US008306445B2

(12) United States Patent
Suzuki et al.

(10) Patent No.: US 8,306,445 B2
(45) Date of Patent: Nov. 6, 2012

(54) IMAGE FORMING APPARATUS, IMAGE FORMING SYSTEM, CONTAINER FOR DEVELOPING AGENT, AND METHOD OF MANUFACTURING CONTAINER FOR DEVELOPING AGENT

(75) Inventors: Satoru Suzuki, Kasugai (JP); Shunsuke Ishii, Toki (JP); Keigo Nakajima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 394 days.

(21) Appl. No.: 12/704,848

(22) Filed: Feb. 12, 2010

(65) Prior Publication Data

US 2010/0202798 A1 Aug. 12, 2010

(30) Foreign Application Priority Data

Feb. 12, 2009 (JP) ..... 2009-030396
Feb. 12, 2009 (JP) ..... 2009-030398
Feb. 12, 2009 (JP) ..... 2009-030439
Feb. 12, 2009 (JP) ..... 2009-030443
Feb. 12, 2009 (JP) ..... 2009-030446
Feb. 12, 2009 (JP) ..... 2009-030447
Feb. 12, 2009 (JP) ..... 2009-030451

(51) Int. Cl.
*G03G 15/10* (2006.01)

(52) U.S. Cl. ..... 399/64

(58) Field of Classification Search ..... 399/27, 399/64, 118, 119
See application file for complete search history.

(56) References Cited

U.S. PATENT DOCUMENTS 5,802,433 A 9/1998 Sato et al.
6,330,402 B1 * 12/2001 Sakurai et al. ..... 399/12
6,337,956 B1 * 1/2002 Sato et al. ..... 399/27
6,456,802 B1 9/2002 Phillips
7,113,711 B2 9/2006 Okamura
2002/0037173 A1 3/2002 Kakeshita
2002/0057918 A1 5/2002 Kojima et al.

(Continued)

FOREIGN PATENT DOCUMENTS

JP 08-292632 11/1996

(Continued)

OTHER PUBLICATIONS

JP Office Action dtd Nov. 30, 2010, JP Appln. 2009-030446, partial English translation.

(Continued)

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming apparatus is provided. The image forming apparatus includes a mounting part configured to allow plural types of cartridges having different initial capacities of developing agent to be detachably mountable therein; a light emitting device configured to emit light into the cartridge mounted in the mounting part; a light receiving device configured to receive light emitted from the light emitting device and passed through an inside of the cartridge; a determining unit configured to determine that a replacement time of the cartridge has been reached when a ratio of time, during which an output value of the light receiving device exceeds a light reception reference value, exceeds a determination threshold value. The image forming apparatus or the cartridges are configured such that the determination of the replacement time changes according to the initial capacity of the cartridge.

9 Claims, 48 Drawing Sheets

U.S. PATENT DOCUMENTS

| | | | | |
|---|---|---|---|---|
| 2005/0008378 | A1 | 1/2005 | Okamura | |
| 2006/0204284 | A1* | 9/2006 | Kawakami et al. | 399/262 |
| 2007/0122165 | A1* | 5/2007 | Igarashi et al. | 399/12 |

FOREIGN PATENT DOCUMENTS

| | | | |
|---|---|---|---|
| JP | 09-146359 | | 6/1997 |
| JP | 11-194602 | A | 7/1999 |
| JP | 2000-321861 | A | 11/2000 |
| JP | 2001-005276 | | 1/2001 |
| JP | 2002-062723 | | 2/2002 |
| JP | 2002-091152 | | 3/2002 |
| JP | 2002-372848 | | 12/2002 |
| JP | 2004-045861 | | 2/2004 |
| JP | 2004-347931 | | 12/2004 |
| JP | 2004-347935 | A | 12/2004 |
| JP | 2005-114933 | | 4/2005 |
| JP | 2005-208077 | | 8/2005 |
| JP | 2005-300685 | | 10/2005 |

OTHER PUBLICATIONS

JP Office Action dtd Nov. 30, 2010, JP Appln. 2009-030451, partial English translation.

JP Office Action dtd Dec. 7, 2010, JP Appln. 2009-030447, partial English translation.

* cited by examiner

IMAGE FORMING APPARATUS, IMAGE FORMING SYSTEM, CONTAINER FOR DEVELOPING AGENT, AND METHOD OF MANUFACTURING CONTAINER FOR DEVELOPING AGENT

CROSS-REFERENCE TO RELATED APPLICATION

This application claims priority from Japanese Patent Application Nos. 2009-030396, 2009-030398, 2009-030439, 2009-030443, 2009-030446, 2009-030447 and 2009-030451, all filed on Feb. 12, 2009, the entire subject matter of which is incorporated herein by reference.

TECHNICAL FIELD

Aspects of the present invention relate to an image forming apparatus that can determine a replacement time of a cartridge mounted therein using an optical detecting unit, an image forming system including at least two types of developing agent containers with different initial capacities of developing agent and an image forming apparatus configured to detachably mountable therein the developing agent containers at a same position, a container for developing agent that is mounted in the image forming apparatus of the image forming system, and a method of manufacturing the container for developing agent.

BACKGROUND

In general, an electrophotographic image forming apparatus is detachably provided with a cartridge (i.e. developing agent container) containing therein toner (i.e. developing agent), and is configured to perform image forming by supplying the toner within the cartridge to a photosensitive body. In such an image forming apparatus, a pair of light transmission windows is oppositely provided on side walls of the cartridge, and an amount of toner within the cartridge is estimated on the basis of a light reception signal obtained by detecting light incident from one light transmission window through the other light transmission window.

However, the toner in the cartridge gradually deteriorates (i.e. the charge performance is gradually lowered) due to repeated agitation thereof, and thus if the number of printed sheets exceeds a predetermined number, it is hardly to obtain the initial charge performance, and the quality of an image being formed deteriorates. Accordingly, in order to form a favorable image, it is required that a predetermined amount of toner still remains in the cartridge without the whole amount of toner in the cartridge being consumed.

In the meantime, it is common that plural types of developing cartridges that contain different initial amounts of toner, for example, two types of cartridges including a large-capacity type developing cartridge and a small-capacity type developing cartridge, are commercially available. However, in the related-art image forming apparatus, it is determined that a cartridge replacement time has been reached when the amount of toner therein becomes not more than a predetermined amount regardless of the initial capacity of toner.

Since the toner deterioration state differs roughly depending upon the use time of the cartridge, even if the same residual amount of toner as that in the large-capacity type developing cartridge remains in the small-capacity type developing cartridge, the toner remaining in the small-capacity type developing cartridge has not deteriorated so much that it lowers the quality of an image. Accordingly, if it is determined that the cartridge replacement time has been reached when the amount of toner is not more than the predetermined amount regardless of the initial capacity of toner, it is determined that the cartridge is to be replaced in spite of the fact that the toner remaining in the small-capacity type developing cartridge is still tolerable to use, and thus it is not possible to efficiently use the toner,

SUMMARY

Accordingly, it is an aspect of the present invention to provide an image forming apparatus that can make it possible to properly use a developing agent up to its deterioration state according to an initial capacity of a cartridge.

It is another aspect of the present invention to provide an image forming system, a container for a developing agent, and a method of manufacturing the container for a developing agent, which makes it possible to use a developing agent up to its proper deterioration state according to an initial capacity of a cartridge.

According to an illustrative embodiment of the present invention, there is provided an image forming apparatus comprising: a mounting part configured to be detachably mountable therein plural types of cartridges having different initial capacities of developing agent; a light emitting device configured to emit light into the cartridge mounted in the mounting part; a light receiving device configured to receive light emitted from the light emitting device and passed through an inside of the cartridge; a determining unit configured to determine that a replacement time of the cartridge has been reached when a ratio of time, during which an output value of the light receiving device exceeds a light reception reference value, exceeds a determination threshold value; and a detecting unit configured to detect an initial capacity of the cartridge mounted in the mounting part, wherein the determining unit changes the determination threshold value in accordance with the initial capacity of the cartridge detected by the detecting unit such that the determination threshold value is larger as the initial capacity of the cartridge is smaller.

According to another illustrative embodiment of the present invention, there is provided an image forming apparatus comprising: a mounting part configured to be detachably mountable therein plural types of cartridges having different initial capacities of developing agent; a light emitting device configured to emit light into the cartridge mounted in the mounting part; a light receiving device configured to receive light emitted from the light emitting device and passed through an inside of the cartridge; a determining unit configured to determine a replacement time of the cartridge based on a light reception signal of the light receiving device; a detecting unit configured to detect an initial capacity of the cartridge mounted in the mounting part; and a light emission time changing unit configured to change a light emission time of the light emitting device in accordance with the initial capacity of the cartridge detected by the detecting unit such that the light emission time is shorter as the initial capacity of the cartridge is smaller.

According to a further illustrative embodiment of the present invention, there is provided an image forming apparatus comprising: a mounting part configured to be detachably mountable therein plural types of cartridges having different initial capacities of developing agent; a light emitting device configured to emit light into the cartridge mounted in the mounting part; a light receiving device configured to receive light emitted from the light emitting device and passed through an inside of the cartridge; a determining unit configured to determine a replacement time of the cartridge based on a light reception signal of the light receiving device; and a detecting unit configured to detect an initial capacity of the cartridge mounted in the mounting part, wherein the determining unit is configured to change a number of sampling points sampled from the light reception signal within a predetermined time period, in accordance with the initial capacity of the cartridge detected by the detecting unit, such that the number of sampling points is smaller as the initial capacity of the cartridge is smaller.

According to a further illustrative embodiment of the present invention, there is provided an image forming apparatus comprising: a mounting part configured to be detachably mountable therein plural types of cartridges having different initial capacities of developing agent; a light emitting device configured to emit light into the cartridge mounted in the mounting part; a light receiving device configured to receive light emitted from the light emitting device and passed through an inside of the cartridge; a determining unit configured to determine a replacement time of the cartridge based on a light reception signal of the light receiving device; a detecting unit configured to detect an initial capacity of the cartridge mounted in the mounting part; and a light emission intensity changing unit configured to change a light emission intensity of the light emitting device in accordance with the initial capacity of the cartridge detected by the detecting unit such that the light emission intensity is smaller as the initial capacity of the cartridge is smaller.

According to a further illustrative embodiment of the present invention, there is provided an image forming apparatus comprising: a mounting part configured to be detachably mountable therein plural types of cartridges having different initial capacities of developing agent; a light emitting device configured to emit light into the cartridge mounted in the mounting part; a light receiving device configured to receive light emitted from the light emitting device and passed through an inside of the cartridge; a determining unit configured to determine that a replacement time of the cartridge has been reached when a ratio of time, during which an output value of the light receiving device exceeds a light reception reference value, exceeds a determination threshold value; and a detecting unit configured to detect an initial capacity of the cartridge mounted in the mounting part, wherein the determining unit changes the light reception reference value in accordance with the initial capacity of the cartridge detected by the detecting unit such that a difference between the light reception reference value and an output value provided when the light receiving device does not receive the light is larger as the initial capacity of the cartridge is smaller.

According to a further illustrative embodiment of the present invention, there is provided an image forming apparatus comprising: a mounting part configured to be detachably mountable therein plural types of cartridges having different initial capacities of developing agent, each of the cartridges including an agitating member configured to rotate to agitate the developing agent therein; a light emitting device configured to emit light into the cartridge mounted in the mounting part; a light receiving device configured to receive light emitted from the light emitting device and passed through an inside of the cartridge; a determining unit configured to determine a replacement time of the cartridge based on a light reception signal of the light receiving device; and a speed changing unit configured to change a rotating speed of the agitating member of the cartridge mounted in the mounting part in accordance with the initial capacity of the cartridge at least when the replacement time of the cartridge is determined, wherein the speed changing unit changes the rotating speed of the agitating member such that the rotating speed of the agitating member is higher as the initial capacity of the cartridge is smaller.

According to a further illustrative embodiment of the present invention, there is provided an image forming system comprising: a first developing agent container configured to contain developing agent; a second developing agent container configured to contain developing agent, wherein an amount of the developing agent contained in the second developing agent container is larger than that of the first developing agent container; and an image forming apparatus configured to be detachably mountable therein the first developing agent container and the second developing agent container at a same position; wherein each of the first developing agent container and the second developing agent container includes: a developing agent containing chamber configured to contain developing agent; and a pair of light transmission parts oppositely provided on side walls developing agent containing chamber, wherein the image forming apparatus includes: a light emitting device configured to emit light; a light receiving device configured to receive light emitted from the light emitting device and passed through the pair of light transmission parts; and a determining unit configured to determine that a replacement time of a developing agent container has been reached when a ratio of time during which the light receiving device receives light with an intensity equal to or larger than a predetermined value over a predetermined time exceeds a determination threshold value, and wherein the first developing agent container is configured such that a light reception time obtained when the first developing agent container having a predetermined amount of developing agent remaining is mounted in the image forming apparatus is shorter than a light reception time obtained when the second developing agent container having the same predetermined amount of developing agent remaining is mounted in the image forming apparatus.

According to a further illustrative embodiment of the present invention, there is provided a developing agent container comprising: a developing agent containing chamber configured to contain developing agent; a pair of light transmission parts provided on opposite side walls of the developing agent containing chamber; and a light shielding member which is rotatably provided inside the developing agent containing chamber, and which is configured to periodically block light to be passed through the pair of light transmission parts for a predetermined time, wherein the developing agent container is set as one of at least two types including a small-capacity type and a large-capacity type having different initial capacities of developing agent in the developing agent containing chamber, and detachably mountable at a same position in an image forming apparatus, and wherein the light shielding member of the small-capacity type is longer than the light shielding member of the large-capacity type in a rotating direction of the light shielding member.

According to a further illustrative embodiment of the present invention, there is provided a developing agent container comprising: a developing agent containing chamber configured to contain developing agent; a pair of light transmission parts provided on opposite side walls of the developing agent containing chamber; a transport member which is rotatably provided inside the developing agent containing chamber, and which is configured to transport the developing agent in the developing agent containing chamber; and a light shielding member which is rotatably provided inside the developing agent containing chamber, and which is configured to periodically block light to be passed through the pair of light transmission parts for a predetermined time, wherein the developing agent container is set as one of at least two types including a small-capacity type and a large-capacity type having different initial capacities of developing agent in the developing agent containing chamber, and detachably mountable at a same position in an image forming apparatus, and wherein a position of the light shielding member of the small-capacity type with respect to the transport member is different from a position of the light shielding member of the large-capacity type with respect to the transport member in a rotating direction of the light shielding member such that the light shielding member of the small-capacity type blocks light to be passed through the pair of light transmission parts for a longer time than the light shielding member of the large-capacity type.

According to a further illustrative embodiment of the present invention, there is provided a developing agent container comprising: a developing agent containing chamber configured to contain developing agent; a pair of light transmission parts provided on opposite side walls of the developing agent containing chamber; and a light shielding member which is rotatably provided inside the developing agent containing chamber, and which is configured to periodically block light to be passed through the pair of light transmission parts for a predetermined time, wherein the developing agent container is set as one of at least two types including a small-capacity type and a large-capacity type having different initial capacities of developing agent in the developing agent containing chamber, and detachably mountable at a same position in an image forming apparatus, and wherein the small-capacity type is provided with a number of the light shielding members larger than a number of the light shielding members provided in the large-capacity type such that the light shielding members of the small-capacity type block light to be passed through the pair of light transmission parts for a longer time than the light shielding member of the large-capacity type.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber; and a light shielding member which is rotatably provided inside the developing agent containing chamber and which is configured to periodically block light to be passed through the pair of light transmission parts, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the light shielding member which is longer than the light shielding member provided for the large-capacity type in a rotating direction of the light shielding member.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber; a transport member which is rotatably provided inside the developing agent containing chamber and which is configured to transport developing agent in the developing agent containing chamber; and a light shielding member which is rotatably provided inside the developing agent containing chamber, and which is configured to periodically block light to be passed through the pair of light transmission parts for a predetermined time, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the light shielding member at a position different from a position of the light shielding member provided for the large-capacity type with respect to the transport member in a rotating direction of the shielding member such that the light shielding member of the small-capacity type blocks light to be passed through the pair of light transmission parts for a longer time than the light shielding member of the large-capacity type.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber; and a light shielding member which is rotatably provided inside the developing agent containing chamber and which is configured to periodically block light to be passed through the pair of light transmission parts, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing a number of shielding members in the small-capacity type larger than a number of shielding member provided in the large-capacity type such that the light shielding members of the small-capacity type block light to be passed through the pair of light transmission parts for a longer time than the light shielding member of the large-capacity type.

According to a further illustrative embodiment of the present invention, there is provided an image forming system comprising: a first developing agent container configured to contain developing agent; a second developing agent container configured to contain developing agent, wherein an amount of the developing contained in the second developing agent container is larger than that of the first developing agent container; and an image forming apparatus configured to be detachably mountable therein the first developing agent container and the second developing agent container at a same position; wherein each of the first developing agent container and the second developing container includes: a developing agent containing chamber configured to contain developing agent; a pair of light transmission parts oppositely provided on side walls there of the developing agent containing chamber; an agitating member which is rotatably provided inside the developing agent containing chamber, and which is configured to agitate the developing agent in the developing agent containing chamber; and a pair of cleaning members which is rotatably provided inside the developing agent containing chamber to clean the pair of light transmission parts, respectively, wherein the image forming apparatus includes: a light emitting device configured to emit light; a light receiving device configured to receive light emitted from the light emitting device and passed through the pair of light transmission parts; and a determining unit configured to determine that a replacement time of a developing agent container has been reached when a ratio of time, during which the light receiving device receives light with an intensity equal to or larger than a predetermined value over a predetermined time, exceeds a determination threshold value, and wherein a position of the cleaning members with respect to the agitating member in the first developing agent container is arranged on an upstream in a rotating direction from a position of the cleaning members with respect to the agitating member in the second developing agent container.

According to a further illustrative embodiment of the present invention, there is provided a developing agent container comprising: a developing agent containing chamber configured to contain developing agent; a pair of light transmission parts provided on opposite side walls of the developing agent containing chamber; an agitating member which is rotatably provided inside the developing agent containing chamber, and which is configured to agitate the developing agent in the developing agent containing chamber; and a pair of cleaning members which is rotatably provided inside the developing agent containing chamber to clean the pair of light transmission parts, respectively, wherein the developing agent container is set as one of at least two types including a small-capacity type and a large-capacity type having different initial capacities of developing agent in the developing agent containing chamber, and detachably mountable at a same position in an image forming apparatus, and wherein a position of the cleaning members with respect to the agitating member in the small-capacity type is arranged on an upstream in a rotating direction from a position of the cleaning members with respect to the agitating member in the large-capacity type.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber; an agitating member which is rotatably provided inside the developing agent containing chamber and which is configured to agitate the developing agent in the developing agent containing chamber; and a pair of cleaning members which is rotatably provided inside the developing agent containing chamber to clean the pair of light transmission parts, respectively, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the cleaning members at a position with respect to the agitating member upstream in a rotating direction from a position of the cleaning members with respect to the agitating member in the large-capacity type.

According to a further illustrative embodiment of the present invention, there is provided an image forming system comprising: a first developing agent container configured to contain developing agent; a second developing agent container configured to contain developing agent, wherein an amount of the developing agent contained in the second developing agent container is larger than that of the first developing agent container; and an image forming apparatus configured to be detachably mountable therein the first developing agent container and the second developing agent container at a same position, wherein each of the first developing agent container and the second developing agent container includes: a developing agent containing chamber configured to contain developing agent; a pair of light transmission parts oppositely provided on side walls there of the developing agent containing chamber, wherein the image forming apparatus includes: a light emitting device configured to emit light; a light receiving device configured to receive light emitted from the light emitting device and passed through the pair of light transmission parts; and a determining unit configured to determine that a replacement time of a developing agent container has been reached when a ratio of time, during which the light receiving device receives light with an intensity equal to or larger than a predetermined value over a predetermined time, exceeds a determination threshold value, and wherein the first developing agent container is configured such that a light reception intensity obtained when the first developing agent container having a predetermined amount of developing agent remaining is mounted in the image forming apparatus is lower than a light reception intensity obtained when the second developing agent container having the same predetermined amount of developing agent remaining is mounted in the image forming apparatus.

According to a further illustrative embodiment of the present invention, there is provided a developing agent container comprising: a developing agent containing chamber configured to contain developing agent; and a pair of light transmission parts provided on opposite side walls of the developing agent containing chamber; and a light shielding part provided to overlap a part of the light transmission part to shield a part of light to be passed through the pair of light transmission parts.

According to a further illustrative embodiment of the present invention, there is provided a developing agent container comprising: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of the developing agent in the developing agent containing chamber, and detachably mountable at a same position in an image forming apparatus, and wherein the light transmission part of the small-capacity type is formed of a material having a light transmittance lower than that of the light transmission part of the large-capacity type.

According to a further illustrative embodiment of the present invention, there is provided a developing agent container comprising: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of the developing agent in the developing agent containing chamber, and detachably mountable at a same position in an image forming apparatus, and wherein the light transmission part of the small-capacity type has a thickness larger than that of the light transmission part of the large-capacity type.

According to a further illustrative embodiment of the present invention, there is provided a developing agent container comprising: a developing agent containing chamber configured to contain developing agent; and a pair of light transmission parts provided on opposite side walls of the developing agent containing chamber, wherein the light transmission parts include a member configured to expand light.

According to a further illustrative embodiment of the present invention, there is provided a developing agent container comprising: a developing agent containing chamber configured to contain developing agent; a pair of light transmission parts provided on opposite side walls of the developing agent containing chamber; and a pair of cleaning members which is rotatably provided inside the developing agent containing chamber to clean the pair of light transmission parts, respectively, wherein the cleaning member is configured to clean only a part of the light transmission parts.

According to a further illustrative embodiment of the present invention, there is provided a developing agent container comprising: a developing agent containing chamber configured to contain developing agent; a pair of light transmission parts provided on opposite side walls of the developing agent containing chamber; and a shutter configured to be movable between a light shielding position in which the shutter overlaps a part of the light transmission part and an open position in which the shutter does not overlap the light transmission part as seen from a facing direction of the pair of the light transmission parts.

According to a further illustrative embodiment of the present invention, there is provided a method of manufacturing a developing agent container including: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing a light shielding part to overlap a part of the light transmission part to shield a part of light to be passed through the pair of light transmission parts, According to a further illustrative embodiment of the present invention, there is provided a method of manufacturing a developing agent container including: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the light transmission part formed of a material having a light transmittance lower than that of the light transmission part for the large-capacity type.

According to a further illustrative embodiment of the present invention, there is provided a method of manufacturing a developing agent container including: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the light transmission part having a thickness larger than that of the light transmission part for the large-capacity type.

According to a further illustrative embodiment of the present invention, there is provided a method of manufacturing a developing agent container including: a developing agent containing chamber configured to contain developing agent; and a pair of light transmission parts provided on opposite side walls of the developing agent containing chamber, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the light transmission part including a member configured to expands light further than that of the light transmission part for the large-capacity type.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber, and a pair of cleaning members which is rotatably provided inside the developing agent containing chamber to clean the pair of light transmission parts, respectively, wherein the developing agent container is set as one of at least two types including a small-capacity type and a large-capacity type having different initial capacities of developing agent in the developing agent containing chamber, and detachably mountable at a same position in an image forming apparatus, the method comprising: when the small-capacity type is manufactured, providing the cleaning member to clean an area of the light transmission part which is smaller than an area of the light transmission part which is cleaned by the cleaning member for the large-capacity type.

According to a further illustrative embodiment of the present invention, there is provided a method of manufacturing a developing agent container including: a developing agent containing chamber configured to contain developing agent; a pair of light transmission parts provided on opposite side walls of the developing agent containing chamber; and a shutter configured to be movable between a light shielding position in which the shutter overlaps a part of the light transmission part and an open position in which the shutter does not overlap the light transmission part as seen from a facing direction of the pair of the light transmission parts, wherein the developing agent container is set as one of at least two types including a small-capacity type and a large-capacity type having different initial capacities of the developing agent in the developing agent containing chamber, and detachably mountable at a same position in an image forming apparatus, the method comprising; when the small-capacity type is manufactured, providing the shutter to the light shielding position, and when a large-capacity type is manufactured, providing the shutter to the open position.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Figure 1:
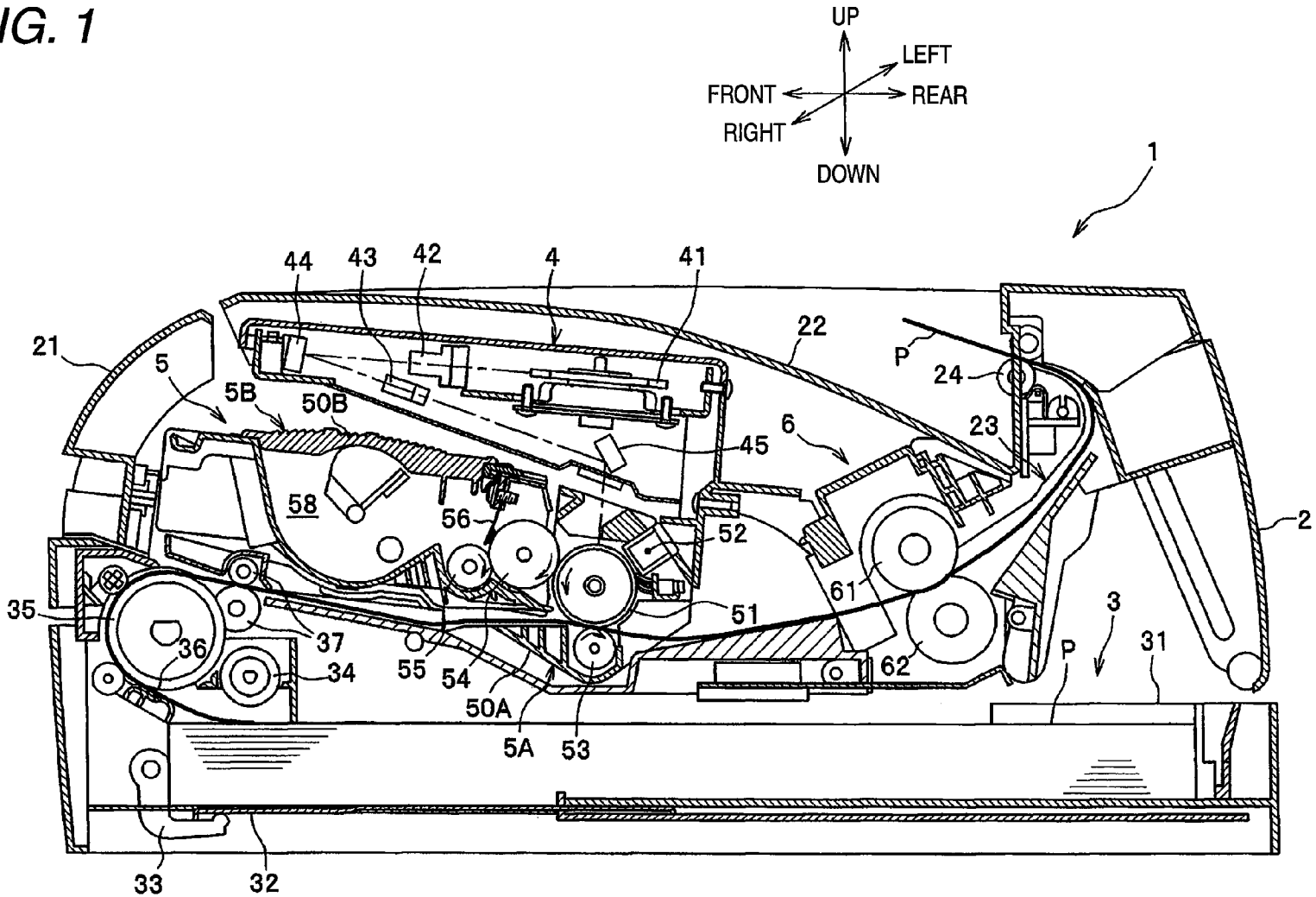
FIG. 1 is a cross-sectional view of a laser printer as an example of an image forming apparatus according to a first illustrative embodiment of the present invention.

Hereinafter, illustrative embodiments of the present invention will be described in detail while referring to the accompanying drawings. In the following description, directions are defined from a user who operates a laser printer. That is, for example in FIG. 1, a left side and a right side are "front" and "rear", respectively, and a front side and a deep inside are "right" and "left", respectively. Also, upper and lower directions in FIG. 1 are "upper" and "lower", respectively.

<First Illustrative Embodiment>

Schematic Configuration of Laser Printer

Hereinafter, illustrative embodiments of the present invention will be described in detail while referring to the accompanying drawings. In the following description, directions will be described on the basis of a user who operates a laser printer. That is, in FIG. 1, As illustrated in FIG. 1, a laser printer 1 is mainly provided with a feed unit 3 supplying a paper P, an exposure device 4, a process unit 5 transferring a toner image onto the paper P, and a fusing device 6 thermally fusing the transferred toner image on the paper P, which are provided within a main body casing 2. The paper P may be normal paper, a postcard, an OHP sheet, or the like.

The feed unit 3 is provided in a lower portion of an inside of the main body casing 2, and is mainly provided with a feed tray 31 accommodating a paper P, a paper pressing plate 32 and a lift lever 33 lifting a front side of the paper P, a pickup roller 34, a feed roller 35, a feed pad 36, and a resist roller 37. The paper P inside the feed tray 31 is pushed near to the pickup roller 34 by the lift lever 33 and the paper pressing plate 32, and is fed by the pickup roller 34. The fed paper P is separated sheet by sheet by the feed roller 35 and the feed pad 36, passes through the resist roller 37, and then is transported toward a gap between a photosensitive drum 51 and a transfer roller 53.

The exposure device 4 is provided in an upper portion of the inside of the main body casing 2, and is mainly provided with a laser light emitting unit (not illustrated), a rotary polygon mirror 41, lenses 42 and 43, and reflecting mirrors 44 and 45. The laser light (see dotted line) emitted from the laser light emitting unit on the basis of image data is reflected by or passes through the polygon mirror 41, the lens 42, the reflecting mirror 44, the lens 43, and the reflecting mirror 45 in order, and then is radiated onto a surface of the photosensitive drum 51 with high-speed scanning.

The process unit 5 is mounted in a mounting part provided at a lower side of the exposure device 4, and is configured to be detachable through an opening provided when a front cover 21 provided on the main body casing 2 is opened with respect to the main body casing 2. This process unit 5 includes a photosensitive unit 5A and a developing cartridge 5B as an example of a cartridge.

The photosensitive unit 5A is mainly provided with the photosensitive drum 51, a charger 52, and the transfer roller 53, which are provided inside a photosensitive frame 50A. Also, the developing cartridge 5B is configured to be detachably mounted with respect to the photosensitive unit 5A, and is mainly provided with a developing roller 54, a supply roller 55, and a layer thickness restricting blade 56, which are provided inside a developing frame 50B. The developing cartridge 5B has a toner containing chamber 58 (i.e. developing agent containing chamber) accommodating therein the toner as an example of the developing agent.

After being uniformly charged by the charger 52 in the process unit 5, the surface of the photosensitive drum 51 is exposed by high-speed scanning of the laser light from the exposure device 4, and thus an electrostatic latent image on the basis of the image data is formed on the photosensitive drum 51. Also, the toner inside the toner containing chamber 5S is supplied to the developing roller 54 through the supply roller 55, enters into a gap between the developing roller 54 and the layer thickness restricting blade 56, and then is adhered on the developing roller 54 as a thin layer with a predetermined thickness.

The toner adhered on the developing roller 54 is supplied from the developing roller 54 onto the electrostatic latent image formed on the photosensitive drum 51. Accordingly, the electrostatic latent image is developed into a visible image and a toner image is formed on the photosensitive drum 51. Thereafter, the paper P is transported between the photosensitive drum 51 and the transfer roller 53, and thus the toner image on the photosensitive drum 51 is transferred onto the paper P.

The fusing device 6 is provided in the rear of the process unit 5, and is mainly provided with a heating roller 61 and a press roller 62, between which the paper P is positioned. The toner image transferred onto the paper P is thermally fused on the paper P as the paper P is transported between the heating roller 61 and the press roller 62. The paper P on which the toner image has been thermally fused is transported from the fusing device 6 to a discharge path 23, and then is discharged onto a discharge tray 22 by a discharge roller 24 from the discharge path 23.

Determination of Replacement Time of Developing Cartridge

The determination of the replacement time of the developing cartridge 5B will be described in detail while referring to the accompanying drawings. In the following description, the configuration of the developing cartridge 5B and the main body casing 2, which are related to the determination of the replacement time, will be first described, and then the determination of the replacement time according to the first illustrative embodiment of the present invention will be described.

Configuration of Developing Cartridge

The developing cartridge 5B mountable in the laser printer 1 is classified into two types which contain different initial amounts of toner. Specifically, for example, there are a large-capacity type developing cartridge for which the number of sheets that can be printed is set to 6,000 and a small-capacity type developing cartridge for which the number of sheets that can be printed is set to 3,000 and which contains an initial capacity of toner smaller than that of the large-capacity type developing cartridge. In this case, the respective types of developing cartridges 5B have different initial capacities of toner T contained in their toner containing chambers 58, but their configurations are substantially the same.

Figure 2:
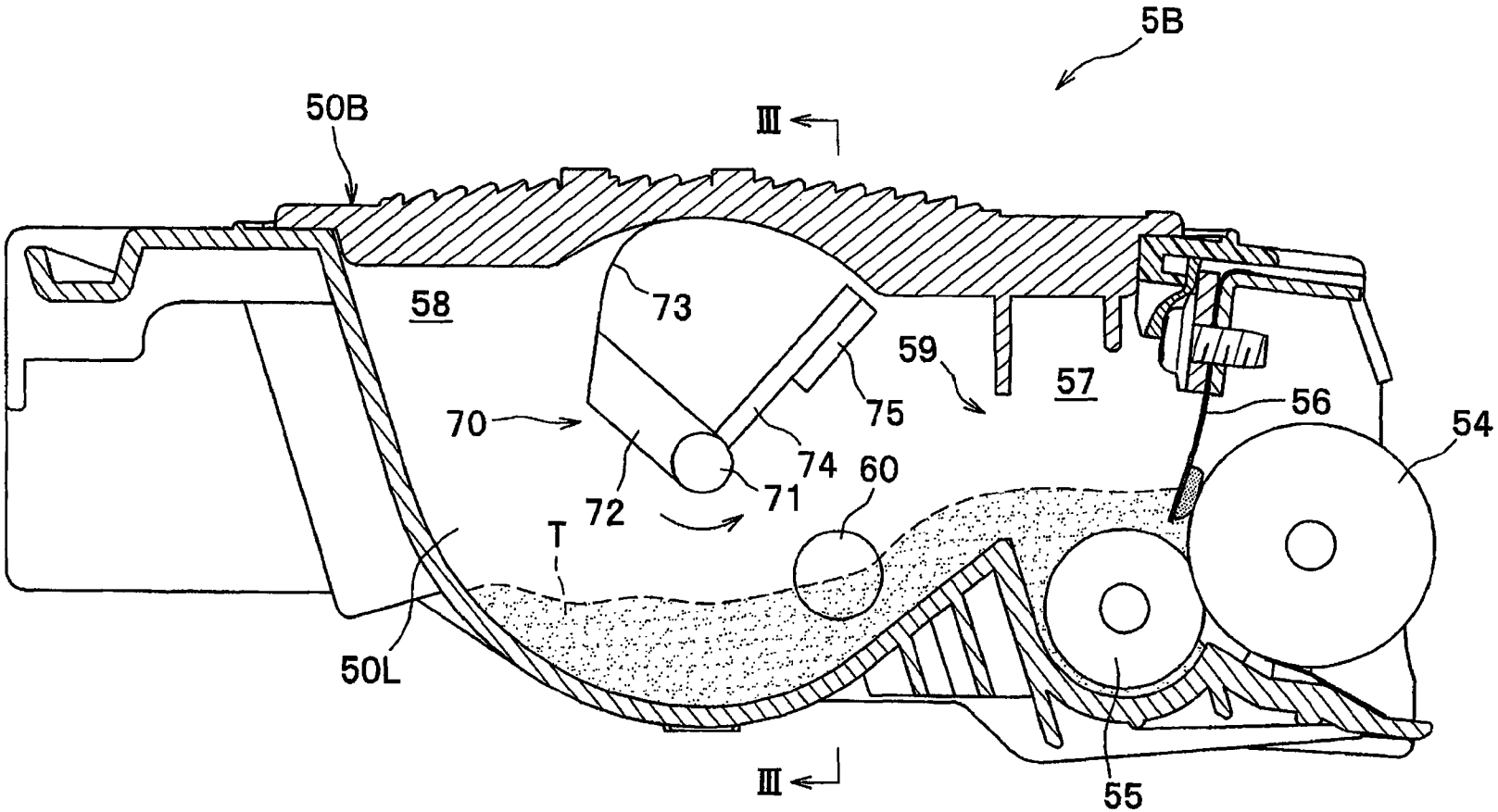
FIG. 2 is an enlarged cross-sectional view of a developing cartridge according to the first illustrative embodiment.

As illustrated in FIG. 2, the developing cartridge 5B is partitioned into a developing chamber 57, in which the supply roller 55 or the like is arranged, and the toner containing chamber 58, in which the toner T is accommodated by way of the developing frame 50B. The developing chamber 57 and the toner containing chamber 58 communicate with each other through a communicating part 59. This communicating part 59 is formed over the substantially entire width in an axis direction of a roller portion of the supply roller 55, and the toner T can communicate between the developing chamber 57 and the toner containing chamber 58 through the communicating part 59.

Figure 3:
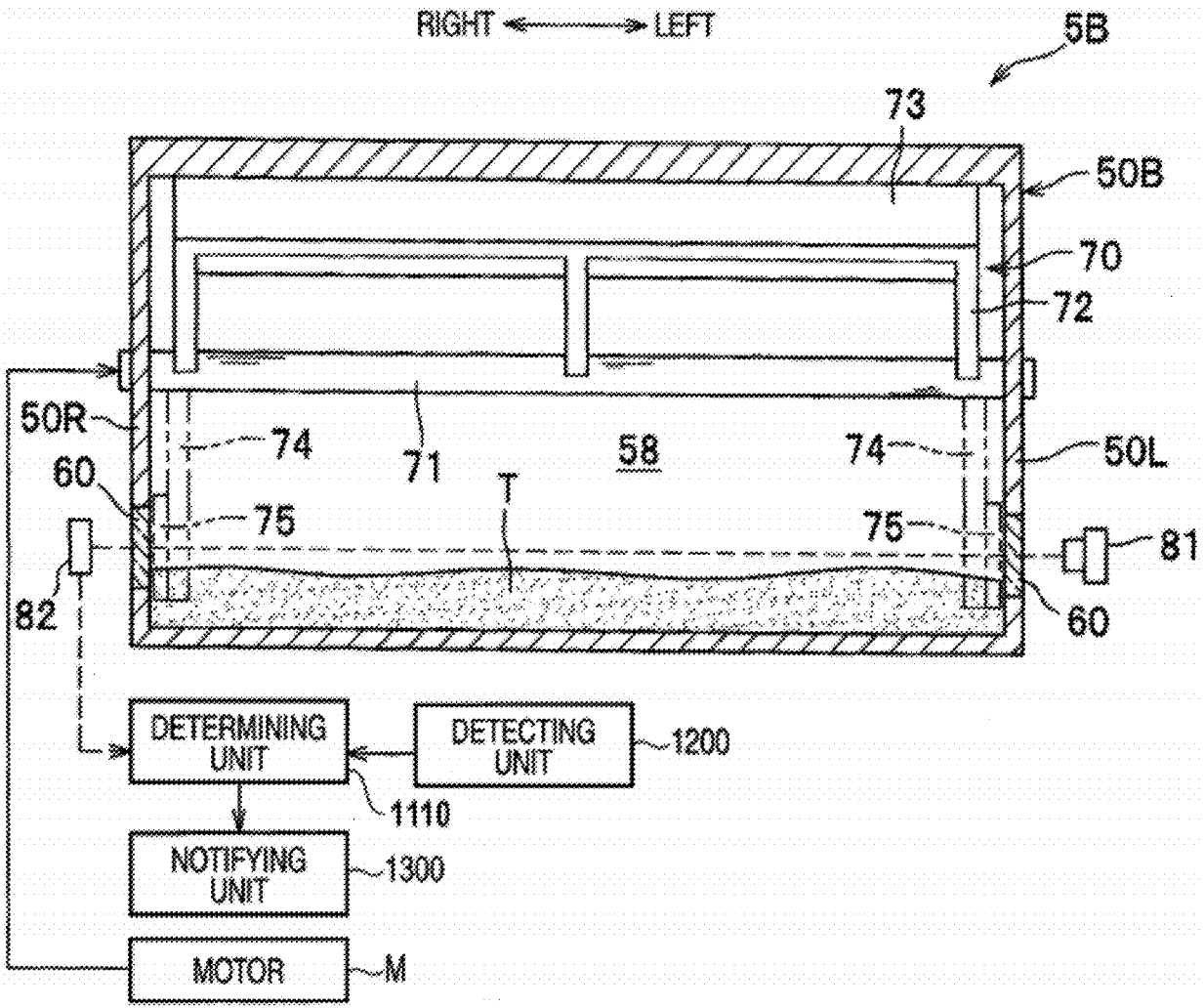
FIG. 3 is a cross-sectional view taken along line III-III in FIG. 2 illustrating a configuration of an image forming apparatus according to the first illustrative embodiment.

In the toner containing chamber 58, an agitator 70 that rotates to agitate the toner T is provided. Also, as illustrated in FIG. 3, on side walls 50L and 50R of the toner containing chamber 58 (i.e. developing frame 50B), transparent light transmission windows 60 (i.e. light transmission parts) are oppositely provided in the left/right direction.

As illustrated in FIG. 2, the agitator 70 is mainly provided with a rotating spindle 71, a sheet attaching unit 72, a sheet member 73, a wiper attaching unit 74, and a wiper 75.

The rotating spindle 71 is a shaft extending along the axis direction (i.e. left/right direction) of the developing roller 54 and the supply roller 55, and both ends of the rotating spindle 71 is rotatably supported on the side walls 50L and 50R (in FIG. 2, only one side is illustrated) of the developing frame 50B.

The sheet attaching unit 72 is formed to extend to the outside in a diameter direction from the rotating spindle 71, and its front end is fixed to the sheet member 73 by adhesion or the like.

The sheet member 73 is a flexible sheet type member which, by the rotation of the agitator 70, agitates the toner T as its front end slides across a bottom wall of the toner containing chamber 58, or the like, and transports the agitated toner T toward the developing chamber 57.

The wiper attaching unit 74 is provided in each place in the periphery of both ends in axis direction of the rotating spindle 71 (Refer to FIG. 3). The wiper attaching unit 74, at the rear of the rotating direction of the sheet attaching unit 72, as seen from its side, is formed in a position that is substantially perpendicular to the sheet attaching unit 72 so as to extend to the outside in the diameter direction from the rotating spindle 71. In the wiper attaching unit 74, a wiper 75 is fixed by adhesion to an outside surface in an axis direction of the rotating spindle 71.

The wiper 75, as illustrated in FIG. 3, is a member that wipes the toner T attached to the light transmission window 60 as it slides across the light transmission window 60, and is formed of a flexible material, such as urethane rubber, or the like.

FIG. 3 shows a position in which the wiper 75 slides across the light transmission window 60.

The agitator 70 as configured above rotates counterclockwise about the rotating spindle 71 in the toner containing chamber 58 to agitate and transport the toner T by way of the sheet member 73 due to a rotation driving force given from a motor M provided inside the main body casing 2.

Configuration of Main Body Casing

As illustrated in FIG. 3, the laser printer 1 includes a light emitting device 81, a light receiving device 82, a determining unit 1110 configured to determine the replacement time of the developing cartridges 5B, a detecting unit 1200 configured to detect an initial capacity of the mounted developing cartridge 5B, and a notifying unit 1300 configured to notify a user of a message.

The light emitting device 81 and the light receiving device 82 are oppositely arranged and interposed between a pair of light transmission windows 60 of the developing cartridge 5B mounted in the main body casing 2. As the light emitting device 81 and the light receiving device 82, commonly known light sensors may be adopted.

Figure 4:
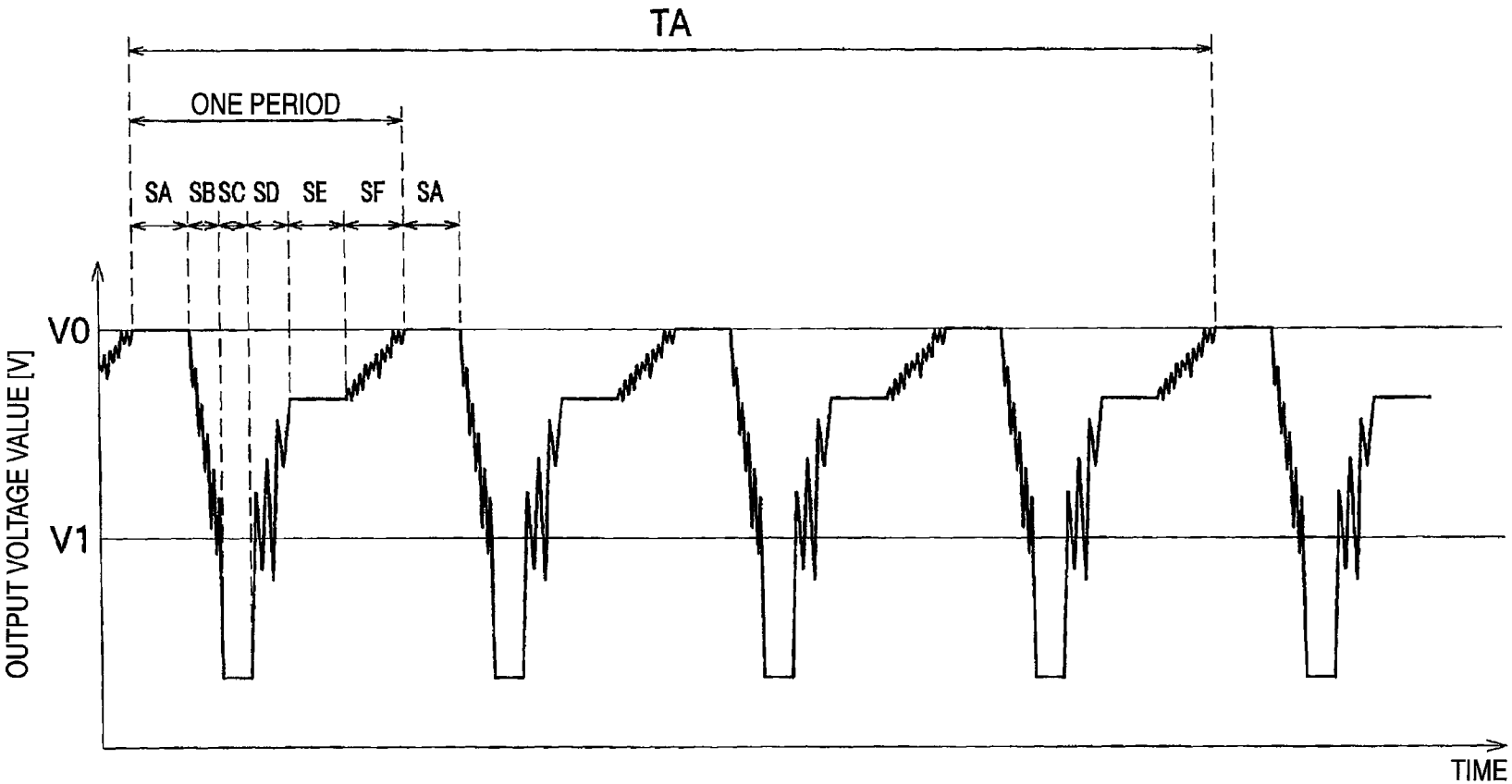
FIG. 4 is a time chart showing an output voltage value of a light receiving device according to the first illustrative embodiment.

As illustrated as a dotted line FIG. 3, light emitted from the light emitting device 81 enters into the developing cartridge 5B (i.e. toner containing chamber 58) through one side light transmission window 60, and is received in the light receiving device 82 through the other side light transmission window 60. The light receiving device 82 is a device of which the output voltage value is changed depending upon the intensity of the received light, and outputs a light reception signal as shown in FIG. 4 to the determining unit 1110.

Here, the light reception signal will be described with reference to FIGS. 4 and 5A to 5D. In the first illustrative embodiment, the light receiving device 82 is adopted such that when the intensity of the received light is at a minimum, the output voltage value becomes maximum, while when the intensity of the received light is maximum, the output voltage value becomes minimum. Accordingly, as shown in FIG. 4, as the output voltage value gets larger, the intensity of the received light is lower, while as the output voltage value gets smaller, the intensity of the received light is higher. In this case, V0 denotes the output voltage value when the light receiving device 82 receives no light (i.e. when the intensity of the received light is minimum).

Figure 5A:
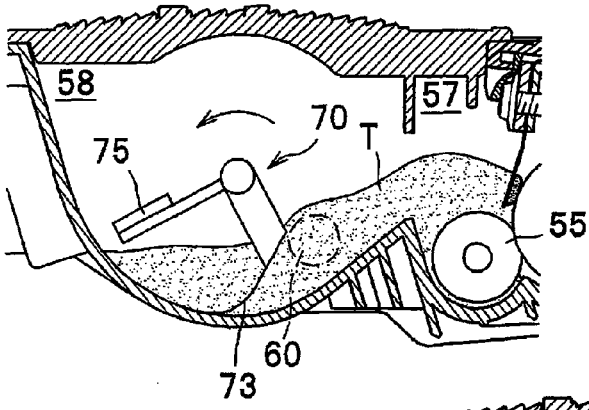
FIGS. 5A, 5B, 5C and 5D are cross-sectional views for explaining the operation of an agitator and movement of toner according to the first illustrative embodiment.

As shown in FIG. 5A, in a process in which the sheet member 73, by the rotation of the agitator 70, gathers and transports the toner T to the side of the developing chamber 57 as the sheet member 73 slides across the bottom surface of the toner containing chamber 58, if the gathered toner T completely covers the light transmission window 60, the light receiving device 82 is in a state in which the light receiving device 82 hardly receives any light, and thus the output voltage value becomes maximum (in FIG. 4, the output voltage value is changed to be in the neighborhood of V0) (corresponding to a region SA).

Figure 5B:
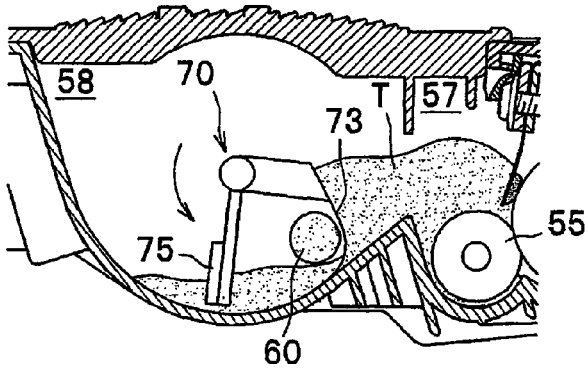

As shown in FIG. 5B, if the sheet member 73 passes between the pair of light transmission windows 60 by the rotation of the agitator 70, the amount of toner T between the pair of light transmission windows 60 is abruptly decreased due to the transport of the toner by the sheet member 73, and thus the intensity of the light that is received in the light receiving device 82 is abruptly heightened. Accordingly, the output voltage value becomes abruptly small (corresponding to a region SB).

Figure 5C:
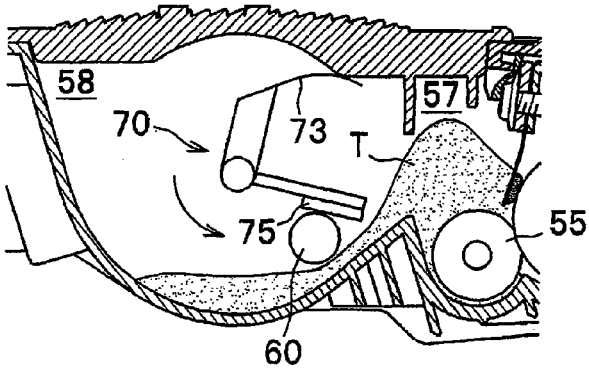

Although at the time of the region SB, the toner T is attached to the light transmission window 60, the toner T that is attached to the light transmission window 60 is wiped by the wiper 75 as shown in FIG. 5C, and thus the intensity of the light received in the light receiving device 82 becomes maximum and causes the output voltage value to becomes minimum (corresponding to a region SC).

Figure 5D:
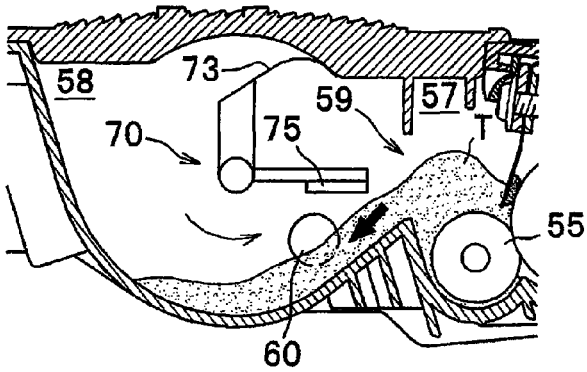

Although in the process as shown in FIGS. 5A to 5C, the toner T is accumulated in the developing chamber 57, a part of the toner T crumbles as shown in FIG. 5D, and thus the toner T flows into the toner containing chamber 58 through the communicating part 59. As the toner T having flowed into the toner containing chamber 58 covers at least a part of the light transmission window 60, the intensity of the light received in the light receiving device 82 is lowered and causes the output voltage value to become large (corresponding to a region SD).

Thereafter, as shown in FIG. 2, while the sheet member 73 slides across an upper wall or a front wall of the toner containing chamber 58, the amount of movement of the toner T in the periphery of the light transmission window 60 becomes small, and thus the output voltage value is shifted to a substantially constant level (corresponding to a region SE). Also, as the sheet member 73 pushes into the toner T accumulated on the bottom wall of the toner containing chamber 58, gradually gathers and transports the toner T to the side of the developing chamber 57 as the sheet member 73 slides across the bottom wall of the toner containing chamber 58, the light transmission window 60 is gradually covered with the toner T, and thus the output voltage value becomes larger (corresponding to a region SF). Once the light transmission window 60 is completely covered, the output voltage value becomes maximum (corresponding to the region SA).

In this case, the time ratio of the respective regions in the light reception signal is changed according to the residual amount of toner T inside the developing cartridge 5B. That is, if there is a large residual amount of toner T, a large amount of toner T, although the toner T attached to the light transmission window 60 is wiped by the wiper 75, flows into the toner containing chamber 58 and covers the light transmission window 60, and the time of the region SC becomes shortened. Also, since it is difficult for the light to pass through the developing cartridge 5B, the output voltage value in the entire region SE is increased.

If the amount of toner T is sufficient immediately after the replacement of the developing cartridge 5B, the toner T flows into the toner containing chamber 58 to cover the light transmission window 60 just after the sheet member 73 transports the toner T to the developing chamber 57, and thus the output voltage value in the entire region SB is increased with the region SC almost vanishing.

On the other hand, if the residual amount of toner T is decreased, the time of the region SC is gradually lengthened and the time of the regions SD and SE is shortened. Also, since the light can readily pass through the developing cartridge 5B, the output voltage value in the entire regions SA and SE is decreased.

As shown in FIG. 3, the determining unit 1110 is provided with a Central Processing Unit (CPU), a Random Access Memory (RAM), a Read Only Memory (ROM), an input/output circuit, and the like (not illustrated). The determining unit 1110 mainly determines the replacement time of the developing cartridge 5B on the basis of a program or data stored in the ROM, outputs from the light receiving device 82 and the detecting unit 1200, and the like.

The basic flow of the replacement time determination will be briefly described. As shown in FIG. 4, in a predetermined time TA including one or plural periods (e.g. one period is a time required for one rotation of the agitator 70, and four periods are provided as shown in FIG. 4), the time during which the output voltage value exceeds a preset light reception reference value V1 (i.e. in FIG. 4, the time during which the output voltage value is lower than the reference value V1) is calculated. Then, the ratio of the time during which the output voltage value exceeds the light reception reference value V1 over the predetermined time TA is calculated. The calculated time ratio is compared with a preset determination threshold value, and if the calculated time ratio exceeds the determination threshold value, it is determined that the replacement time of the developing cartridge 5B has been reached.

For example, if the ratio of the time during which the output voltage value exceeds the light reception reference value V1 over the predetermined time TA is 13% and the determination threshold value is set to 12%, the ratio of the time during which the output voltage value exceeds the light reception reference value V1 exceeds the determination threshold value, and thus the determining unit 1110 determines that the replacement time of the developing cartridge 5B has been reached.

The method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time TA, and whether the output voltage value (i.e. respective sampling point) every predetermined time exceeds the light reception reference value may be determined. In this case, the ratio of sampling points that exceed the determination reference value over the entire sampling points may be calculated, and the replacement time may be determined depending upon whether the ratio exceeds the determination threshold value.

In the first illustrative embodiment, the determining unit 1110, when determining the replacement time, changes the determination threshold value according to the initial capacity of the developing cartridge 5B (i.e. whether the developing cartridge 5B is a large-capacity type or a small-capacity type) detected by the detecting unit 1200 to be described later. Specifically, the determining unit 1110 changes the determination threshold value so that the larger determination threshold value is used to determine the replacement time of the small-capacity type developing cartridge.

Specifically, the determining unit 1110 uses the determination threshold value Th1 (e.g. 12%) when determining the replacement time of the large-capacity type developing cartridge, and uses the determination threshold value Th2 (e.g. 24%) that is larger than the determination threshold value Th1 (e.g. 12%). The operation when the determination threshold value is set to be large will be described later.

The detecting unit 1200 detects whether the developing cartridge 5B mounted in the main body casing 2 is a large-capacity type or a small-capacity type, and outputs the result of detection to the determining unit 1110. The detecting unit 1200 may adopt a known configuration for detecting the specification of the developing cartridge 5B mounted in the main body casing 2. For example, a device that reads initial capacity information from an IC chip provided in the developing cartridge 5B or a sensor for detecting the initial capacity of the mounted developing cartridge 5B in accordance with the change of the detection state may be adopted.

The notifying unit 1300 notifies a user who operates the laser printer 1 of a message. In the first illustrative embodiment of the present invention, when the determining unit 1110 determines that the replacement time of the developing cartridge has been reached, the notifying unit 1300 notifies a user of the message to the corresponding effect. The notifying unit 1300 may adopt, for example, a liquid crystal display notifying the message as text, pictures, and the like, a speaker notifying the message as sound, a lamp notifying the message by flickering light, or the like. Also, the notifying unit 1300 may adopt a combination of two or more of the liquid crystal display, the speaker, the lamp, and the like.

Determination of Replacement Time of Developing Cartridge

Next, the determination of the replacement time of the developing cartridge 5B and the operation when the determination threshold value is set according to the first illustrative embodiment of the present invention will be described while referring to the accompanying drawings.

Figure 6:
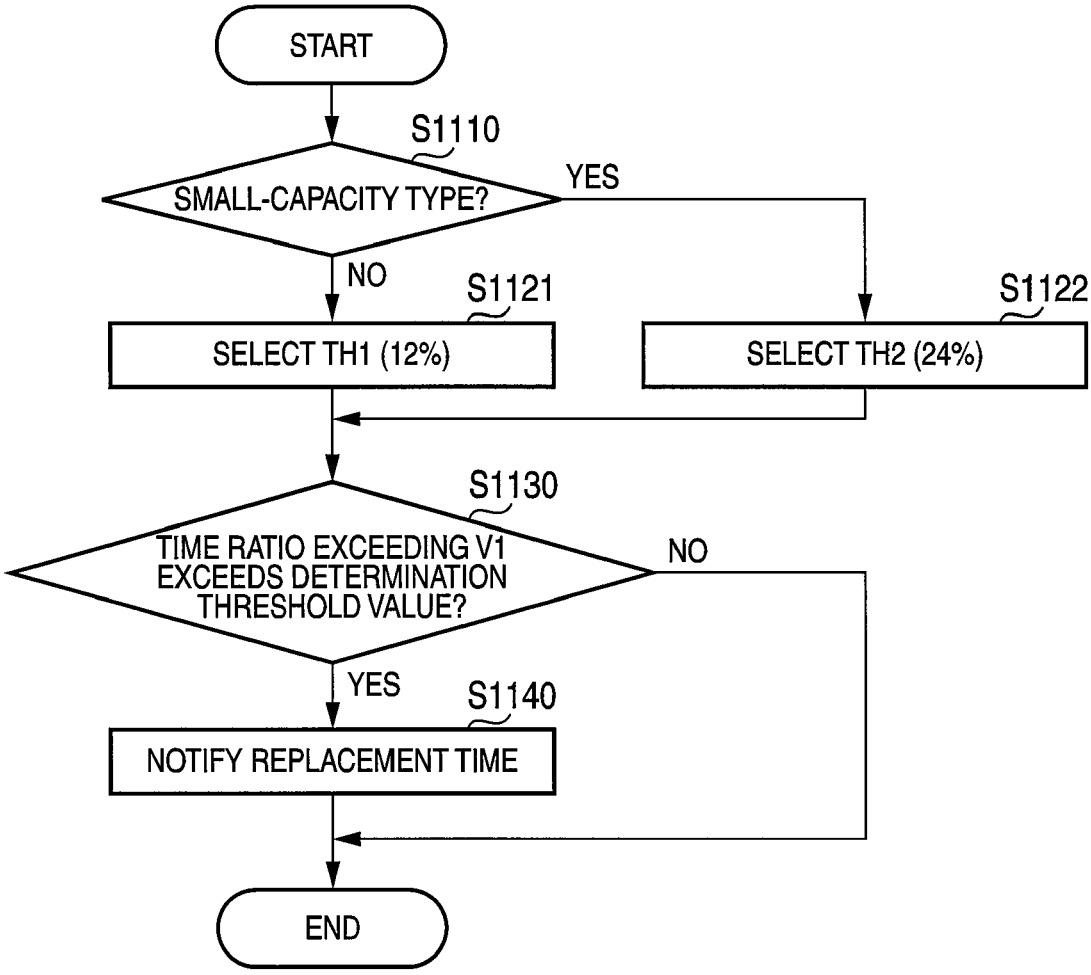
FIG. 6 is a flowchart of a replacement time determination by a determining unit according to the first illustrative embodiment.

As illustrated in FIG. 6, the determining unit 1110 first determines whether the developing cartridge 5B mounted in the main body casing 2 is a small-capacity type or a large-capacity type on the basis of information about the type (i.e. initial capacity) of the developing cartridge 5B that is detected by the detecting unit 1200 (step S1110).

If the developing cartridge 5B is a large-capacity type ("No" in step S1110), the determining unit 1110 selects the determination threshold value Th1 (e.g. 12%) (step S1121). On the other hand, if the developing cartridge 5B is a small-capacity type ("Yes" in step S1110), the determining unit 1110 selects the determination threshold value Th2 (e.g. 24%) (step S1122).

Then, the determining unit 1110 determines whether the ratio of the time, during which the output voltage value exceeds the light reception reference value V1, exceeds the determination threshold value Th1 or Th2 (step S1130). If the ratio of the time, during which the output voltage value exceeds the light reception reference value V1, exceeds the determination threshold value Th1 or Th2 ("Yes" in step S1130), the determining unit 1110 determines that the replacement time of the developing cartridge 5B has been reached, and notifies the notifying unit 1300 of the message to the corresponding effect (step S1140). If the ratio of the time, during which the output voltage value exceeds the light reception reference value V1 does not exceed the determination threshold value Th1 or Th2 ("No" in step S1130), the determining unit 1110 terminates the determination of the replacement time without notification.

As described above, in the case of using the small-capacity type developing cartridge, the determination threshold value Th2 (e.g. 24%) is set to be larger than the determination threshold value Th1 (e.g. 12%), and thus the time can be lengthened for which the ratio of the time, during which the output voltage value, exceeds the light reception reference value V1, exceeds the determination threshold value Th2. Accordingly, the time, which is required until it is determined that the replacement time of the small-capacity type developing cartridge 5B has been reached, can be lengthened.

Specifically, it is assumed that the ratio of the time during which the output voltage value exceeds the light reception reference value V1 is, for example, 13% in both the large-capacity type developing cartridge and the small-capacity type developing cartridge. In this case, in the large-capacity type developing cartridge, the ratio of the time exceeds the determination threshold value Th1 (e.g. 12%), and thus it is determined that the replacement time has been reached. In contrast, in the small-capacity type developing cartridge, the ratio of the time does not exceed the determination threshold value Th2 (e.g. 24%), and thus it is determined that the replacement time has not been reached. As a result, the use time of the small-capacity type developing cartridge 5B can be lengthened.

As described above, even if there is the same residual amount of toner T as that in the large-capacity type developing cartridge, the toner T remaining in the small-capacity type developing cartridge has not deteriorated so much that it lowers the quality of an image. Accordingly, by lengthening the use time of the small-capacity type developing cartridge through the increase of the determination threshold value Th2, it is possible to use the small-capacity type developing cartridge 5B until the toner T remaining therein reaches a proper deterioration state, Accordingly, the toner T in the small-capacity type developing cartridge can be efficiently used, and thus it is possible to increase the number of sheets that can be printed with respect to the small-capacity type developing cartridge. Also, it is possible to reduce the amount of toner T contained in the small-capacity type developing cartridge (i.e. the initial capacity of toner T) so that the number of sheets that can be printed is kept at 3,000.

Although the first illustrative embodiment has been described, the present invention is not limited thereto. The detailed configuration of the present invention may be properly modified without deviating from the scope of the present invention.

In the first illustrative embodiment, it is exemplified that the same light reception reference value V1 is used regardless of the initial capacity of the developing cartridge 5B, but the present invention is not limited thereto. For example, the light reception reference value may be changed in accordance with the initial capacity of the developing cartridge 5B detected by the detecting unit 1200. Specifically, as shown in FIG. 7, the light reception reference value V1 may be used in determining the replacement time of the large-capacity type developing cartridge, and a light reception reference value V2 may be used in determining the replacement time of the small-capacity type developing cartridge.

The light reception reference value V2 that is used in determining the replacement time of the small-capacity type developing cartridge may be set such that a difference D2 between the light reception reference value V2 and the output value V0 in a state in which the light receiving device 82 receives no light is greater than a difference D1 between the light reception reference value V1 that is used in determining the replacement time of the large-capacity type developing cartridge and the output value V0. In FIG. 7, the light reception reference value V2 is set to be smaller than the light reception reference value V1.

Accordingly, the ratio of the time during which the output voltage value exceeds the light reception reference value V2 is calculated as a small value, and thus it is possible to further lengthen the time for which the ratio of the time exceeds the determination threshold value Th2. As a result, the required time can be further lengthened until it is determined that the replacement time of the small-capacity type developing cartridge has been reached (i.e. the use time of the small-capacity type developing cartridge), and thus it is possible to use the small-capacity type developing cartridge until the toner T remaining therein reaches a proper deterioration state.

Figure 7:
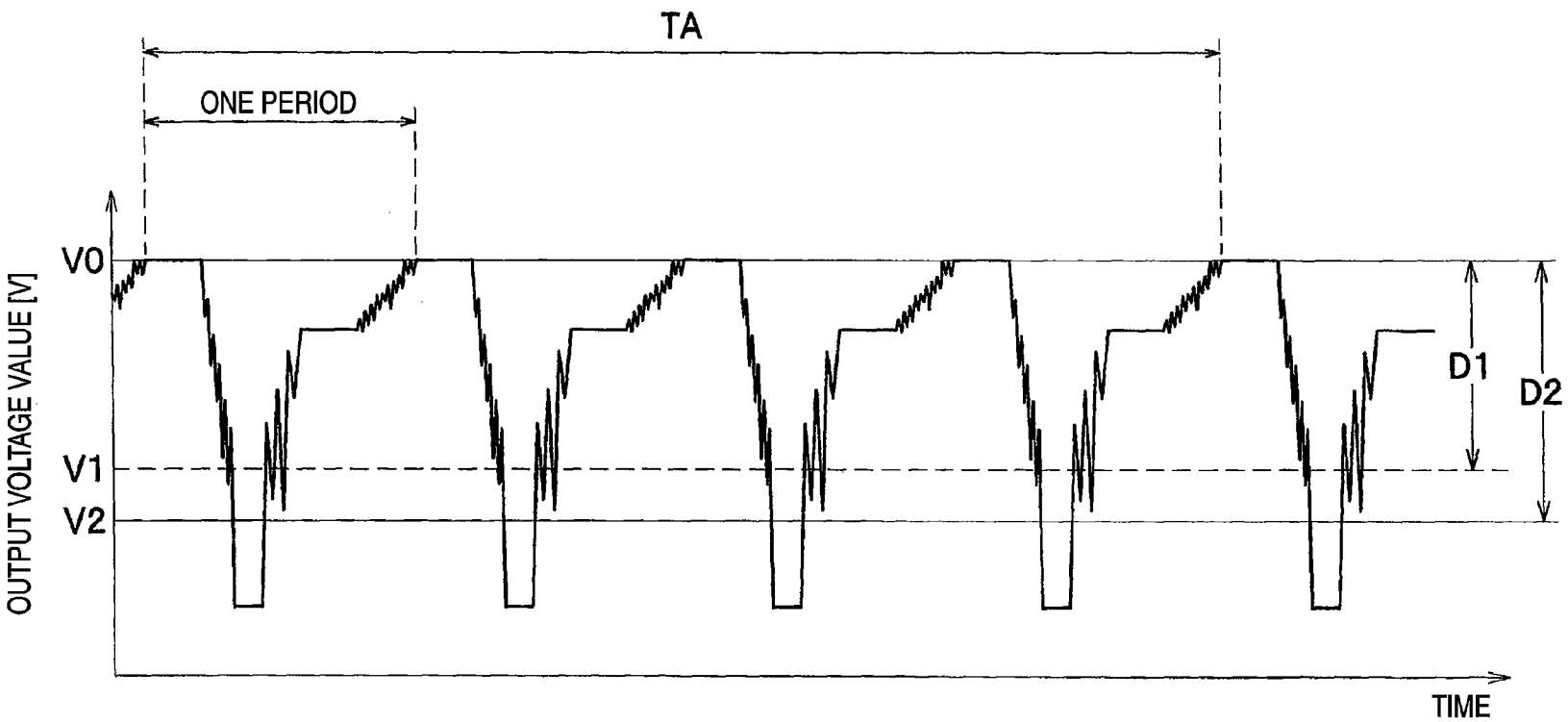
FIG. 7 is a time chart of an output voltage value of a light receiving device for explaining the change of a light reception reference value according to the first illustrative embodiment.

In this case, as shown in FIG. 7, the light reception reference value V2 is set to be larger than the light reception reference value V1. Accordingly, by combining the light reception reference value V2 with the determination threshold value Th2, it is possible to more strictly control the deterioration state of the toner T (i.e. the replacement time of the developing cartridge 5B).

Although two types of developing cartridges 5B that can be mounted in the laser printer 1 are exemplified in the first illustrative embodiment, the present invention is not limited thereto, and three or more types of developing cartridges, for example, may be used. When three or more types of developing cartridges are used, the determination threshold values may be individually set for the respective types of developing cartridges or for respective initial capacity ranges of the developing cartridges. In the latter case, the determination threshold value Th1 is used in determining the replacement time of the cartridge for which the number of sheets that can be printed is set to equal to or more than 6,000, the determination threshold value Th2 is used in determining the replacement time of the cartridge for which the number of sheets that can be printed is set to equal to or less than 3,000, and a determination threshold value Th3 is used in determining the replacement time of the cartridge for which the number of sheets that can be printed is set to equal to or more than 3,000 and equal to or less than 6,000 (where, Th1<Th3<Th2). For example, in the case of using three types of mountable cartridges, the same determination threshold value may be used in determining the replacement times for two cartridges having the initial capacity within a specific range, and another determination threshold value may be used in determining the replacement time for remaining one cartridge.

Although it is exemplified that preset determination threshold values are used in the first illustrative embodiment, the present invention is not limited thereto, and a configuration may be used, which calculates the determination threshold value based on a preset equation from the initial capacity of the developing cartridge 5B detected by the detecting unit 1200, and uses the calculated determination threshold value.

In the first illustrative embodiment, the numerical values of the determination threshold values Th1 and Th2 (e.g. 12% and 24%) are mere example.

<Second Illustrative Embodiment>

Next, a second illustrative embodiment of the present invention will be described in detail while referring to the accompanying drawings. In the following description, the same reference numerals are used for the same constituent elements as those of the first illustrative embodiment, and the detailed description thereof will be omitted.

In the second illustrative embodiment, the main body casing has a configuration different from that in the first illustrative embodiment.

Configuration of Main Body Casing

Figure 8:
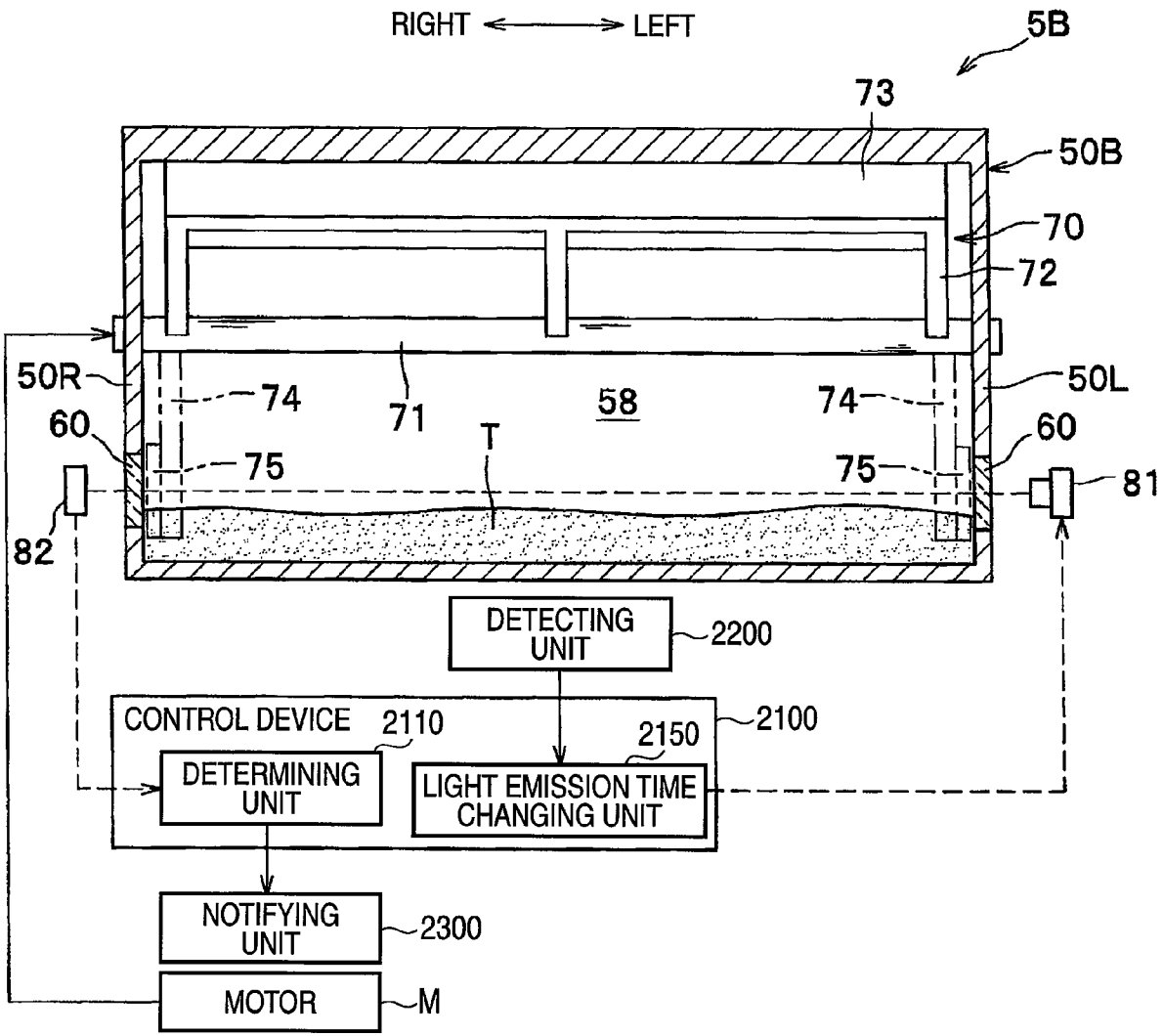
FIG. 8 is a cross-sectional view illustrating a schematic configuration of an image forming apparatus according to a second illustrative embodiment of the present invention.

As illustrated in FIG. 8, the laser printer 1 includes a light emitting device 81, a light receiving device 82, a control device 2100 as an example of a determining unit and a light emission time changing unit, a detecting unit 2200 configured to detect an initial capacity of the mounted developing cartridge 5B, and a notifying unit 2300 configured to notify a user of a message, in the main body casing 2.

The light emitting device 81 and the light receiving device 82 are oppositely arranged and interposed between a pair of light transmission windows 60 of the developing cartridge 5B mounted in the main body casing 2. As the light emitting device 81 and the light receiving device 82, commonly known light sensors may be adopted.

As illustrated as a dotted line FIG. 8, light emitted from the light emitting device 81 enters into the developing cartridge 5B (i.e. toner containing chamber 58) through one side light transmission window 60, and is received in the light receiving device 82 through the other side light transmission window 60. The light emitting device 81 is a device of which a light emission time may be changed in accordance with a light emission signal input from the control device 2100. The light receiving device 82 is a device of which the output voltage value is changed depending upon the intensity of the received light, and as described above in the first illustrative embodiment, outputs a light reception signal as shown in FIG. 4 to the control device 2100.

As shown in FIG. 8, the control device 2100 has a determining unit 2110 and a light emission time changing unit 2150. The control device 2100 is provided with a CPU, a RAM, a ROM, an input/output circuit, and the like (not illustrated). The control device 2100 receives information from the light receiving device 82 and the detecting unit 2200, and realizes functions of the respective units as the CPU executes programs stored in the ROM.

The determining unit 2110 determines the replacement time of the developing cartridge 5B based on the light reception signal input from the light receiving device 82. Referring to FIG. 4, an example of replacement time determination will be briefly described. As shown in FIG. 4, in a predetermined time TA including one or plural periods (e.g. one period is a time required for one rotation of the agitator 70, and four periods are provided as shown in FIG. 4), the time during which the output voltage value exceeds a preset light reception reference value V1 (i.e. in FIG. 4, the time during which the output voltage value is less than the reference value V1) is calculated. Then, the ratio of the time during which the output voltage value exceeds the light reception reference value V1 over the predetermined time TA is calculated. The calculated time ratio is compared with a preset determination threshold value, and if the calculated time ratio exceeds the determination threshold value, it is determined that the replacement time of the developing cartridge 5B has been reached.

For example, if the ratio of the time during which the output voltage value exceeds the light reception reference value V1 over the predetermined time TA is 13% and the determination threshold value is set to 12%, the ratio of the time, during which the output voltage value exceeds the light reception reference value V1, exceeds the determination threshold value, and thus the determining unit 2110 determines that the replacement time of the developing cartridge 5B that is currently mounted has been reached.

The method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time TA, and whether the output voltage value (i.e. respective sampling point) every predetermined time exceeds the light reception reference value may be determined. In this case, the ratio of sampling points that exceed the determination reference value over the entire sampling points may be calculated, and the replacement time may be determined depending upon whether the ratio exceeds the determination threshold value.

The light emission time changing unit 2150 changes the light emission time of the light emitting device 81 in accordance with the initial capacity of the developing cartridge 5B (i.e. whether the developing cartridge 5B is a large-capacity type or a small-capacity type) detected by the detecting unit 2200 to be described later. Specifically, the light emission time changing unit 2150 changes the light emission time of the light emitting device 81 so that the light emission time for the small-capacity type developing cartridge is shortened.

Specifically, the light emission time changing unit 2150 causes the light emitting device 81 to continuously emit light when a large-capacity type developing cartridge is mounted. In contrast, the light emission time change unit 2150 causes the light emitting device 81 to emit pulsed light at predetermined light emission intervals when a small-capacity type developing cartridge is mounted. In this case, the light emission time (e.g. the pulsed light emission intervals) may be preset by experiments or the like, based on an obtained correlation among the initial capacity of the developing cartridge 5B, the deterioration time of the toner T, and the like. The operation when the light emission time of the light emitting device 81 is shortened will be described later.

The detecting unit 2200 detects whether the developing cartridge 5B mounted in the main body casing 2 is a large-capacity type or a small-capacity type, and outputs the result of detection to the light emission time changing unit 2150. The detecting unit 2200 may adopt a known configuration for detecting the specification of the developing cartridge 5B mounted in the main body casing 2. For example, a device that reads initial capacity information from an IC chip provided in the developing cartridge 5B or a sensor for detecting the initial capacity of the mounted developing cartridge 5B in accordance with the change of the detection state may be adopted.

The notifying unit 2300 notifies a user who operates the laser printer 1 of a message. In the second illustrative embodiment of the present invention, when the determining unit 2110 determines that the replacement time of the developing cartridge 5B has been reached, the notifying unit 2300 notifies a user of the message to the corresponding effect. The notifying unit 2300 may adopt, for example, a liquid crystal display notifying the message as text, picture, and the like, a speaker notifying the message as sound, a lamp notifying the message by flickering light, or the like. Also, the notifying unit may adopt a combination of two or more of the liquid crystal display, the speaker, the lamp, and the like.

Determination of Replacement Time of Developing Cartridge

Next, the determination of the replacement time of the developing cartridge 5B and the operation when the light emission time of the light emitting device 81 is shortened according to the second illustrative embodiment of the present invention will be described while referring to the accompanying drawings.

Figure 9:
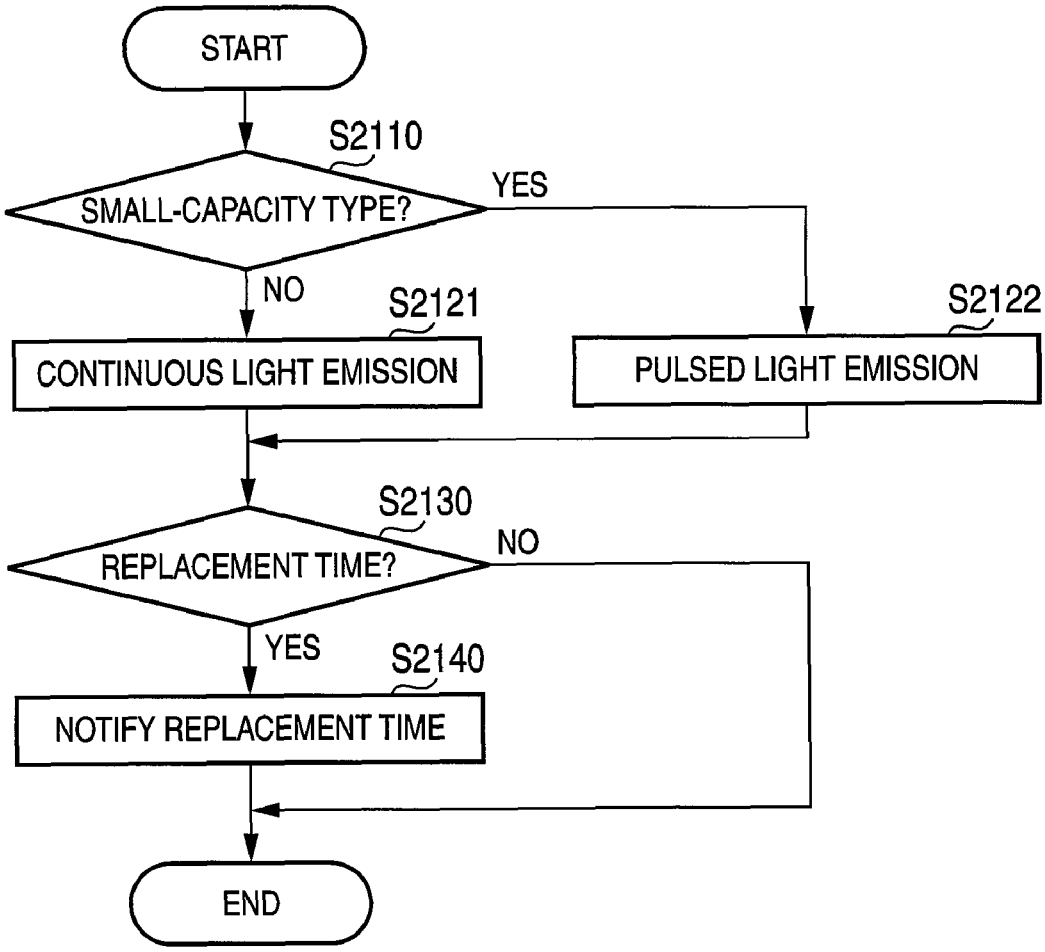
FIG. 9 is a flowchart of a replacement time determination by a control device according to the second illustrative embodiment.

As illustrated in FIG. 9, the control device 2100 (i.e. the light emission time changing unit 2150) first determines whether the developing cartridge 5B mounted in the main body casing 2 is a small-capacity type or a large-capacity type on the basis of information about the type (i.e. initial capacity) of the developing cartridge 5B that is detected by the detecting unit 2200 (step S2110).

If the developing cartridge 5B is a large-capacity type ("No" in step S2110), the control device 2100 (i.e. the light emission time changing unit 2150) causes the light emitting device 81 to continuously emit light (step S2121). On the other hand, if the developing cartridge 5B is a small-capacity type ("Yes" in step S2110), the control device 2100 (i.e. the light emission time changing unit 2150) causes the light emitting device 81 to emit pulsed light (step S2122).

Thereafter, the control device 2100 (i.e. the determining unit 2110) determines whether the replacement time of the developing cartridge 5B has been reached (step S2130). If it is determined that the replacement time of the developing cartridge 5B has been reached ("Yes" in step S2130), the control device 2100 causes the notifying unit 2300 to notify the message (step S2140), while if it is determined that the replacement time of the developing cartridge 5B has not been reached ("No" in step S2130), the control device 2100 terminates the determination of the replacement time.

Figure 10:
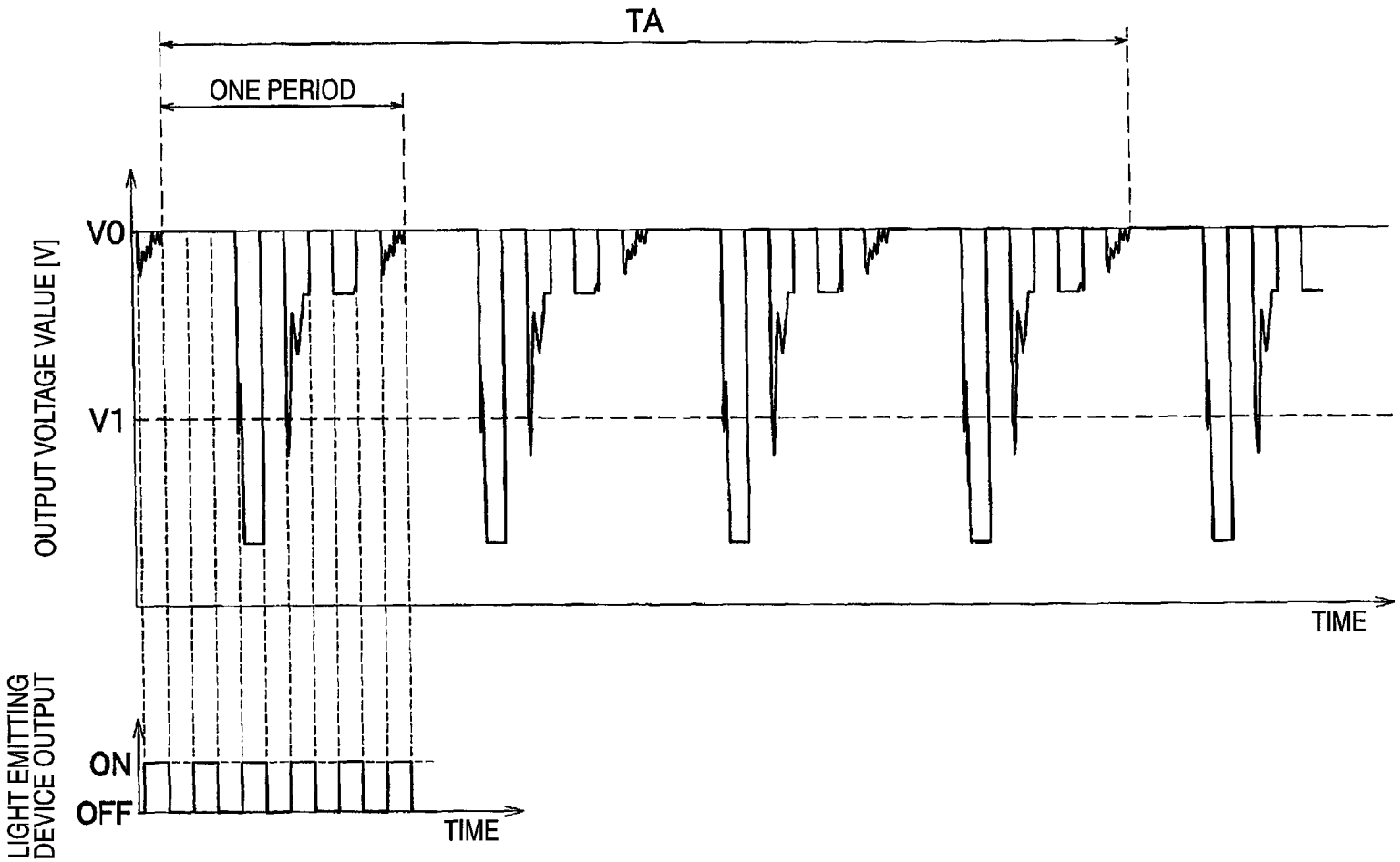
FIG. 10 is a time chart showing an output voltage value of a light receiving device when a light emitting device is caused to emit a pulsed light according to the second illustrative embodiment.

As shown in FIG. 10, if the light emitting device 81 is caused to emit the pulsed light (i.e. if the light emission time of the light emitting device 81 is shortened), the output voltage value when the light emitting device 81 emits no light (i.e. when the light emitting device 81 is in an off state) becomes V0. Accordingly, the ratio of the time during which the output voltage value exceeds the light reception reference value V1 over the predetermined time TA becomes lower than that in the case in which the light emitting device 81 as shown in FIG. 4 is caused to continuously emit light, and thus the required time can be lengthened until the corresponding ratio exceeds the determination threshold value. As a result, the required time can be lengthened until it is determined that the replacement time of the developing cartridge 5B has been reached.

As described above, by shortening the light emission time of the light emitting device 81 when a small-capacity type developing cartridge is mounted in comparison to the light emission time of the light emitting device 81 when a large-capacity type developing cartridge is mounted, the required time can be lengthened until it is determined that the replacement time of the small-capacity type developing cartridge 5B has been reached. Accordingly, the use time of the small-capacity type developing cartridge 5B can be lengthened.

As described above, the toner T remaining in the small-capacity type developing cartridge, even if the same residual amount of toner T as that in the large-capacity type developing cartridge, which corresponds to the determination of the replacement time of the large-capacity type developing cartridge is not deteriorating so much that it lowers the quality of an image. Accordingly, by lengthening the use time of the small-capacity type developing cartridge through the shortening of the light emission time of the light emitting device 81, it is possible to use the small-capacity type developing cartridge 5B until the toner T remaining therein reaches a proper deterioration state.

Accordingly, the toner T in the small-capacity type developing cartridge can be efficiently used, and thus it is possible to increase the number of sheets that can be printed with respect to the small-capacity type developing cartridge. Also, it is possible to reduce the amount of toner T contained in the small-capacity type developing cartridge (i.e. the initial capacity of toner T) so that the number of sheets that can be printed is kept at 3,000.

Although in the second illustrative embodiment, it is exemplified that the light emitting device 81 is caused to continuously emit light when a large-capacity type developing cartridge is mounted, and the light emitting device 81 is caused to emit pulsed light at predetermined light emission intervals when a small-capacity type developing cartridge is mounted, the present invention is not limited thereto. For example, a configuration may be used, which causes the light emitting device 81 to emit pulsed light at a first light emission interval when a large-capacity type developing cartridge is mounted, and causes the light emitting device 81 to emit pulsed light at a second light emission interval that is shorter than the first light emission interval when a small-capacity type developing cartridge is mounted.

Also, when three types of developing cartridges 5B that can be mounted in the laser printer 1, which include a large-capacity type, a medium-capacity type and a small-capacity type, are used, a configuration may be used, which causes the light emitting device 81 to continuously emit light when a large-capacity type developing cartridge is mounted, causes the light emitting device 81 to emit pulsed light at a first light emission interval when a medium-capacity type developing cartridge is mounted, and causes the light emitting device 81 to emit pulsed light at a second light emission interval that is shorter than the first light emission interval when a small-capacity type developing cartridge is mounted.

Although in the second illustrative embodiment, it is exemplified that the light emitting device is in an off state (i.e. the light emitting device emits no light) as a method of changing (i.e. shortening) the light emission time, the present invention is not limited thereto, and for example, the light emitting device may be caused to emit a weak light. In this case, since the output voltage value when the light is received in the light receiving device after passing through the cartridge, does not exceed the light reception reference value, substantially the same effect as that in the case in which the light emitting device emits no light can be obtained. In this case, the weak light is a light having an intensity at which the output voltage value of the light receiving device does not exceed the light reception reference value in a state in which no cartridge is interposed between the light emitting device and the light receiving device.

<Third Illustrative Embodiment>

Figure 11:
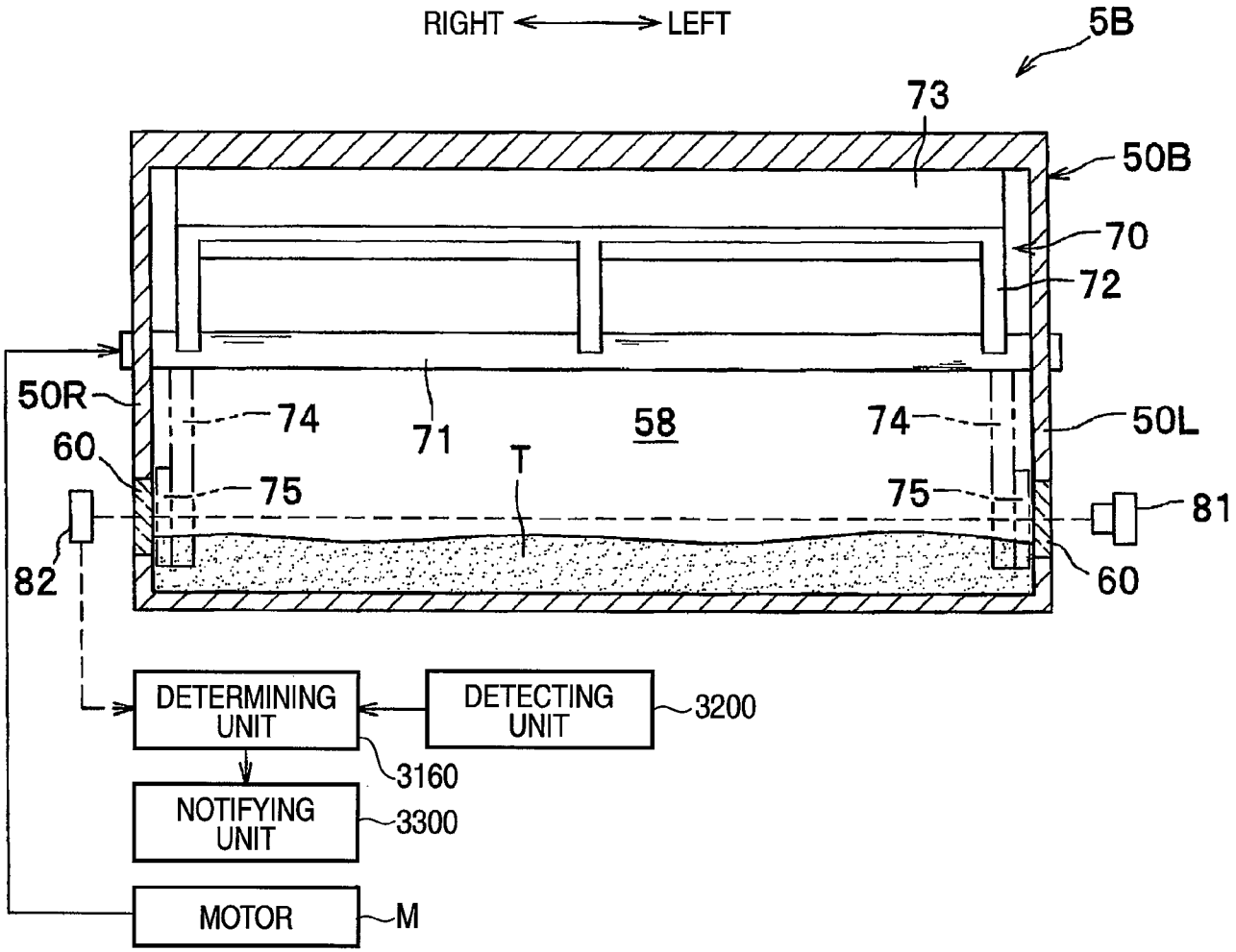
FIG. 11 is a cross-sectional view illustrating a schematic configuration of an image forming apparatus according to a third illustrative embodiment of the present invention.

Next, a third illustrative embodiment of the present invention will be described in detail while referring to the accompanying drawings. In the third illustrative embodiment, instead of changing the light emission time of the light emitting device 81 as in the second illustrative embodiment, it is configured that the number of output voltage values (i.e. sampling points indicated by black circles "•" and white circles "○" in FIG. 9) which is acquired from the light reception signal in a predetermined time, is changed. In the following description, the same reference numerals are used for the same constituent elements as those of the above-described illustrative embodiments, and the detailed description thereof will be omitted, As illustrated in FIG. 11, the laser printer 1 according to the third illustrative embodiment includes a light emitting device 81, a light receiving device 82, and a determining unit 3160 configured to determine the replacement time of the developing cartridge 5B, a detecting unit 3200, and a notifying unit 3300 in the main body casing 2.

The determining unit 3160 is provided with a CPU, a RAM, a ROM, an input/output circuit, and the like (not illustrated), and determines the replacement time of the developing cartridge 5B on the basis of a program or data stored in the ROM, outputs from the light receiving device 82 and the detecting unit 3200, and the like.

Figure 12:
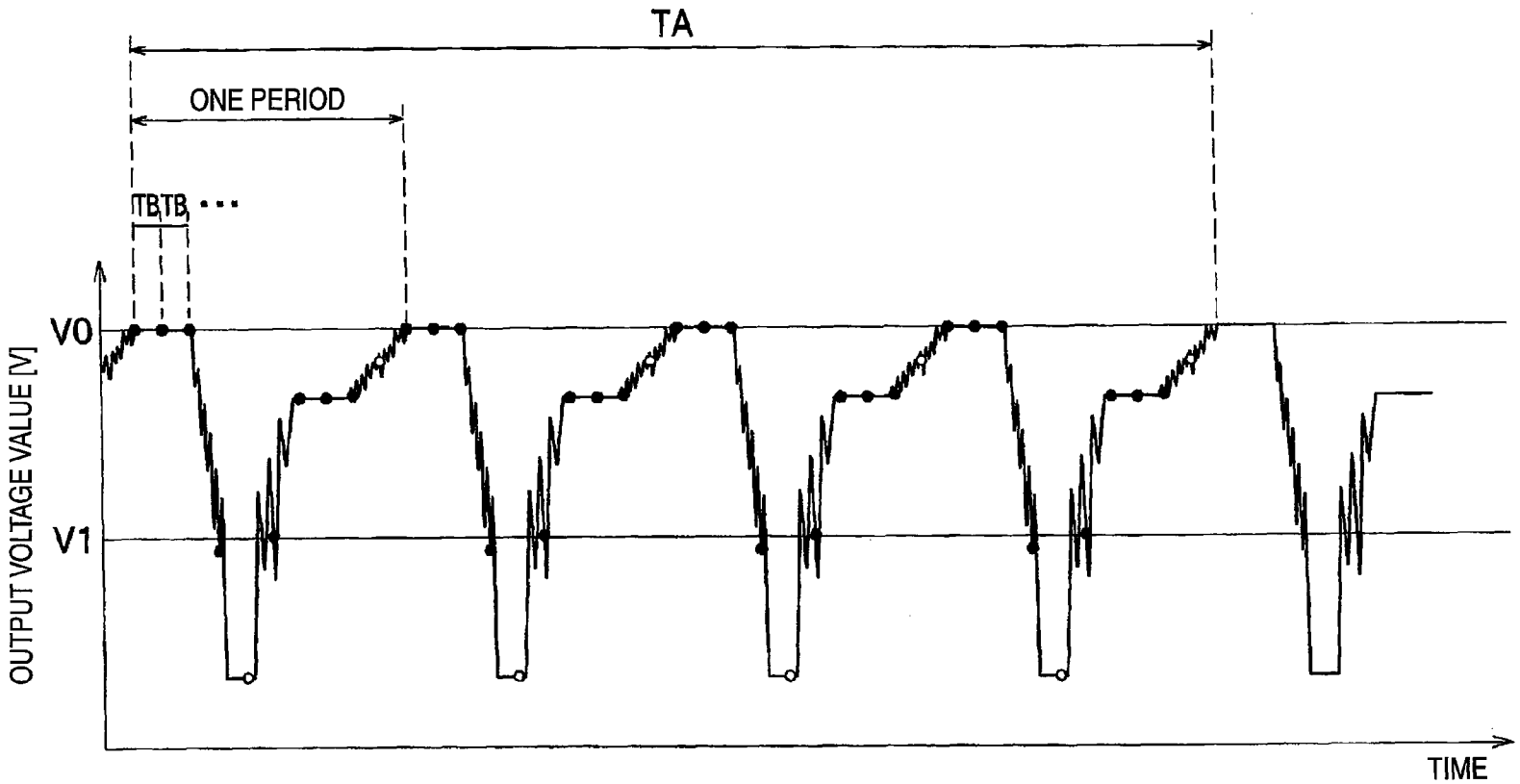
FIG. 12 is a flowchart of an output voltage value of a light receiving device for explaining a replacement time determining method according to the third illustrative embodiment.

The basic flow of the replacement time determination by the determining unit 3160 will be described. As shown in FIG. 12, the output voltage value is acquired (i.e. sampled) every time TB from the light reception signal in a predetermined time TA. Then, it is determined whether the acquired output voltage value (i.e. the output voltage value at a sampling point) exceeds the preset light reception reference value V1. Specifically, for example, a case in which the output voltage value at the sampling point does not exceed the reference value V1 (i.e. a case in which the output voltage value is larger than the reference value V1) is determined as "0", while a case in which the output voltage value at the sampling point exceeds the reference value V1 (i.e. a case in which the output voltage value is smaller than the reference value V1) is determined as "1".

Thereafter, the ratio of the number of sampling points at which the output voltage value is determined as "1" (e.g. 8 in FIG. 12) to the total number of sampling points (e.g. 40 in FIG. 12) is calculated. Then, the calculated ratio is compared with, the preset determination threshold value, and if the calculated ratio exceeds the determination threshold value, it is determined that the replacement time of the developing cartridge 5B has been reached. For example, in the state as indicated in FIG. 12, the ratio that exceeds the light reception reference value is 8÷40×100=20%, and if the determination threshold value is set to 12%, the calculated ratio exceeds the determination threshold value, and thus it is determined that the replacement time has been reached.

In the third illustrative embodiment, in the case of determining the replacement time, the determining unit 3160 changes the number of sampling points in the predetermined time TA, which are sampled from the light reception signal, so that the number of sampling points when the small-capacity type developing cartridge 5B is mounted is decreased, in accordance with the initial capacity of the developing cartridge 5B detected by the detecting unit 3200. Specifically, when the large-capacity type developing cartridge is mounted, all sampling points (e.g. 40 sampling points) that can be sampled within the predetermined time TA are sampled, while when the small-capacity type developing cartridge is mounted, sampling points are decimated in a predetermined ratio from all the sampling points that can be sampled within the predetermined time TA, and then the sampling is performed.

Here, the predetermined ratio may be regularly set, such as a case in which if one sampling point is acquired, one following sampling point is not acquired, a case in which if four sampling points are acquired, one following sampling point is not acquired, a case in which if three sampling points are acquired, two following sampling points are not acquired, or the like. Also, the predetermined ratio may be irregularly set, such as a case in which sampling points randomly selected among all the sampling points, e.g. 10% of all the sampling points, which can be acquired within the predetermined divided time TA, are not acquired, or the like.

In the third illustrative embodiment, a case in which if four sampling points are acquired, one following sampling point is not acquired is shown in FIG. 12 as the predetermined ratio. Specifically, when the small-capacity type developing cartridge is mounted, the sampling points sampled within the predetermined time TA are indicated as "•", and the decimated sampling points are indicated as "○".

As illustrated in FIG. 12, since the sampling is performed by decimating the sampling points in the predetermined ratio (i.e. "○" is excluded from being acquired), the decimated portion may have the same meaning as that of a case in which the light receiving device 82 receives no light. Accordingly, as in the second illustrative embodiment, the same effect as that of a case in which the time during which the light receiving device 82 receives no light is lengthened by shortening the light emission time of the light emitting device 81.

That is, when the small-capacity type developing cartridge is mounted, by decimating (i.e. reducing) the sampling points to be sampled, the ratio of the number of sampling points at which the output voltage value exceeds the light reception reference value V1 (i.e. which is determined as "1") to the total number of sampling points (40 points) that can be sampled within the predetermined time TA can be decreased in comparison to a case in which all the sampling points are sampled. As a result, the ratio of the number of sampling points at which the output voltage value exceeds the light reception reference value V1 can lengthen the time required until the output voltage value exceeds the determination threshold value.

Specifically, since the ratio of the number of sampling points (e.g. four sampling points) at which the output voltage value exceeds the light reception reference value V1 to the number of sampling points "•" which are sampled when the small-capacity type developing cartridge is mounted is 4÷40×100=10%, if the determination threshold value is set to 12%, the calculated ratio does not exceed the determination threshold value, and thus it is determined that the replacement time has not bee reached.

In this case, since the required time can be lengthened until it is determined that the replacement time of the small-capacity type developing cartridge 5B has been reached, the use time of the small-capacity type developing cartridge 5B can also be lengthened. As a result, the small-capacity type developing cartridge 5B can be used until the toner T remaining in the small-capacity type developing cartridge reaches a proper deterioration state.

In the third illustrative embodiment, it is exemplified that when the large-capacity type developing cartridge is mounted, all the sampling points that can be sampled within the predetermined time TA are sampled, while when the small-capacity type developing cartridge is mounted, sampling points are decimated in a predetermined ratio from all the sampling points that can be sampled within the predetermined time TA, and then the sampling is performed. However, the present invention is not limited thereto. For example, when the large-capacity type developing cartridge is mounted, the sampling may be performed by decimating the sampling points in the first ratio from all the sampling points, while when the small-capacity type developing cartridge is mounted, the sampling may be performed by decimating the sampling points in the second ratio that is higher than the first ratio from all the sampling points.

Also, when three types of developing cartridges 5B that can be mounted in the laser printer 1, which include a large-capacity type, a medium-capacity type and a small-capacity type, are used, a configuration may be used, which samples all the sampling points when the large-capacity type developing cartridge is mounted, performs sampling by decimating the sampling points in the first ratio when the medium-capacity type developing cartridge is mounted, and performs sampling by decimating the sampling points in the second ratio that is higher than the first ratio when the small-capacity type developing cartridge is mounted.

Although in the third illustrative embodiment, it is exemplified that the sampling point is treated as one point on the light reception signal, the present invention is not limited thereto. For example, in the case in which the light reception signal within the predetermined time is divided into very short times, and it is determined whether the output voltage value exceeds the light reception reference value every time unit, each time unit may be treated as a sampling point (i.e. sampling unit).

Although the second and third illustrative embodiments of the present invention have been described as above, the present invention is not limited to such illustrative embodiments. The detailed configuration of the present invention may be properly modified without deviating from the scope of the present invention.

Although in the second and third illustrative embodiments, two types of developing cartridges 5B that can be mounted in the laser printer 1 are exemplified, the present invention is not limited thereto, and three or more types of developing cartridges, for example, may be used. When three or more types of developing cartridges are used, the light emission time of the light emitting device may be individually set for the respective types of developing cartridges or for respective initial capacity ranges of the developing cartridges. In the latter case, the light emitting device is caused to continuously emit light when the cartridge for which the number of sheets that can be printed is set to equal to or more than 6,000 is used, the light emitting device is caused to emit pulsed light at intervals for lengthening the light emission time when the cartridge for which the number of sheets that can be printed is set to equal to or more than 3,000 and equal to or less than 6,000 is used, and the light emitting device is caused to emit pulsed light at intervals for shortening the light emission time when the cartridge for which the number of sheets that can be printed is set to equal to or less than 3,000 is used. For example, in the case of using three types of mountable cartridges, the same light emission time may be used for two cartridges having the initial capacity within a specific range, and a different light emission time may be used for the remaining cartridge having the initial capacity within another range. In the meantime, the same number of sampling points may be used for two cartridges having the initial capacity within a specific range, and a different number of sampling points may be used for the remaining cartridge having the initial capacity within another range.

<Fourth Illustrative Embodiment>

Next, a fourth illustrative embodiment of the present invention will be described in detail while referring to the accompanying drawings. In the following description, the same reference numerals are used for the same constituent elements as those of the above-described illustrative embodiments, and the detailed description thereof will be omitted.

In the fourth illustrative embodiment, the main body casing has a configuration different from that in the first illustrative embodiment.

Configuration of Main Body Casing

Figure 13:
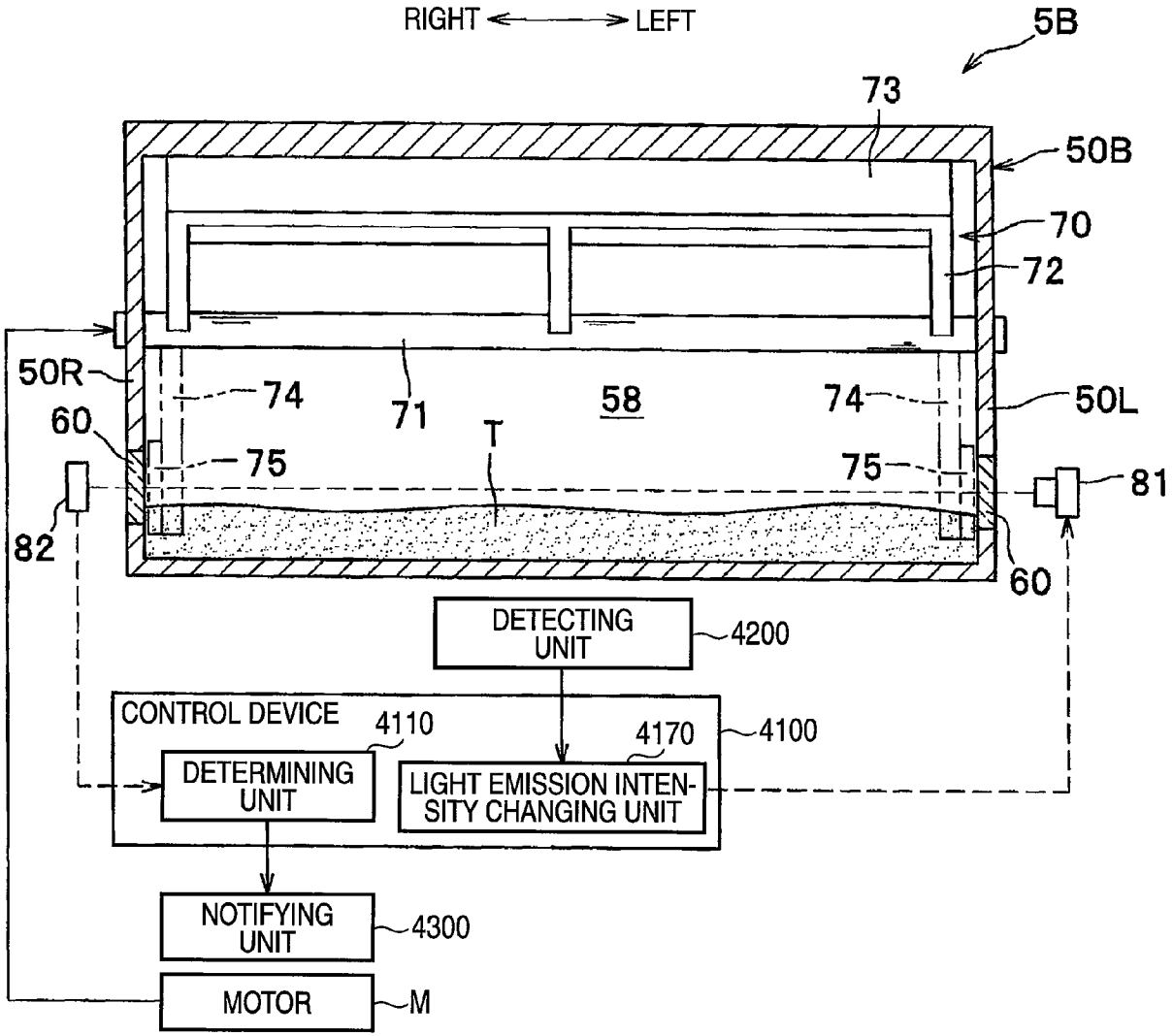
FIG. 13 is a cross-sectional view illustrating a schematic configuration of an image forming apparatus according to a fourth illustrative embodiment of the present invention.

As illustrated in FIG. 13, the laser printer 1 includes a light emitting device 81, a light receiving device 82, a control device 4100 as an example of a determining unit and a light emission intensity changing unit, a detecting unit 4200 configured to detect an initial capacity of the mounted developing cartridge 5B, and a notifying unit 4300 configured to notify a user of a message, which are provided inside the main body casing 2.

The light emitting device 81 and the light receiving device 82 are oppositely arranged and interposed between a pair of light transmission windows 60 of the developing cartridge 5B mounted in the main body casing 2. As the light emitting device 81 and the light receiving device 82, commonly known light sensors may be adopted.

As illustrated as a dotted line FIG. 13, light emitted from the light emitting device 81 enters into the developing cartridge 5B (i.e. toner containing chamber 58) through one side light transmission window 60, and is received in the light receiving device 82 through the other side light transmission window 60. The light emitting device 81 is a device of which s light emission intensity may be changed in accordance with an input voltage from the control device 4100. The light receiving device 82 is a device of which the output voltage value is changed depending upon the intensity of the received light, and, as described above in the first illustrative embodiment, outputs a light reception signal as shown in FIG. 4 to the control device 4100.

As shown in FIG. 13, the control device 4100 has a determining unit 4110 and a light emission intensity changing unit 4170. The control device 4100 is provided with a CPU, a RAM, a ROM, an input/output circuit, and the like (not illustrated). The control device 4100 receives information from the light receiving device 82 and the detecting unit 4200, and realizes functions of the respective units as the CPU executes programs stored in the ROM.

The determining unit 4110 determines the replacement time of the developing cartridge 5B based on the light reception signal input from the light receiving device 82. Referring to FIG. 4, a basic flow of replacement time determination will be roughly described. As shown in FIG. 4, in a predetermined time TA including one or plural periods (e.g. one period is a time required for one rotation of the agitator 70, and four periods are provided as shown in FIG. 4), the time during which the output voltage value exceeds a preset light reception reference value V1 (i.e. in FIG. 4, the time during which the output voltage value is less than the reference value V1) is calculated. Then, the ratio of the time during which the output voltage value exceeds the light reception reference value V1 over the predetermined time TA is calculated. The calculated time ratio is compared with a preset determination threshold value, and if the calculated time ratio exceeds the determination threshold value, it is determined that the replacement time of the developing cartridge 5B has been reached.

For example, if the ratio of the time during which the output voltage value exceeds the light reception reference value V1 over the predetermined time TA is 13% and the determination threshold value is set to 12%, the ratio of the time during which the output voltage value exceeds the light reception reference value V1 exceeds the determination threshold value, and thus the determining unit 4110 determines that the replacement time of the developing cartridge 5B that is currently mounted has been reached.

In this case, the method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time TA, and whether the output voltage value (i.e. respective sampling point) every predetermined time exceeds the light reception reference value may be determined. In this case, the ratio of sampling points that exceed the determination reference value to the entire sampling points may be calculated, and the replacement time may be determined depending upon whether the ratio exceeds the determination threshold value.

The light emission intensity changing unit 4170 changes the light emission intensity of the light emitting device 81 in accordance with the initial capacity of the developing cartridge 5B (i.e. whether the developing cartridge 5B is a large-capacity type or a small-capacity type) detected by the detecting unit 4200 to be described later. Specifically, the light emission intensity changing unit 4170 changes the light emission intensity of the light emitting device 81 so that the light emission intensity for the small-capacity type developing cartridge is lowered.

Specifically, the light emission intensity changing unit 4170 causes the light emitting device 81 to emit light with a light emission intensity $I_{HIGH}$ when a large-capacity type developing cartridge is mounted. In contrast, the light emission intensity changing unit 4170 causes the light emitting device 81 to emit light with a light emission intensity $I_{LOW}$ that is lower than the light emission intensity $I_{HIGH}$ when a small-capacity type developing cartridge is mounted. In this case, the light emission intensities $I_{HIGH}$ and $I_{LOW}$ may be preset by experiments or the like, based on an obtained correlation among the initial capacity of the developing cartridge 5B, the deterioration time of the toner T, and the like. The operation when the light emission intensity of the light emitting device 81 is lowered will be described later.

The detecting unit 4200 detects whether the developing cartridge 5B mounted in the main body casing 2 is a large-capacity type or a small-capacity type, and outputs the result of detection to the light emission intensity changing unit 4170. The detecting unit 4200 may adopt a known configuration for detecting the specification of the developing cartridge 5B mounted in the main body casing 2. For example, a device that reads initial capacity information from an IC chip provided in the developing cartridge 5B or a sensor for detecting the initial capacity of the mounted developing cartridge 5B in accordance with the change of the detection state may be adopted.

The notifying unit 4300 notifies a user who operates the laser printer 1 of a message. In the first illustrative embodiment of the present invention, when the determining unit 4110 determines that the replacement time of the developing cartridge 5B has been reached, the notifying unit 4300 notifies a user of the message to the corresponding effect. The notifying unit 4300 may adopt, for example, a liquid crystal display notifying the message as text, picture, and the like, a speaker notifying the message as sound, a lamp notifying the message by flickering light, or the like. Also, the notifying unit 4300 may adopt a combination of two or more of the liquid crystal display, the speaker, the lamp, and the like.

Determination of Replacement Time of Developing Cartridge

Next, the determination of the replacement time of the developing cartridge 5B and the operation when the light emission intensity of the light emitting device 81 is lowered according to this illustrative embodiment of the present invention will be described while referring to the accompanying drawings.

Figure 14:
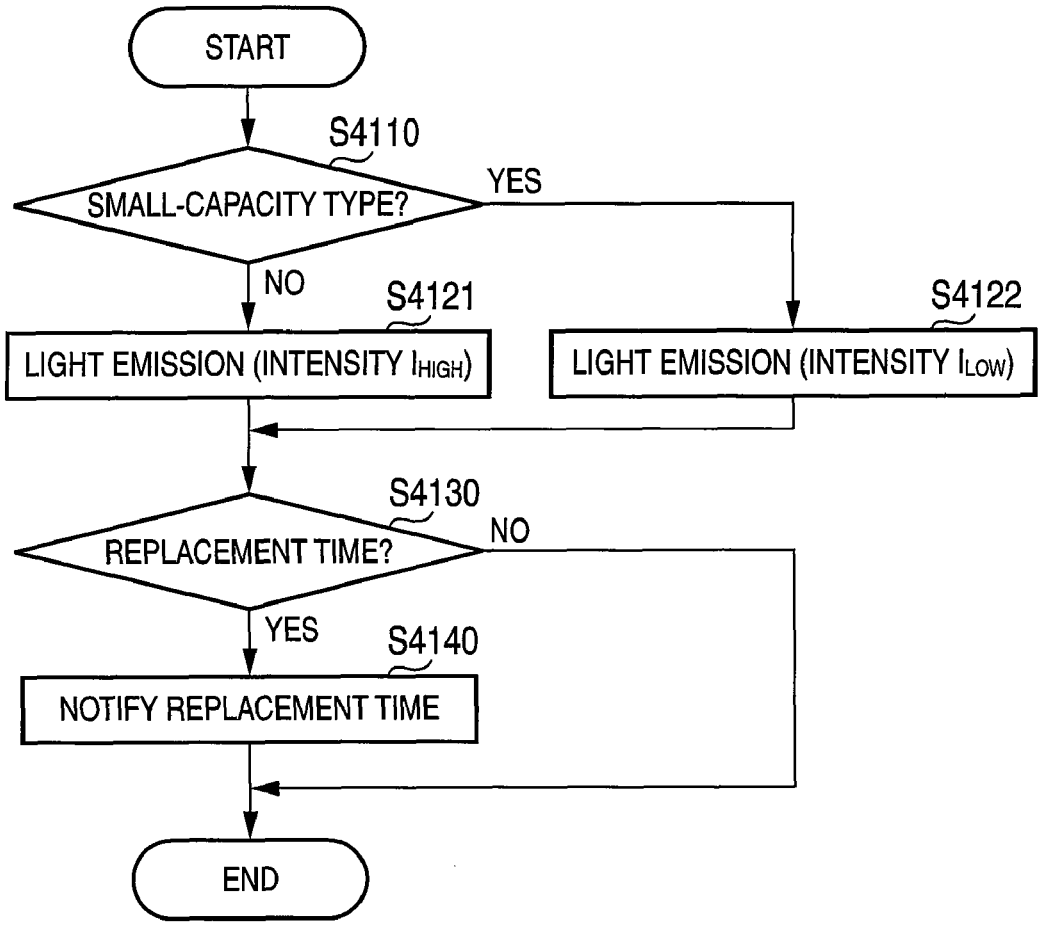
FIG. 14 is a flowchart of a replacement time determination by a control device according to the fourth illustrative embodiment.

As illustrated in FIG. 14, the control device 4100 (i.e. the light emission intensity changing unit 4170) first determines whether the developing cartridge 5B mounted in the main body casing 2 is a small-capacity type or a large-capacity type on the basis of information about the type (i.e. initial capacity) of the developing cartridge 5B that is detected by the detecting unit 4200 (step S4110).

If the developing cartridge 5B is a large-capacity type ("No" in step S4110), the control device 4100 (i.e. the light emission intensity changing unit 4170) causes the light emitting device 81 to emit light with the light emission intensity $I_{HIGH}$, (step S4121). On the other hand, if the developing cartridge 5B is a small-capacity type ("Yes" in step S4110), the control device 4100 (i.e. the light emission intensity changing unit 4170) causes the light emitting device 81 to emit light with the light emission intensity $I_{LOW}$ that is lower than the light emission intensity $I_{HIGH}$ (step S4122).

Thereafter, the control device 4100 (i.e. the determining unit 4110) determines whether the replacement time of the developing cartridge 5B has been reached (step S4130). If it is determined that the replacement time of the developing cartridge 5B has been reached ("Yes" in step S4130), the control device 4100 notifies the message (step S4140), while if it is determined that the replacement time of the developing cartridge 5B has not been reached ("No" in step S4130), the control device 4100 terminates the determination of the replacement time.

Figure 15:
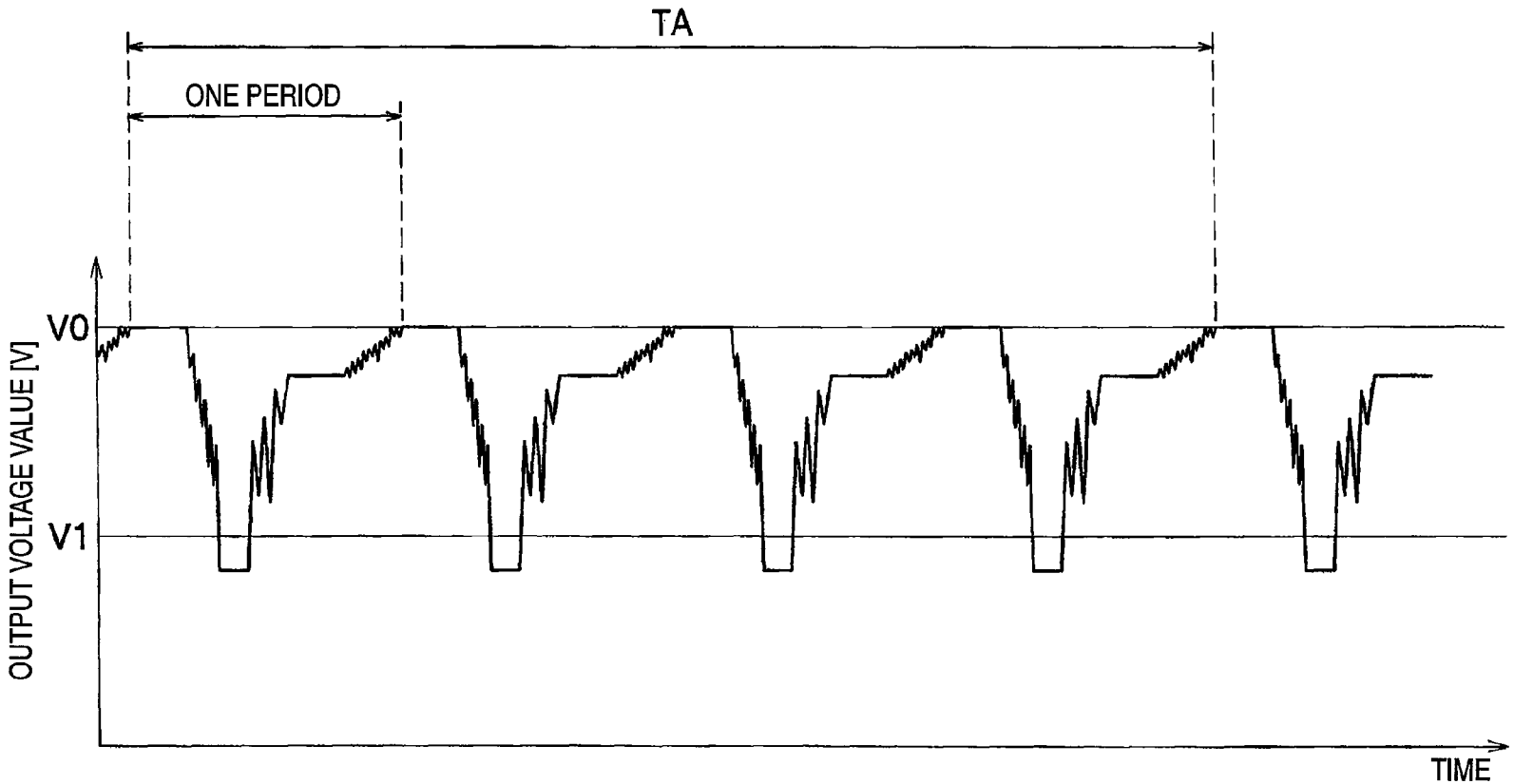
FIG. 15 is a time chart showing an output voltage value of a light receiving device when the light emission intensity of the light emitting device is made low according to the fourth illustrative embodiment.

As shown in FIG. 15, if the light emission intensity of the light emitting device 81 is lowered, the intensity of light received in the light receiving device 82 is lowered, and thus the output voltage value can be entirely increased (near to V0). Accordingly, the ratio of the time during which the output voltage value exceeds the light reception reference value V1 over the predetermined time TA becomes lower than that in the case in which the light emission intensity is high as shown in FIG. 4, and thus the required time can be lengthened until the ratio exceeds the determination threshold value. As a result, the required time can be lengthened until it is determined that the replacement time of the developing cartridge 5B has been reached.

As described above, by changing the light emission intensity of the light emitting device 81 when a small-capacity type developing cartridge is mounted to be lowered in comparison to the light emission intensity of the light emitting device 81 when a large-capacity type developing cartridge is mounted, the required time can be lengthened until it is determined that the replacement time of the small-capacity type developing cartridge 5B has been reached. Accordingly, the use time of the small-capacity type developing cartridge 5B can be lengthened.

As described above, when the residual amount of toner T in the small-capacity type developing cartridge reaches the amount with which it is determined that the replacement is needed in the large-capacity type developing cartridge, the residual toner T in the small-capacity type developing cartridge is not deteriorated to the extent where the image quality is degraded. Accordingly, by lengthening the use time of the small-capacity type developing cartridge through the lowering of the light emission intensity of the light emitting device 81, it is possible to use the toner T in the small-capacity type developing cartridge 5B until the toner T remaining therein reaches a proper deterioration state.

Accordingly, the toner T in the small-capacity type developing cartridge can be efficiently used, and thus it is possible to increase the number of sheets that can be printed with the small-capacity type developing cartridge. Also, it is possible to reduce the amount of toner T contained in the small-capacity type developing cartridge (i.e. the initial capacity of toner T) so that the number of sheets that can be printed is kept, for example, at 3,000.

Although in the fourth illustrative embodiment, it is exemplified that the light emitting device 81 of which the light emission intensity can be changed by the input voltage from the control device 4100 (i.e. the light emission intensity changing unit 4170) is used in changing the light emission intensity, the present invention is not limited thereto. For example, the light emission intensity may be changed by configuring a light emitting unit to have a plurality of light emitting devices and changing the number of light emitting devices to emit light in accordance with the input (i.e. instruction) from the light emission intensity changing unit 4170. Also, the light emission intensity may be changed by providing a shutter (i.e. an iris), a movable filter, a movable light shielding plate that can cover a portion of the light transmission window, or the like as another example of the light emission intensity changing unit, between the light emitting device and the cartridge inside the main body of the apparatus.

<Fifth Illustrative Embodiment>

Next, a fifth illustrative embodiment of the present invention will be described in detail while referring to the accompanying drawings. In the fifth illustrative embodiment, instead of changing the light emission intensity of the light emitting device 81 as in the fourth illustrative embodiment, the light reception reference value is changed. In the following description, the same reference numerals are used for the same constituent elements as those of the above-described illustrative embodiments, and the detailed description thereof will be omitted.

Figure 16:
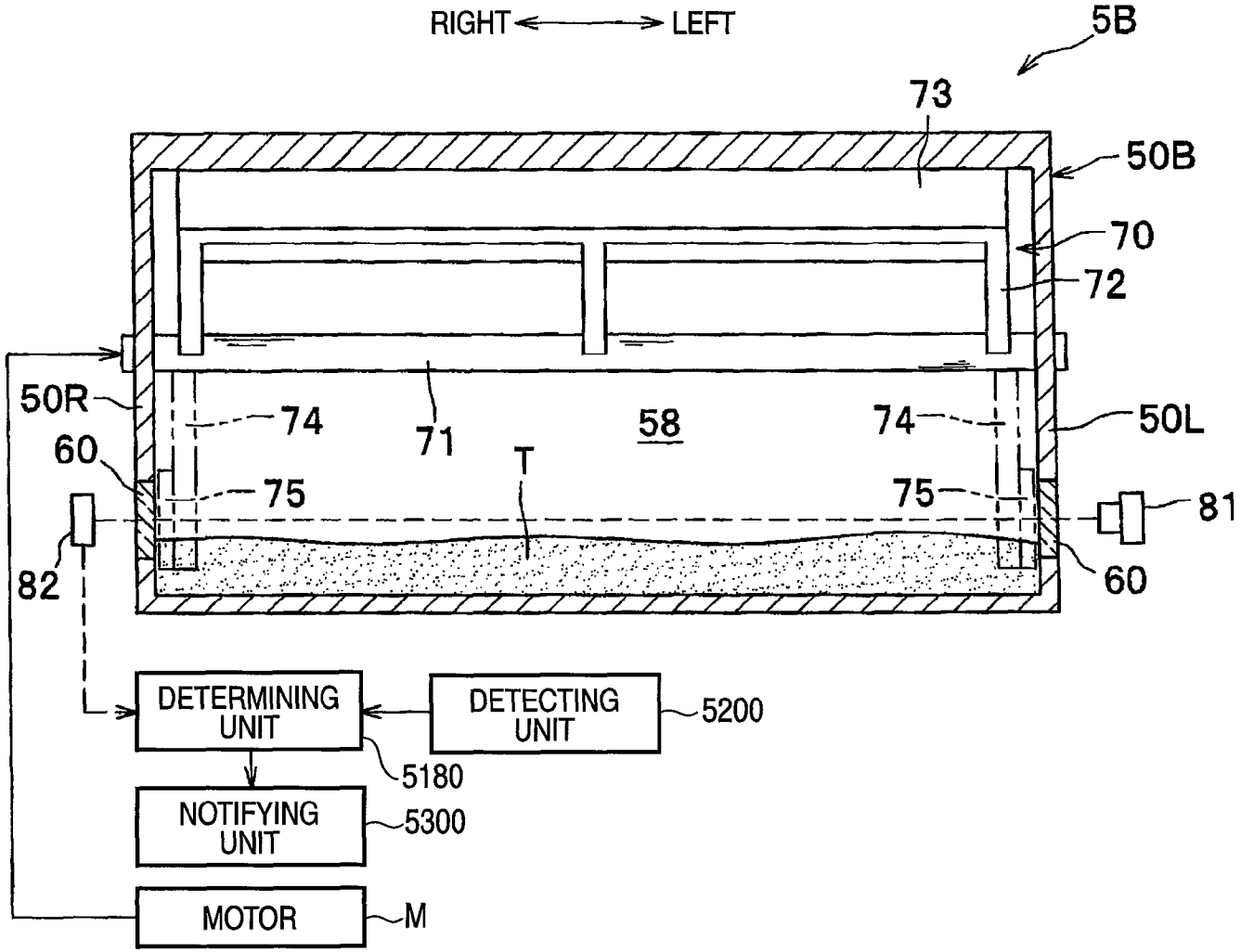
FIG. 16 is a cross-sectional view illustrating a schematic configuration of an image forming apparatus according to a fifth illustrative embodiment of the present invention.

As illustrated in FIG. 16, the laser printer 1 according to the fifth illustrative embodiment includes a light emitting device 81, a light receiving device 82, a determining unit 5180 configured to determine the replacement time of the developing cartridge 5B, a detecting unit 5200, and a notifying unit 5300, which are provided within a main body casing 2.

The determining unit 5180 is provided with a CPU, a RAM, a ROM, an input/output circuit, and the like (not illustrated), and determines the replacement time of the developing cartridge 5B on the basis of a program or data stored in the ROM, outputs from the light receiving device 82 and the detecting unit 5200. Since the determining unit 5180, to be described later, performs the determination of the replacement time in the same method as that of the determining unit 4110 as described above, except for the change of the light reception reference value, the detailed description thereof will be omitted.

Figure 17:
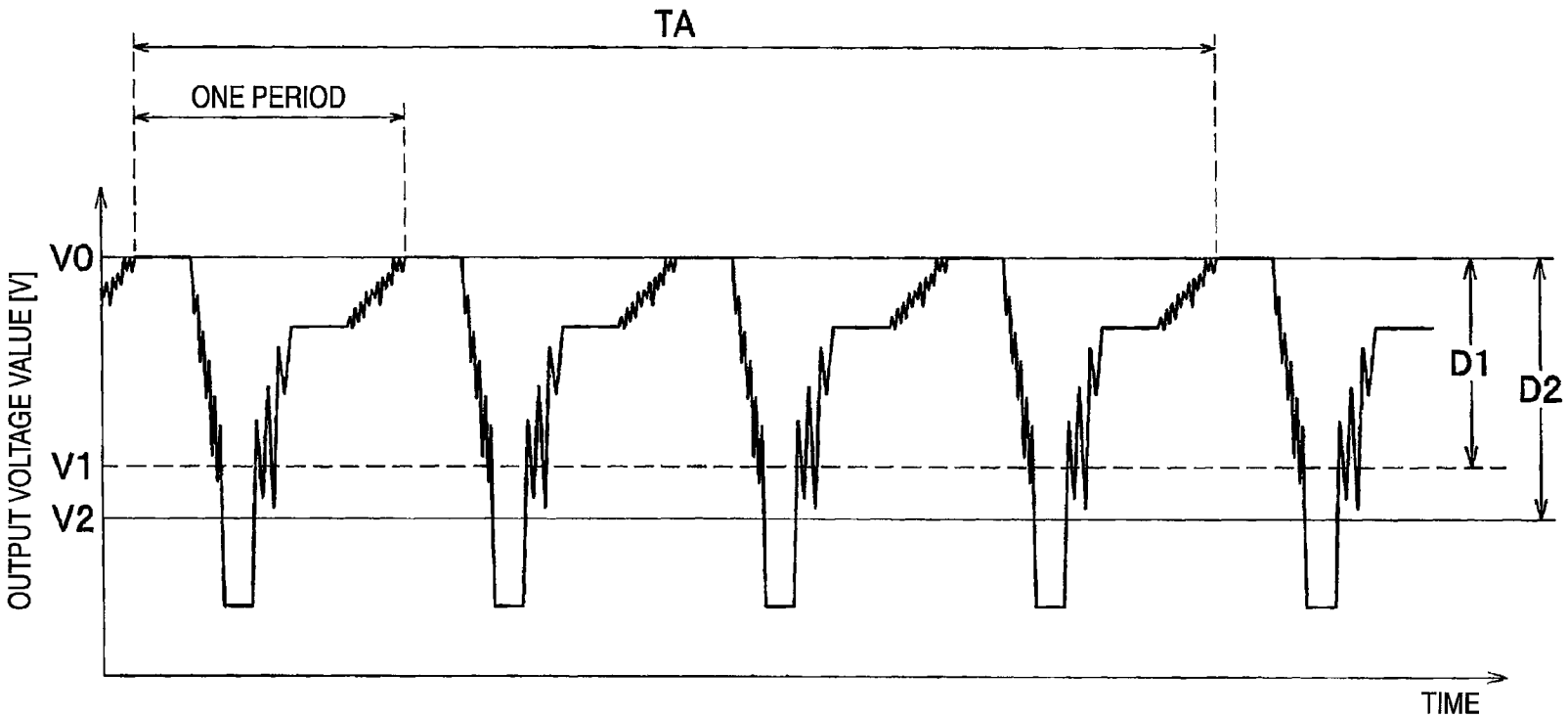
FIG. 17 is a flowchart of an output voltage value of a light receiving device for explaining a change of a light reception reference value according to the fifth illustrative embodiment.

The determining unit 5180, when determining the replacement time, changes the light reception reference value in accordance with the initial capacity of the developing cartridge 5B detected by the detecting unit 5200. Specifically, as shown in FIG. 17, a light reception reference value V1 may be used in determining the replacement time of the large-capacity type developing cartridge, and a light reception reference value V2 may be used in determining the replacement time of the small-capacity type developing cartridge. The light reception reference value V2 may be set such that a difference D2 between the light reception reference value V2 and the output value V0 in a state in which the light receiving device 82 receives no light is greater than a difference D1 between the light reception reference value V1 and the output value V0. In FIG. 17, the light reception reference value V2 is set to be smaller than the light reception reference value V1.

Since the light reception reference value V2 is used in determining the replacement time of the small-capacity type developing cartridge, the ratio of the time during which the output voltage value exceeds the light reception reference value V2 is calculated as a small value, and thus it is possible to lengthen the time during which the ratio exceeds the determination threshold value. As a result, in the same manner as in the first illustrative embodiment, the use time of the small-capacity type developing cartridge can be lengthened, and thus it is possible to use the toner T in the small-capacity type developing cartridge 5B until the toner T remaining therein reaches a proper deterioration state.

Although the fourth and fifth illustrative embodiments of the present invention have been described as above, the present invention is not limited to such illustrative embodiments. The detailed configuration of the present invention may be properly modified without deviating from the scope of the present invention.

Although in the fourth and fifth illustrative embodiments, two types of developing cartridges 5B that can be mounted in the laser printer 1 are exemplified, the present invention is not limited thereto, and three or more types of developing cartridges, for example, may be used. When three or more types of developing cartridges are used, the light emission intensity of the light emitting device may be individually set for the respective types of developing cartridges or for respective initial capacity ranges of the developing cartridges. In the latter case, the light emitting device is caused to emit light with the light emission intensity $I_{HIGH}$ in the case of the cartridge for which the number of sheets that can be printed is set to equal to or more than 6,000, the light emitting device is caused to emit light with the light emission intensity $I_{MEDIUM}$ in the case of the cartridge for which the number of sheets that can be printed is set to more than 3,000 and equal to or less than 6,000, and the light emitting device is caused to emit light with the light emission intensity $I_{LOW}$ in the case of the cartridge for which the number of sheets that can be printed is set to equal to or less than 3,000 ($I_{LOW}<I_{MEDIUM}<I_{HIGH}$). For example, in the case of using three types of mountable cartridges, two cartridges of which the initial capacities are included in a range may have the same light emission intensity, and the remaining cartridge of which the initial capacity is included in another other range may have different light emission intensity. In the meantime, two cartridges of which the initial capacities are included in a range may have the same light reception reference value, and the remaining cartridge of which the initial capacity is included in another range may have a different light reception reference value.

<Sixth Illustrative Embodiment>

Next, a sixth illustrative embodiment of the present invention will be described in detail while referring to the accompanying drawings. In the following description, the same reference numerals are used for the same constituent elements as those of the above-described illustrative embodiment, and the detailed description thereof will be omitted.

In the sixth illustrative embodiment, the main body casing has a configuration different from that in the above-described illustrative embodiment.

Configuration of Main Body Casing

Figure 18:
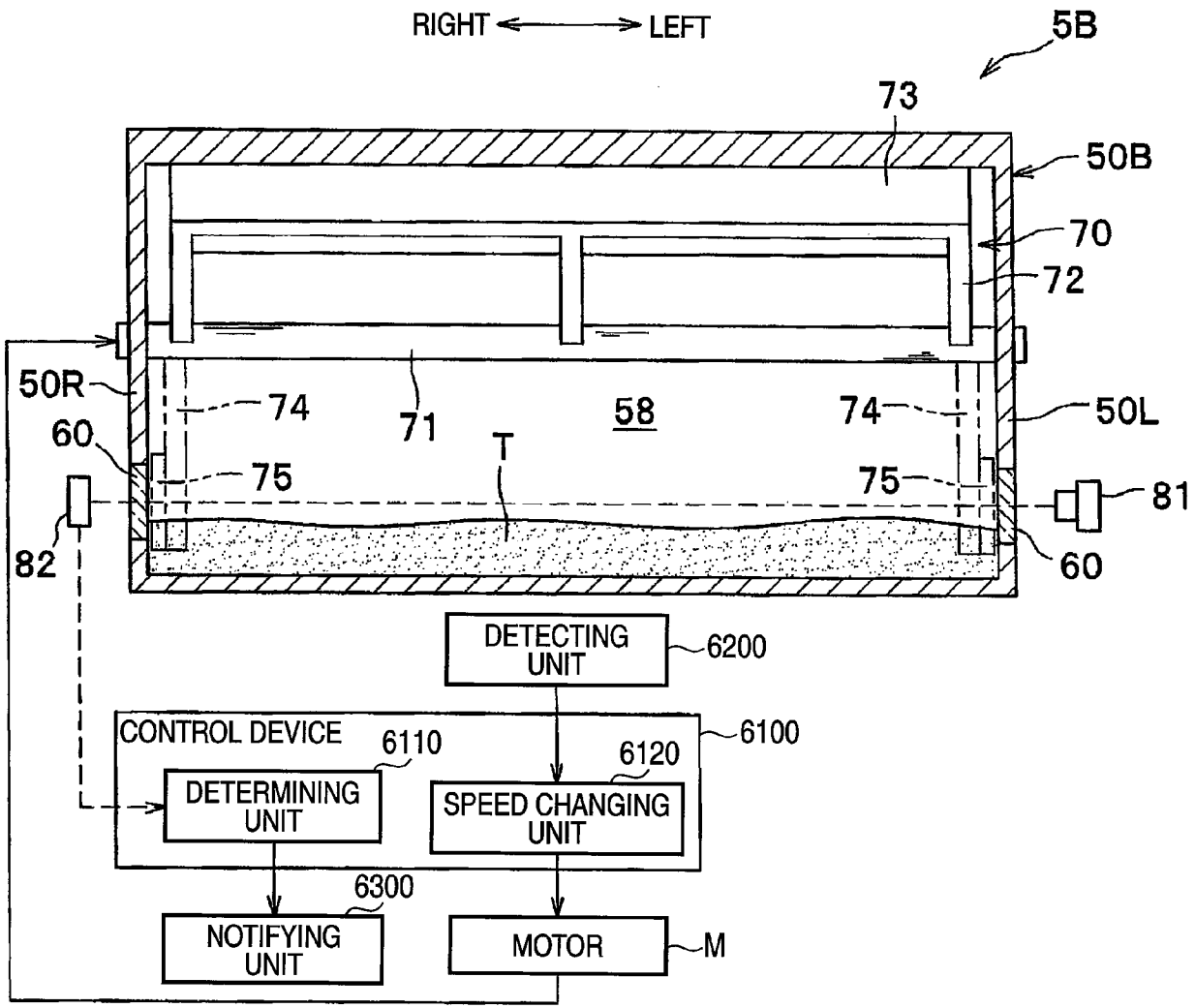
FIG. 18 is a cross-sectional view illustrating a schematic configuration of an image forming apparatus according to a sixth illustrative embodiment of the present invention.

As illustrated in FIG. 18, the laser printer 1 includes a light emitting device 81, a light receiving device 82, a control device 6100 as an example of a determining unit and a speed changing unit, a detecting unit 6200 configured to detect an initial capacity of the mounted developing cartridge 5B, and a notifying unit 6300 configured to notify a user of a message, in the main body casing 2.

The light emitting device 81 and the light receiving device 82 are oppositely arranged and interposed between a pair of light transmission windows 60 of the developing cartridge 5B mounted in the main body casing 2. As the light emitting device 81 and the light receiving device 82, commonly known light sensors may be adopted.

As illustrated as a dotted line in FIG. 18, light emitted from the light emitting device 81 enters into the developing cartridge 5B (i.e. toner containing chamber 58) through one light transmission window 60, and is received in the light receiving device 82 through the other light transmission window 60. The light receiving device 82 is a device of which the output voltage value is changed depending upon the intensity of the received light, and as described above in the first illustrative embodiment, outputs a light reception signal as shown in FIG. 4 to the control device 6100 when receiving light.

Figure 19:
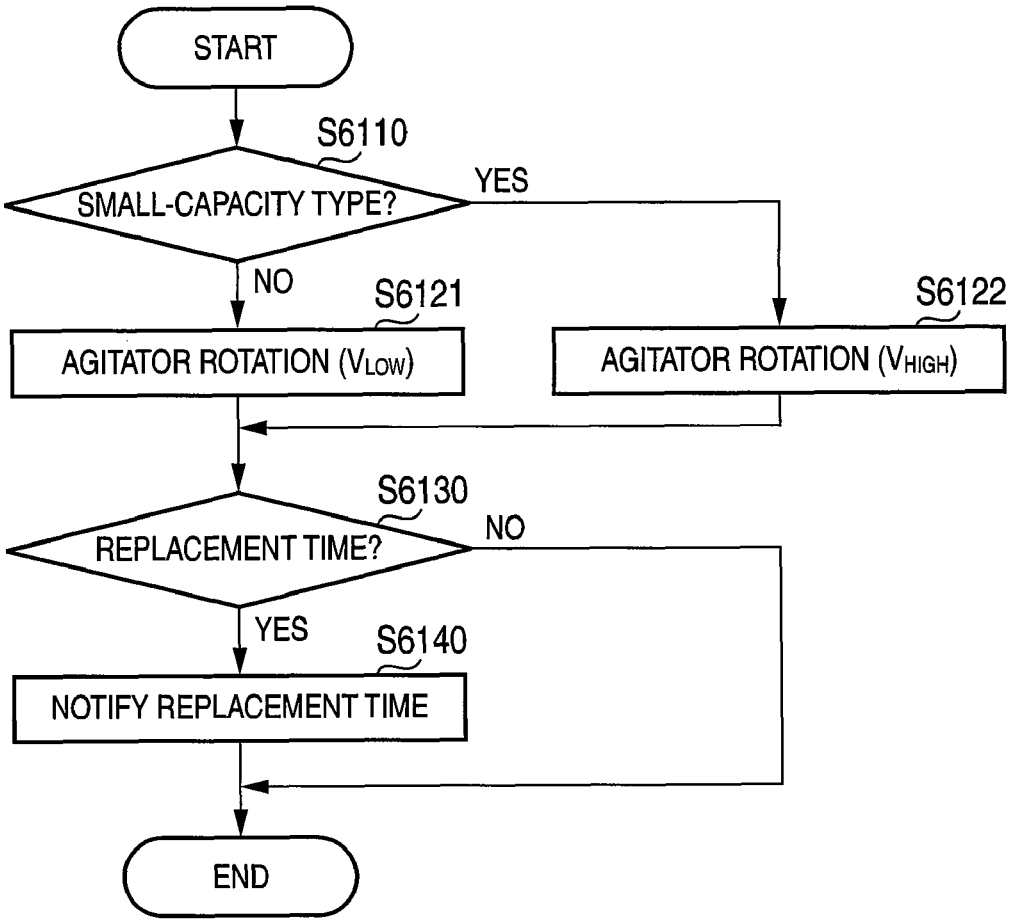
FIG. 19 is a flowchart of a replacement time determination by a control device according to the sixth illustrative embodiment.

As shown in FIG. 19, the control device 6100 has a determining unit 6110 and a speed changing unit 6120. The control device 6100 is provided with a CPU, a RAM, a ROM, an input/output circuit, and the like (not illustrated). The control device 6100 receives information from the light receiving device 82 and the detecting unit 6200, and realizes functions of the respective units as the CPU executes programs stored in the ROM. Also, the control device 6100 is configured to be able to execute at least an image forming mode for forming an image on a paper P and a determining mode for determining the replacement time of the developing cartridge 5B.

The determining unit 6110 determines the replacement time of the developing cartridge 5B based on the light reception signal (i.e. the light reception signal for a predetermined time TA) input from the light receiving device 82. Referring to FIG. 4, an example of replacement time determination will be briefly described. As shown in FIG. 4, in a predetermined time TA including one or plural periods (e.g. one period is a time required for one rotation of the agitator 70, and four periods are provided as shown in FIG. 4), the time during which the output voltage value exceeds a preset light reception reference value V1 (i.e. in FIG. 4, the time during which the output voltage value is less than the reference value V1) is calculated. Then, the ratio of the time during which the output voltage value exceeds the light reception reference value V1 over the predetermined time TA is calculated. The calculated time ratio is compared with a preset determination threshold value, and if the calculated time ratio exceeds the determination threshold value, it is determined that the replacement time of the developing cartridge 5B has been reached.

For example, if the ratio of the time during which the output voltage value exceeds the light reception reference value V1 over the predetermined time TA is 13% and the determination threshold value is set to 12%, the ratio of the time during which the output voltage value exceeds the light reception reference value V1 exceeds the determination threshold value, and thus the determining unit 6100 determines that the replacement time of the developing cartridge 5B has been reached.

In this case, the method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, as a point, from the light reception signal within the predetermined time TA, and whether the output voltage value (i.e. each sampling point) every predetermined time exceeds the light reception reference value may be determined. In this case, the ratio of sampling points that exceed the determination reference value to the entire sampling points may be calculated, and the replacement time may be determined depending upon whether the ratio exceeds the determination threshold value.

The speed changing unit 6120 changes the rotating speed of an agitator 70 by controlling the rotation (i.e. the rotating speed) of the motor M. Specifically, in an image forming mode, the agitator 70 is caused to rotate at the same rotating speed regardless of the initial capacity of the developing cartridge 5B (i.e. whether the developing cartridge is a large-capacity type or a small-capacity type), and in a determining mode, the rotating speed of the agitator 70 is changed in accordance with the initial capacity of the developing cartridge 5B detected by the detecting unit 6200 to be described later.

Figure 20A:
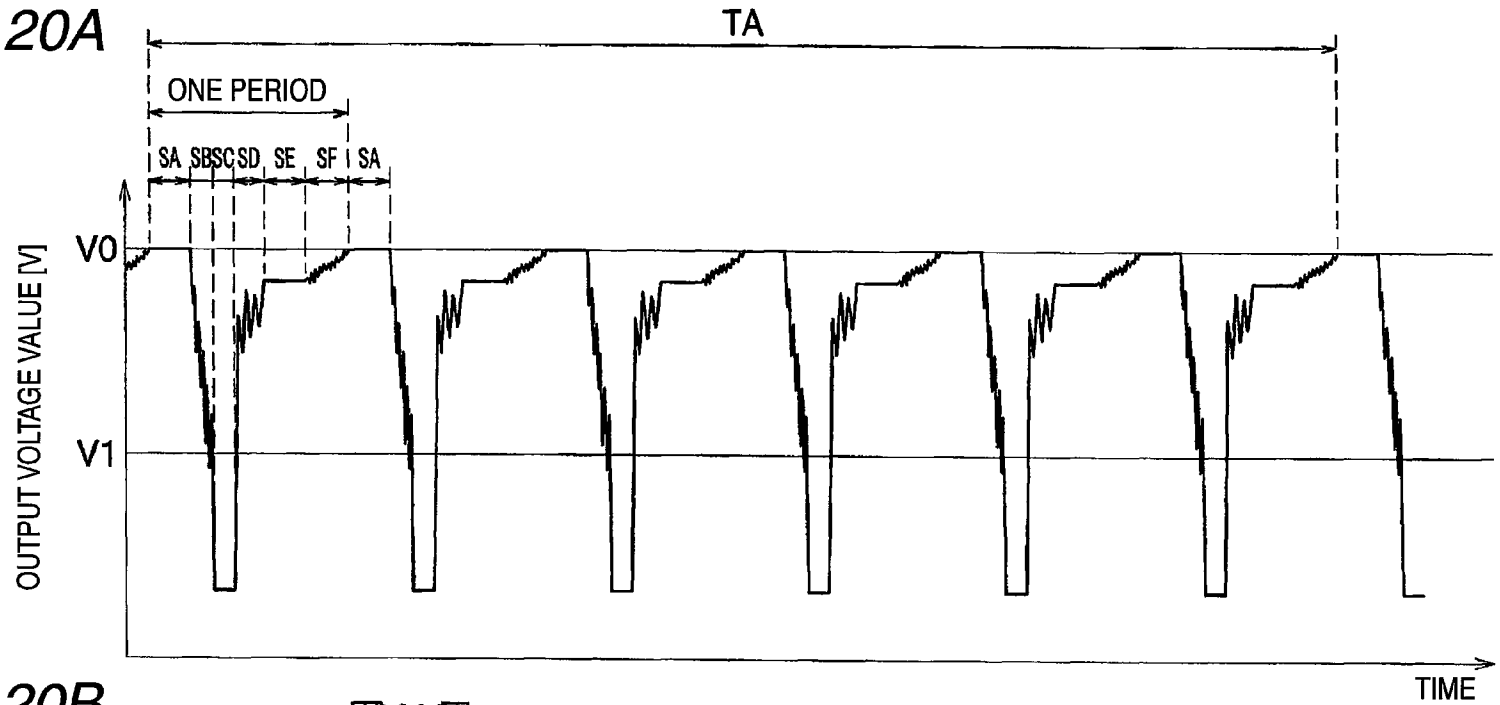
FIG. 20A is a time chart showing an output voltage value of a light receiving device when the rotating speed of an agitator becomes high.

Specifically, the speed changing unit 6120 controls the rotation of the motor in the determining mode to rotate the agitator 70 at a rotating speed $V_{LOW}$ when a large-capacity type developing cartridge is mounted. In contrast, the speed changing unit 6120 controls the rotation of the motor in the determining mode to rotate the agitator 70 at a rotating speed $V_{HIGH}$ that is higher than the rotating speed $V_{LOW}$ when a small-capacity type developing cartridge is mounted. In this case, the rotating speeds $V_{LOW}$ and $V_{HIGH}$ that can be changed by the speed changing unit 6120 are set as rotating speeds at which the agitator 70 makes an integer number of rotations for the predetermined time TA, i.e. as rotating speeds that correspond to an integer number of periods, for the predetermined time as shown in FIGS. 4 and 20A.

Here, the rotating speeds $V_{LOW}$ and $V_{HIGH}$ may be fixed values preset by performing experiments or values calculated on the basis of a preset equation from the initial capacity of the developing cartridge 5B. Also, the rotating speeds $V_{LOW}$ and $V_{HIGH}$ may be constant speeds or speeds having specified ranges (i.e. upper limit values and lower limit values). Also, either of the rotating speeds $V_{LOW}$ and $V_{HIGH}$ may be equal to the rotating speed of the agitator 70 in the image forming mode.

The operation when the rotating speed of the agitator 70 is heightened will be described later.

The detecting unit 6200 detects whether the developing cartridge 5B mounted in the main body casing 2 is a large-capacity type or a small-capacity type, and outputs the result of the detection to the speed changing unit 6120. The detecting unit 6200 may adopt a known configuration for detecting the specification of the developing cartridge 5B mounted in the main body casing 2. For example, a device that reads initial capacity information from an IC chip provided in the developing cartridge 5B or a sensor for detecting the initial capacity of the mounted developing cartridge 5B in accordance with the change of the detection state may be adopted.

The notifying unit 6300 notifies a user who operates the laser printer 1 of a message. In the sixth illustrative embodiment of the present invention, when the determining unit 6110 determines that the replacement time of the developing cartridge 5B has been reached, the notifying unit 6300 notifies a user of the message notifying it. The notifying unit 6300 may adopt, for example, a liquid crystal display notifying the message as text, picture, and the like, a speaker notifying the message as sound, a lamp notifying the message by flickering light, or the like. Also, the notifying unit may adopt a combination of two or more of the liquid crystal display, the speaker, the lamp, and the like.

Determination of Replacement Time of Developing Cartridge

Next, the determination of the replacement time of the developing cartridge 5B and the operation when the rotating speed of the agitator 70 is heightened according to the sixth illustrative embodiment of the present invention will be described while referring to the accompanying drawings.

The determining mode is executed by a known control in a period except for the image forming mode which corresponds to a period until a paper F is discharged to the outside of the main body casing 2 after a print job is input.

As illustrated in FIG. 19, if the determining mode is executed, the control device 6100 (i.e. the speed changing unit 6120) first determines whether the developing cartridge 5B mounted in the main body casing 2 is a small-capacity type or a large-capacity type on the basis of information about the type (i.e. initial capacity) of the developing cartridge 5B that is detected by the detecting unit 6200 (step S6110).

If the developing cartridge 5B is a large-capacity type ("No" in step S6110), the control device 6100 (i.e. the speed changing unit 6120) causes the agitator 70 to rotate at the rotating speed $V_{LOW}$ by controlling the rotation of the motor M (step S6121). On the other hand, if the developing cartridge 5B is a small-capacity type ("Yes" in step S6110), the control device 6100 (i.e. the speed changing unit 6120) causes the agitator 70 to rotate at the rotating speed $V_{HIGH}$ that is higher than the rotating speed $V_{LOW}$ by controlling the rotation of the motor M (step S6122).

Thereafter, the control device 6100 (i.e. the determining unit 6110) determines whether the replacement time of the developing cartridge 5B has been reached (step S6130). If it is determined that the replacement time of the developing cartridge 5B has been reached ("Yes" in step S6130), the control device 6100 causes the notifying unit 6300 to notify the message (step S6140), while if it is determined that the replacement time of the developing cartridge 5B has not been reached ("No" in step S6130), the control device 6100 terminates the determination mode.

As shown in FIG. 20A, if the rotating speed of the agitator 70 is heightened, one period of time (i.e. a time when the agitator 70 makes one rotation) is shortened, and thus the number of periods of the light reception signal included in the predetermined time TA is increased (e.g. 6 periods in FIG. 20A). In this case, since the toner T readily flows within the developing cartridge 5B, it is difficult for the light to pass through the inside of the developing cartridge 5B (i.e. the toner containing chamber 58).

Figure 20B:
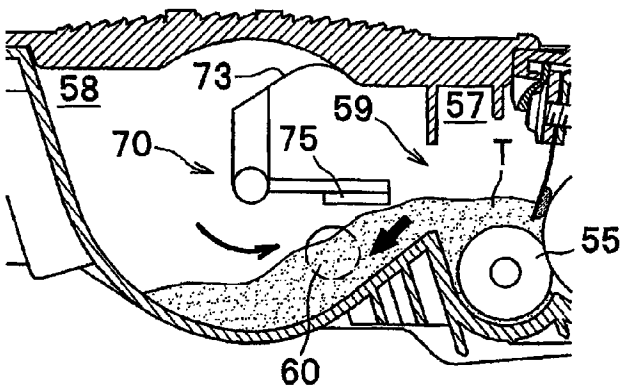
FIG. 20B is a cross-sectional view explaining movement of toner in a region SD of a light reception signal shown in FIG. 20A.

Specifically, if the rotating speed of the agitator 70 is heightened, in the process as shown in FIGS. 5A to 5C, the toner T is abruptly sent into the developing chamber 57 to be abruptly accumulated, and thus the accumulated toner T is in a state in which it readily crumbles in comparison to a case in which the rotating speed of the agitator 70 is low. In this state, as shown in FIG. 20B, the toner T falling down flows into the toner containing chamber 58 in large quantities in comparison to the case in which the rotating speed of the agitator 70 is low. Accordingly, the toner T covers most of the light transmission window 60 in a short time, and it abruptly becomes difficult for the light to pass through the inside of the toner containing chamber 58. As a result, as shown in FIG. 20A, the output voltage value in the region SD is abruptly increased in comparison to the case in which the rotating speed of the agitator 70 is low (see FIG. 4).

Also, due to the large amount of toner T flowing into the toner containing chamber 58 and the high-speed rotation of the agitator 70, the amount of toner T that flies up within the developing cartridge 5B is also increased, and thus it is entirely difficult for the light to pass through the inside of the toner containing chamber 58, resulting in that the output voltage value in the regions SD to SF becomes higher than that in the case in which the rotating speed of the agitator 70 is low.

Accordingly, the ratio of the time during which the output voltage value exceeds the light reception reference value V1 over the predetermined time TA becomes lower than that in the case in which the rotating speed of the agitator 70 is low, and thus the required time can be lengthened until the ratio exceeds the determination threshold value. As a result, the required time can be lengthened until it is determined that the replacement time of the developing cartridge 5B has been reached.

As described above, in the determining mode, by changing the rotating speed of the agitator 70 in the small-capacity type developing cartridge so that the rotating speed of the agitator 70 becomes higher than that in the large-capacity type developing cartridge, the time that is required until it is determined that the replacement time of the small-capacity type developing cartridge 5B has been reached can be lengthened. Accordingly, the user time of the small-capacity type developing cartridge 5B can be lengthened.

As described above, when the residual amount of toner T in the small-capacity type developing cartridge reaches the amount with which it is determined that the replacement is needed in the large-capacity type developing cartridge, the residual toner T in the small-capacity type developing cartridge is not deteriorated to the extent where the image quality is degraded. Accordingly, by lengthening the use time of the small-capacity type developing cartridge through heightening of the rotating speed of the agitator 70, it is possible to use the toner T in the small-capacity type developing cartridge 5B until the toner T remaining therein reaches a proper deterioration state.

Accordingly, the toner T in the small-capacity type developing cartridge can be efficiently used, and thus it is possible to increase the number of sheets that can be printed with the small-capacity type developing cartridge. Also, it is possible to reduce the amount of toner T contained in the small-capacity type developing cartridge (i.e. the initial capacity of toner T) so that the number of sheets that can be printed is kept, for example, at 3,000.

In the sixth illustrative embodiment, since in the image forming mode, the agitator 70 is caused to rotate at the same rotating speed regardless of the initial capacity and in the determining mode, the rotating speed of the agitator 70 is changed between the $V_{LOW}$ or $V_{HIGH}$ in accordance with the initial capacity, the configuration of the laser printer 1 can be simplified with the cost restrained in comparison to the case in which the rotating speed of the agitator 70 is changed in the image forming mode.

If the rotating speed of the agitator 70 is changed in the image forming mode, the timing for exposure, transfer, or the like, is changed, and thus it is required to set the control in the image forming mode for each mountable developing cartridge 5B or to provide a mechanism for enabling only the rotating speed of the agitator 70 to be changed. Accordingly, the configuration of the laser printer 1 becomes complicated and the cost is increased.

In the sixth illustrative embodiment, since plural rotating speed that can be changed by the speed changing unit 6120 are set as rotating speeds at which the agitator 70 makes an integer number of rotations in a predetermined time TA, the light reception signal includes an integer number of periods in the predetermined time TA that is the time when the determining unit 6110 acquires the light reception signal for the determination of the replacement time. Here, if the rotating speed corresponds to, for example, 4.5 periods or 6.2 periods included in the predetermined time TA, it is required to properly change the time for acquiring the light reception signal from the predetermined time TA in order to accurately determine the replacement time. Accordingly, as in the sixth illustrative embodiment, by setting the rotating speed so that an integer number of periods are included in the predetermined time TA, the determination of the replacement time can be performed without changing the time for acquiring the light reception signal.

<Seventh Illustrative Embodiment>

Next, a seventh illustrative embodiment of the present invention will be described in detail while referring to the accompanying drawings. In this illustrative embodiment, the speed changing wilt is not provided in the main body casing 2, but is provided in the developing cartridge 5B. In the following description, the same reference numerals are used for the same constituent elements as those of the above-described illustrative embodiment, and the detailed description thereof will be omitted.

Although in the sixth illustrative embodiment as described above, the configuration in which the control device 6100 (i.e. speed changing unit 6120) as an example of the speed changing unit is provided in the main body casing 2 is described, the present invention is not limited thereto, and the speed changing unit may be provided in, for example, the developing cartridge 5B.

Figure 21A:
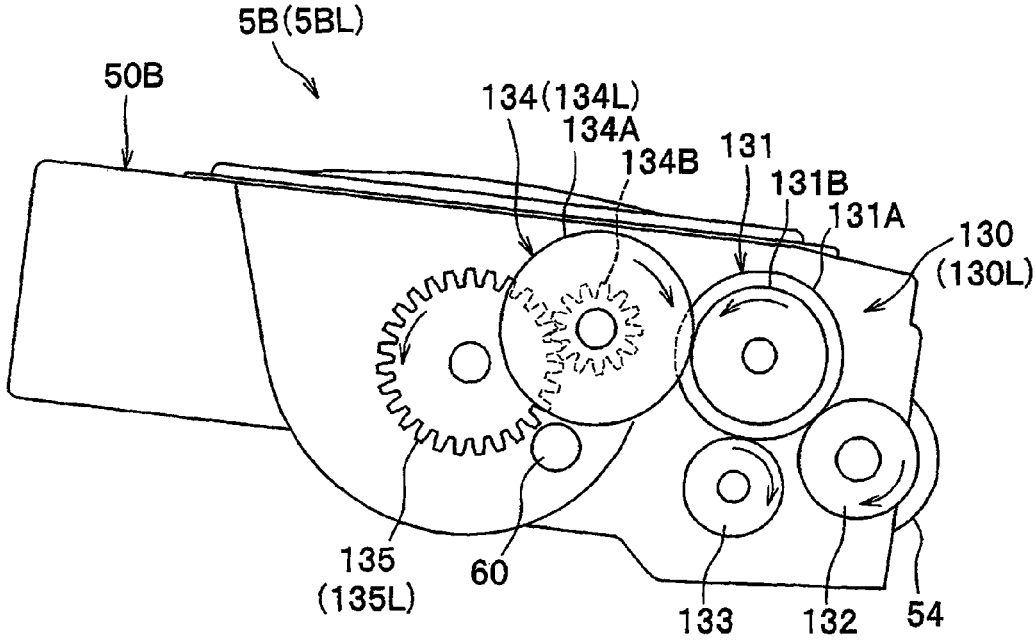
FIG. 21A is a side view of a large-capacity type developing cartridge.
Figure 21B:
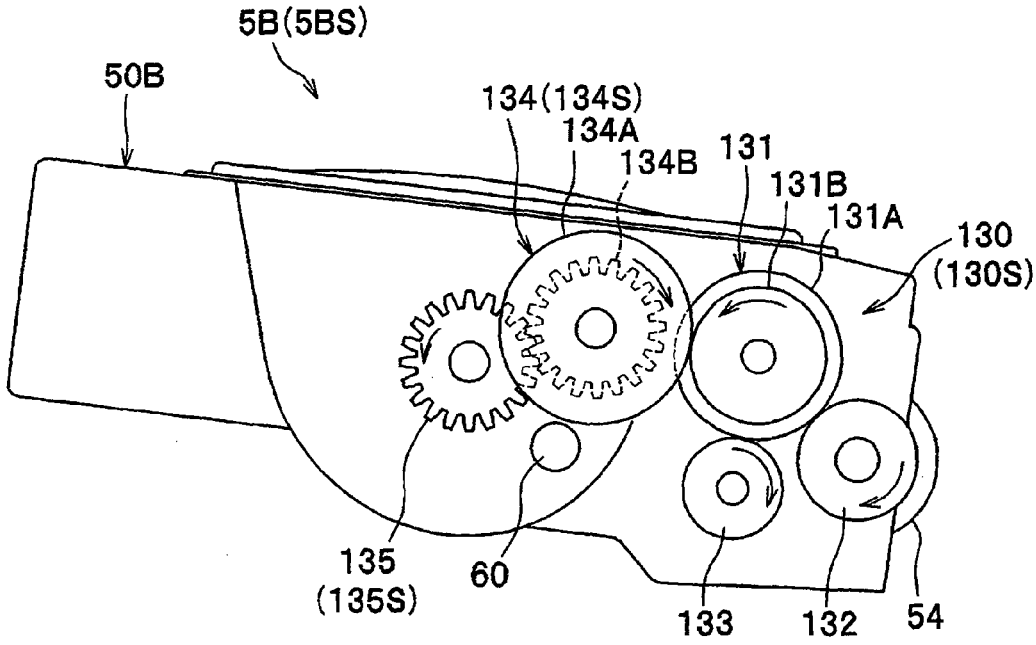
FIG. 21B is a side view of a small-capacity type developing cartridge according to a seventh illustrative embodiment of the present invention.

Specifically, as shown in FIGS. 21A and 21B, the speed changing unit in the seventh illustrative embodiment includes a gear mechanism 130 (130L and 130S) as an example of a gear train which is provided on a right side face of the developing cartridge 5B and transfers a driving force that is input from the main body casing 2 (i.e. the motor M) to the agitator 70. FIG. 21A shows a large-capacity type developing cartridge 5BL and FIG. 21B shows a small-capacity type developing cartridge 5BS.

The gear mechanism 130 includes an input gear 131 receiving an input of the driving force from the main body casing 2, a developing roller gear 132 and a supply roller gear 133 engaged with the input gear 131 (i.e. a large-diameter gear part 131A) to rotate a developing roller 54 and a supply roller 55, respectively, a transfer gear 134 (134L and 134S) engaging the large-diameter gear part 134A with the input gear 131 (i.e. a small-diameter gear part 131B), and an agitator gear 135 (135L and 135S) fixed to the rotating spindle 71 to rotate the agitator 70 by the driving force transferred from the transfer gear 134.

The gear mechanism 130 is configured to change its transmission ratio in accordance with the initial capacity of the developing cartridge 5B (whether the developing cartridge is a large-capacity type or a small-capacity type). Specifically, the gear mechanism 130 is configured to change the transmission ratio of the small-diameter gear part 134B of the transfer gear 134 to the agitator gear 135.

The transmission ratio of the transfer gear 134 (i.e. the small-diameter gear part 134B) to the agitator gear 135 is set so that the rotating speed of the agitator 70 in the small-capacity type developing cartridge is heightened (i.e. the rotation is increased) in comparison to that in the large-capacity type developing cartridge. Specifically, the transmission ratio in the small-capacity type developing cartridge that is obtained by the following equation (1) is set to be lower than that in the large-capacity type developing cartridge.

$$\text{Transmission ratio} = \text{the number of teeth of agitator gear/the number of teeth of transfer gear small-diameter gear part)} \quad (1)$$

Specifically, in the illustrative embodiment as shown in FIGS. 21A and 21B, the transmission ratio of the large-capacity type is set to about 2, and the transmission ratio of the small-capacity type is set to 1. Accordingly, in the large-capacity type developing cartridge, the transfer gear 134 makes two rotations to make the agitator gear 135 (i.e. the agitator 70) make one rotation, while in the small-capacity type developing cartridge, the transfer gear 134 makes two rotations to make the agitator gear 135 (i.e. the agitator 70) make two rotations, and thus the rotating speed of the agitator 70 is heightened.

By providing this gear mechanism 130 (i.e. the speed changing unit) in the developing cartridge 5B, it becomes possible to apply the present invention to a configuration in which the speed changing unit and the detecting unit are not provided in the main body casing 2 (i.e. a related-art image forming apparatus having a determining unit). That is, the rotating speed of the agitator 70 of the small-capacity type developing cartridge can be changed to be higher than that of the large-capacity type developing cartridge. Accordingly, in the same manner as in the sixth illustrative embodiment, the use time of the small-capacity type developing cartridge can be lengthened, and thus it is possible to use the toner T in the small-capacity type developing cartridge 5B until the toner T remaining therein reaches a proper deterioration state.

Even in the seventh illustrative embodiment, it is preferable that the rotating speed of the agitator 70 which is determined by the gear mechanism 130 (130L and 130S) is set as a rotating speed at which the agitator 70 makes an integer number of rotations in the predetermined time TA that is the time when the determining unit acquires the light reception signal for the determination of the replacement time of the developing cartridge 5B. Accordingly, the determination of the replacement time can be performed without changing the time for acquiring the light reception signal in accordance with the initial capacity of the developing cartridge 5B.

In the seventh illustrative embodiment, the size (i.e. diameter), the number, the arrangement, the transmission ratio, and the like, of gears that constitute the gear mechanism 130 may be properly modified. Also, a belt may be adopted to transfer the driving force between two gears.

Although the sixth and seventh illustrative embodiments have been described above, the present invention is not limited to such illustrative embodiments. The detailed configuration of the present invention may be properly modified without deviating from the scope of the present invention.

Although in the sixth and seventh illustrative embodiments, two types of developing cartridges 5B that can be mounted in the laser printer 1 are exemplified, the present invention is not limited thereto, and, for example, three or more types of developing cartridges may be used. When three or more types of developing cartridges are used, the rotating speed of an agitating member may be individually set for the respective types of developing cartridges or for respective initial capacity ranges of the developing cartridges. In the latter case, the rotating speed of the agitating member is set to $V_{LOW}$ in the cartridge for which the number of sheets that can be printed is set to equal to or more than 6,000, the rotating speed of the agitating member is set to $V_{HIGH}$ in the cartridge for which the number of sheets that can be printed is set to more than 3,000 and less than 6,000, and the rotating speed of the agitating member is set to $V_{MEDIUM}$ in the cartridge for which the number of sheets that can be printed is set to equal to or less than 3,000 ($V_{LOW}<V_{MEDIUM}<V_{HIGH}$). For example, in the case of using three types of mountable cartridges, two agitators in two cartridges of which the initial capacities are included in a range may be caused to rotate at the same rotating speed, and the agitator in the remaining cartridge of which the initial capacity is included in another range may be caused to rotate a different rotating speed.

The configuration of the agitator 70 (i.e. the agitating member) described in the sixth and seventh illustrative embodiments are exemplary, and the present invention is not limited thereto. For example, the positional relationship between the sheet member 73 (i.e. the sheet attaching unit 72) and the wiper 75 (i,e. the wiper attaching unit 74) may be different from that in the above-described illustrative embodiments, and the configuration for attaching the wiper 75 may be different from that in the above-described illustrative embodiments. Also, the length of the sheet member may be different from that in the above-described illustrative embodiments, and the sheet member may not be provided.

<Eighth Illustrative Embodiment>

Next, an eighth illustrative embodiment of the present invention will be described in detail while referring to the accompanying drawings. In the following description, the same reference numerals are used for the same constituent elements as those of the above-described illustrative embodiment, and the detailed description thereof will be omitted.

In the eighth illustrative embodiment, the developing cartridge has a configuration different from that in the above-described illustrative embodiment.

Configuration of Developing Cartridge

In the eighth illustrative embodiment, a developing cartridge 805B mountable in the laser printer 1 is classified into two types which contain different initial capacities of toner. Specifically, for example, there are a large-capacity type developing cartridge for which the number of sheets that can be printed is set to 6,000 and a small-capacity type developing cartridge for which the number of sheets that can be printed is set to 3,000 and which contains an initial capacity of toner that is smaller than that of the large-capacity type developing cartridge.

Figure 22A:
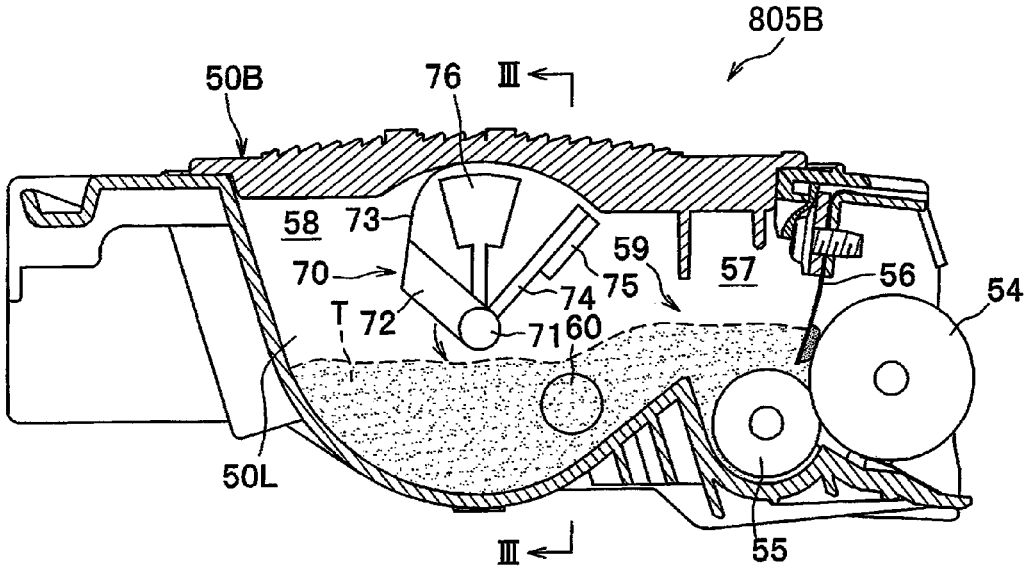
FIG. 22A is an enlarged cross-sectional view of a large-capacity type developing cartridge.
Figure 22B:
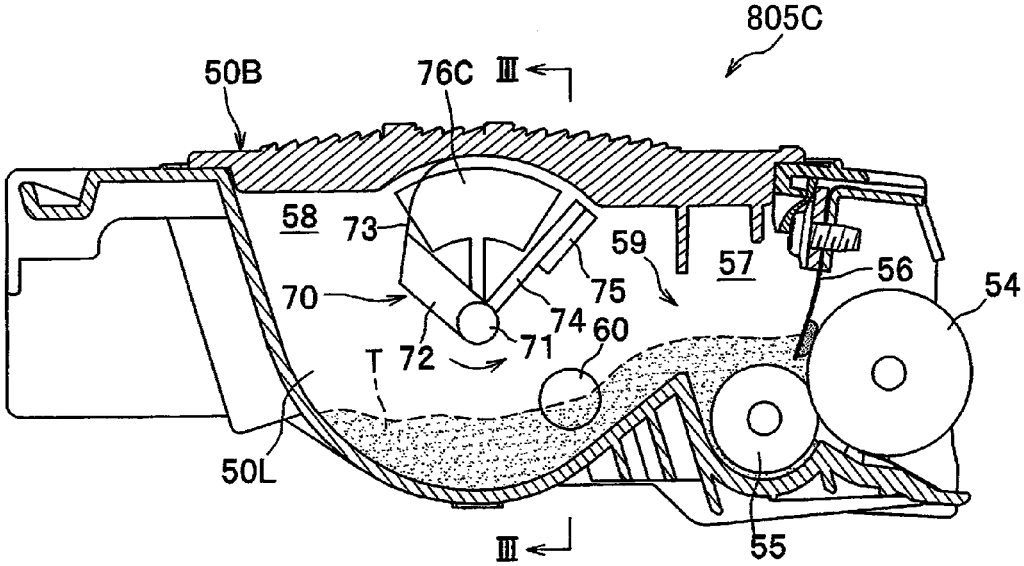
FIG. 22B is an enlarged cross-sectional view of a small-capacity type developing cartridge according to an eighth illustrative embodiment of the present invention.

Here, FIG. 22A shows a large-capacity developing cartridge 805B as an example of a second developing agent container, and FIG. 22B shows a small-capacity developing cartridge 805C as an example of a first developing agent container. In the eighth illustrative embodiment, an image forming system is configured by the two types of developing cartridges 805B and 805C and the laser printer 1 in which each of the two types of developing cartridges 805B and 805C is detachably mountable in a same position.

The respective types of developing cartridges 805B and 805C have different initial capacities of toner T contained in their toner containing chambers 58, but their basic configurations are substantially the same. However, in the eighth illustrative embodiment, a light shielding member 76 or 76C, which will be described later, has different structures. Hereinafter, the structures of the respective developing cartridges 805B and 805C with common portions will be described in detail.

As illustrated in FIGS. 22A and 22B, the developing cartridge 805B or 805C is partitioned into a developing chamber 57 in which a supply roller 55, or the like, is arranged and a toner containing chamber 58 in which the toner T is accommodated by way of a developing frame 50B. The developing chamber 57 and the toner containing chamber 58 communicate with each other through a communicating part 59. This communicating part 59 is formed over the substantially entire width in an axis direction of a roller portion of the supply roller 55, and the toner T can communicate between the developing chamber 57 and the toner containing chamber 58 through the communicating part 59.

Figure 23:
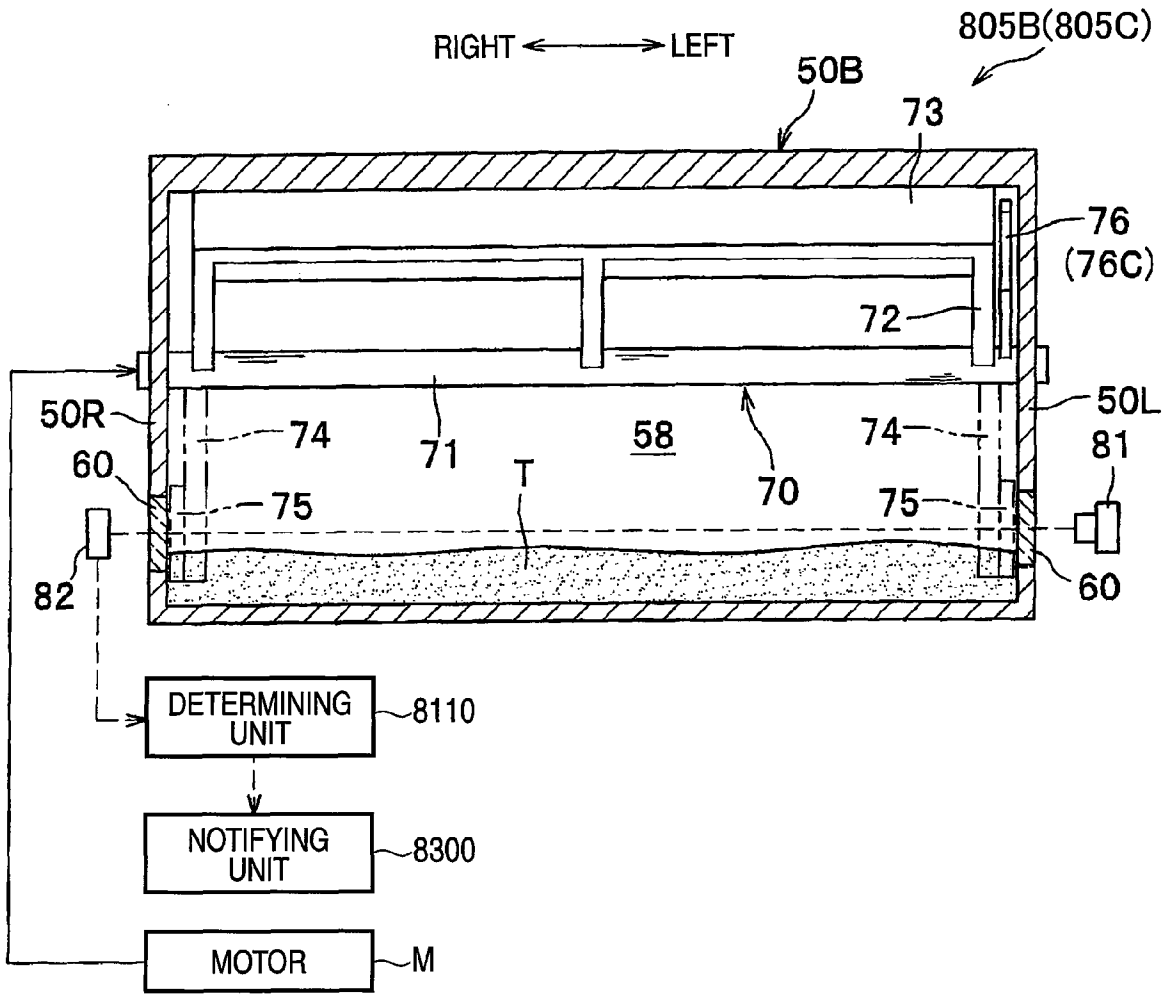
FIG. 23 is a cross-sectional view illustrating a schematic configuration of an image forming apparatus according to the eighth illustrative embodiment.

In the toner containing chamber 58, an agitator 70 that rotates to agitate the toner T is provided. Also, as illustrated in FIG. 23, on side walls 50L and 50R of the toner containing chamber 58 (i.e. developing frame 50B), which face each other, transparent light transmission windows 60 are oppositely provided in left and right directions as examples of a pair of light transmission parts.

As illustrated in FIGS. 22A and 22B, the agitator 70 is mainly provided with a rotating spindle 71, a sheet attaching unit 72, a sheet member 73 as an example of a transport member, a wiper attaching unit 74, a wiper 75, and a light shielding member 76 (or a light shielding member 76C).

The rotating spindle 71 is a shaft extending along the axis direction (i.e. left/right direction) of the developing roller 54 and the supply roller 55, and both ends of the rotating spindle 71 is rotatably supported on the side walls 50L and 50R (in FIG. 2, only one side is illustrated) of the developing frame 50B.

The sheet attaching unit 72 is formed to extend to the outside in a radius direction from the rotating spindle 71, and its front end is fixed to the sheet member 73 by adhesion or the like.

The sheet member 73 is a flexible sheet type member which, by the rotation of the agitator 70, agitates the toner T as its front end slides across a bottom wall of the toner containing chamber 58, or the like, and transports the agitated toner T toward the developing chamber 57.

The wiper attaching unit 74 is provided in each place in the periphery of both ends in axis direction of the rotating spindle 71 (Refer to FIG. 23). The wiper attaching unit 74, at the rear of the rotating direction of the sheet attaching unit 72, as seen from its side, is formed in a position that is substantially perpendicular to the sheet attaching unit 72 so as to extend to the outside in the radial direction from the rotating spindle 71. In the wiper attaching unit 74, a wiper 75 is fixed by adhesion to an outside surface in an axis direction of the rotating spindle 71.

The wiper 75, as illustrated in FIG. 23, is a member that wipes the toner T attached to the light transmission window 60 as it slides across the light transmission window 60, and is formed of a flexible material, such as urethane rubber, or the like. FIG. 23 shows a position in which the wiper 75 slides across the light transmission window 60.

The light shielding member 76 or 76C is a member that periodically blocks light that passes through the pair of light transmission windows (i.e. an optical path from a light emitting device 81 to a light receiving device 82 to be described later) for a predetermined time. The light shielding member 76 or 76C is provided between the sheet member 73 and the wiper 75 to be rotatable integrally with the sheet member 73 and the wiper 75. Also, the light shielding member 76 or 76C is arranged in a position near to the side wall 50L of the developing frame 50B, i.e. on the side of the light emitting device 81. Also, the light shielding member 76C that is provided inside the small-capacity type developing cartridge 805C as shown in FIG. 22B is formed to be longer than the light shielding member 76 that is provided inside the large-capacity type developing cartridge 805B in a rotating direction as shown in FIG. 22A. Accordingly, the light shielding member 76C in the small-capacity type developing cartridge 805C blocks the light for a longer time than the light shielding member 76 in the large-capacity type developing cartridge 805B.

In the case of manufacturing the small-capacity type developing cartridge in the process of manufacturing two types of developing cartridges 805B and 805C, the light shielding member 76C that is longer than the light shielding member 76 used in the large-capacity type developing cartridge 805B in a rotating direction may be used. Specifically, a manufacturing method is employed which includes selecting the light shielding member 76 or 76C having different length according to the type of the developing cartridge, fixing the selected light shielding member to the rotating spindle 71, integrally forming the sheet attaching unit 72, the rotating spindle 71, the light shielding member 76 or 76C, and the wiper attaching unit 74 by frame molds corresponding to the two types of developing cartridges, and the like.

To the agitator 70 as configured above, a rotation driving force is given from the motor M provided inside the main body casing 2, rotates counterclockwise about the rotating spindle 71 in the toner containing chamber 58 to agitate and transport the toner T by way of the sheet member 73. Also, the sheet member 73, the light shielding member 76 or 76C, and the wiper 75 are integrally rotated about the rotating spindle 71, and successively pass through the light transmission window 60 in this order.

Configuration of Main Body Casing

As illustrated in FIG. 23, the laser printer 1 includes a light emitting device 81, a light receiving device 82, a determining unit 8110 configured to determine the replacement time of the developing cartridges 805B and 805C, and a notifying unit 8300 configured to notify a user of a message, in a main body casing 2.

The light emitting device 81 and the light receiving device 82 are oppositely arranged and interposed between a pair of light transmission windows of the developing cartridge 805B or 8050 mounted in the main body casing 2. As the light emitting device 81 and the light receiving device 82, known light sensors may be adopted.

As illustrated as a dotted line in FIG. 23, light emitted from the light emitting device 81 enters into the toner containing chamber 58 through one side light transmission window 60, and is received in the light receiving device 82 through the other side light transmission window 60. The light receiving device 82 is a device of which the output voltage value is changed depending upon the intensity of the received light, and outputs a light reception signal as shown in FIG. 24 to the determining unit 8110.

Here, the light reception signal will be described with reference to FIGS. 24 and 25A to 25D. In the eighth illustrative embodiment, the light receiving device 82 is adopted such that when the intensity of the received light is minimum, the output voltage value is becomes maximum, while when the intensity of the received light is maximum, the output voltage value becomes minimum. Accordingly, as shown in FIG. 24, as the output voltage value is larger, the intensity of the received light is lower, while as the output voltage value is smaller, the intensity of the received light is higher. In this case, V0 denotes the output voltage value when the light receiving device 82 receives no light (i.e. when the intensity of the received light is minimum). Also, the waveform as shown in FIG. 24 represents the waveform when the residual amount of toner inside the development cartridge 805B or 805C is relatively decreased.

Figure 24:
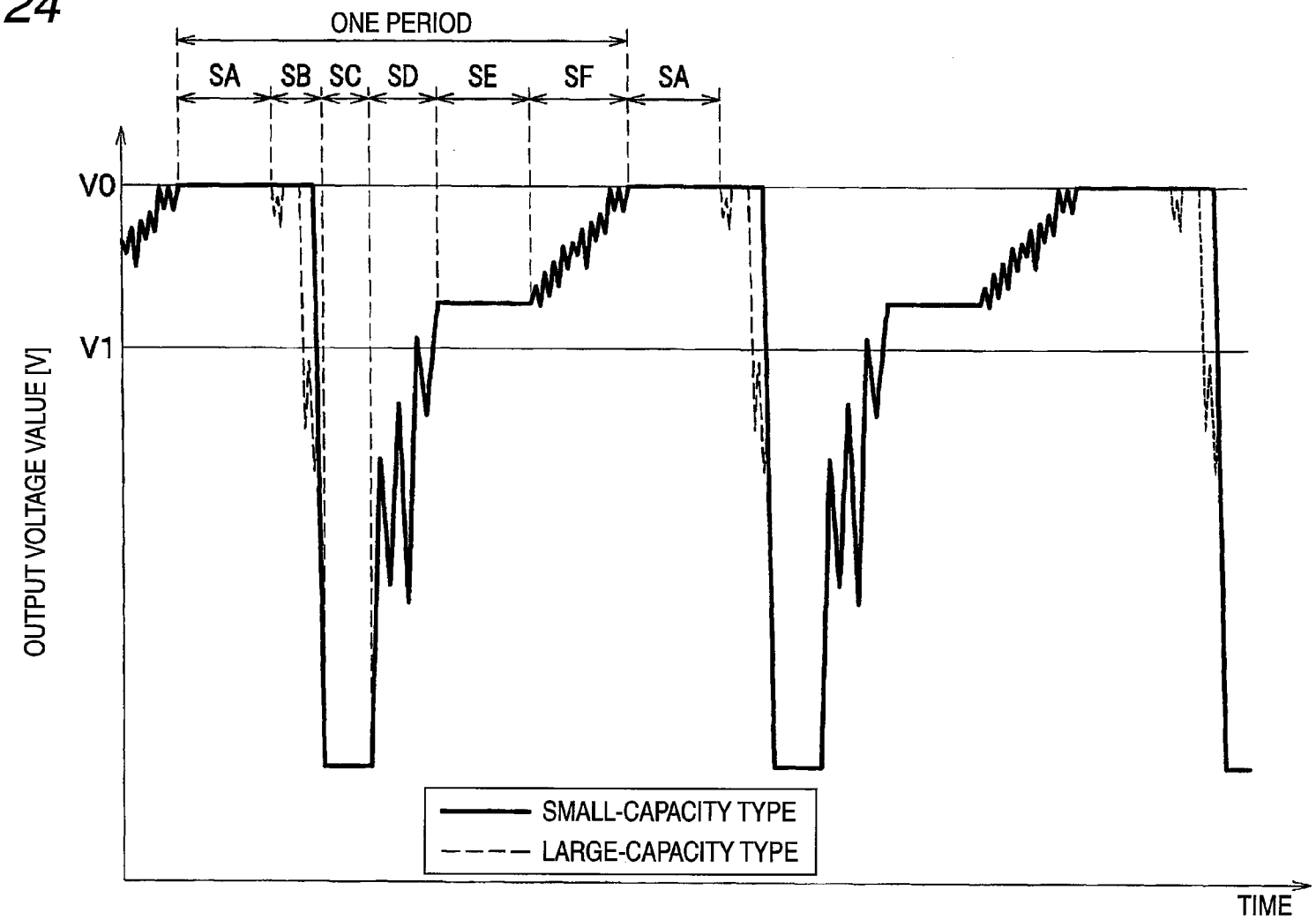
FIG. 24 is a time chart showing a light reception signal of a light receiving device according to the eighth illustrative embodiment.
Figure 25A:
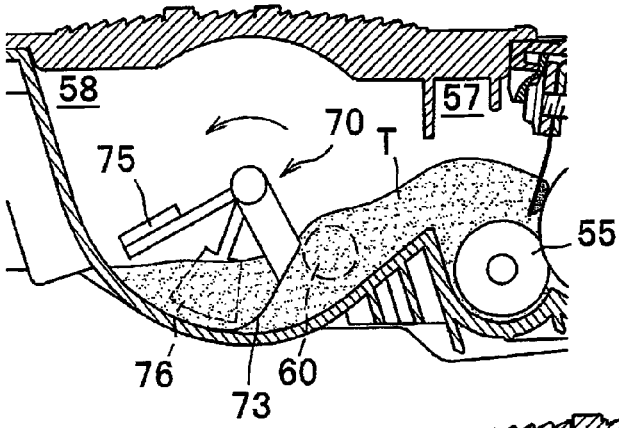
FIGS. 25A, 25B, 25C and 25D are cross-sectional views for explaining the operation of an agitator and movement of toner according to the eighth illustrative embodiment.

As shown in FIG. 25A, in a process in which the sheet member 73, by the rotation of the agitator 70, gathers and transports the toner T to the side of the developing chamber 57 as the sheet member 73 slides across the bottom surface of the toner containing chamber 58, if the gathered toner T completely covers the light transmission window 60, the light receiving device 82 is in a state in which the light receiving device 82 hardly receives the light, and thus the output voltage value becomes a maximum value V0 (corresponding to a region SA in FIG. 24).

If the sheet member 73 passes between the pair of light transmission windows 60 by the rotation of the agitator 70, the amount of toner T between the pair of light transmission windows 60 is decreased due to the transport of the toner by the sheet member 73, and thus the intensity of the light that is received in the light receiving device 82 is heightened (the first half dotted portion in a region SB of FIG. 24).

Here, the region SB is a temporal region until the wiper 75 wipes the light transmission window 60 after the sheet member 73 passes through the light transmission window 60. Accordingly, in the region SB, the wiper 75 has not yet wiped the light transmission window 60 (i.e. the toner T is attached to the light transmission window 60), and thus the light has an intensity weaker than the maximum value of the light.

Figure 25B:
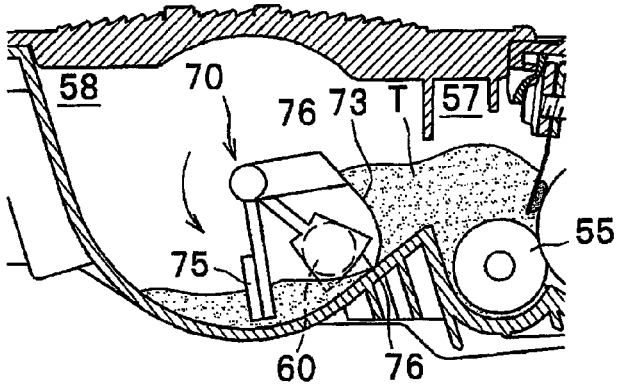

Also as shown in FIG. 25B, if the light passing between the light emitting device 81 and the light receiving device 82 is completely blocked by the light shielding member 76, the output voltage value becomes again the maximum value V0 (corresponding to an intermediate portion of a dotted line in the region SB in FIG. 24). Then, if the light shielding member 76 gets out of the light path, the light passes between the light shielding member 76 and the wiper 75, and the intensity of the light that is received in the light receiving device 82 is heightened (corresponding to the latter half of the dotted line in the regions SB in FIG. 24).

The waveform of the dotted line in the region SB is a waveform corresponding to the light shielding member 76 of the large-capacity type developing cartridge. In the small-capacity type developing cartridge, since the light shielding member 76C is formed to be longer than the light shielding member 76 provided inside the large-capacity type developing cartridge in the rotating direction, in the region SB, as illustrated as a solid line in FIG. 24, the light is continuously blocked by the light shielding member 76C, and thus the output voltage value is roughly kept the maximum value V0.

Figure 25C:
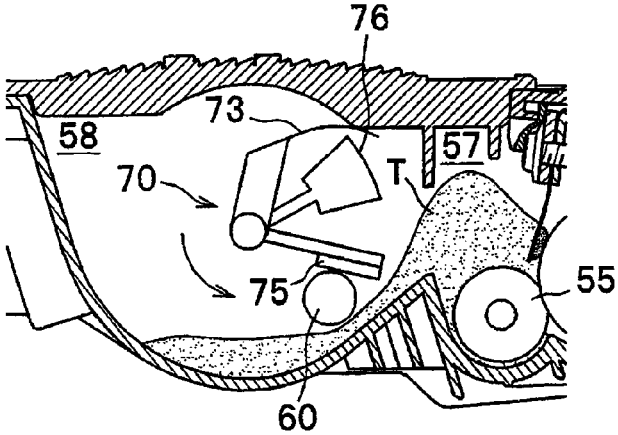

As illustrated in FIG. 25C, if the toner T attached to the light transmission window 60 is wiped by the wiper 75, as shown in FIG. 24, the intensity of the light that is received in the light receiving device 82 becomes maximum, and thus the output voltage value becomes minimum (corresponding to a region SC).

Figure 25D:
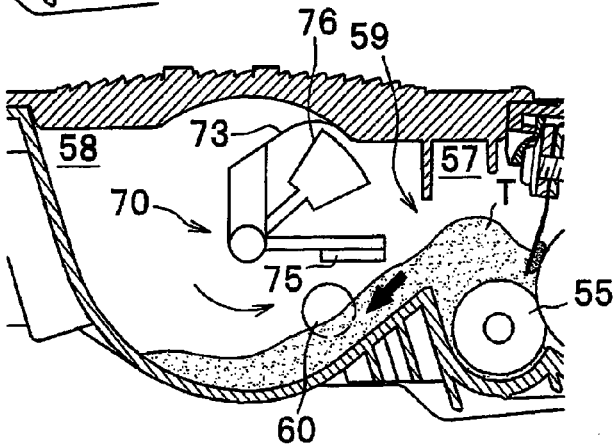

Although in the process as shown in FIGS. 25A to 25C, the toner T is accumulated in the developing chamber 57, a part of the toner T crumbles as shown in FIG. 25D, and thus the toner T flows into the toner containing chamber 58 through the communicating part 59. As the toner T having flowed into the toner containing chamber 58 covers at least a part of the light transmission window 60, the intensity of the light received in the light receiving device 82 is lowered to cause the output voltage value to become large (corresponding to a region SD).

Thereafter, as shown in FIG. 22, while the sheet member 73 slides across an upper wall or a front wall of the toner containing chamber 58, the amount of movement of the toner T in the periphery of the light transmission window 60 becomes small, and thus the output voltage value is shifted to a substantially constant level (corresponding to a region SE). Also, as the sheet member 73 runs into the toner T accumulated on the bottom wall of the toner containing chamber 58, gradually gathers and transports the toner T to the side of the developing chamber 57 as the sheet member 73 slides across the bottom wall of the toner containing chamber 58, the light transmission window 60 is gradually covered with the toner T, and thus the output voltage value becomes larger (corresponding to a region SF). Once the light transmission window 60 is completely covered, the output voltage value becomes maximum (corresponding to the region SA).

As shown in FIG. 23, the determining unit 8110 is provided with a CPU, a RAM, a ROM, an input/output circuit, and the like (not illustrated). The determining unit 8110 determines the replacement time of the developing cartridge 805B or 805C on the basis of a program or data stored in the ROM, outputs from the light receiving device 82, and the like.

The basic flow of the replacement time determination will be briefly described. As shown in FIG. 24, in a predetermined time TA including one or plural periods (e.g. one period is a time required for one rotation of the agitator 70, and four periods are provided as shown in FIG. 24), the time during which the output voltage value exceeds a preset light reception reference value V1 (i.e. in FIG. 24, the time during which the output voltage value is lower than the reference value V1) is calculated by the determining unit 8110. Here, the time during which the output voltage value exceeds the preset light reception reference value V1 means the time when the light with the intensity of equal to or larger than a predetermined value is received, and hereinafter in the eighth illustrative embodiment, for convenience, it is called a "light reception time". Then, the determining unit 8110 calculates the ratio of the light reception time over the predetermined time TA. Then, the determining unit 8110 compares the calculated time ratio with a preset determination threshold value, and if the calculated ratio exceeds the determination threshold value, the determining unit 8110 determines that the replacement time of the developing cartridge 805B or 805C has been reached.

In this case, the method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time, and whether the output voltage value (i.e. respective sampling point) every predetermined time exceeds the light reception reference value may be determined. In this case, the ratio of sampling points that exceed the determination reference value to the entire sampling points may be calculated, and the replacement time may be determined depending upon whether the ratio exceeds the determination threshold value.

The notifying unit 8300 notifies a user who operates the laser printer 1 of a message. In this illustrative embodiment of the present invention, when the determining unit 8110 determines that the replacement time of the developing cartridge 805B or 805C has been reached, the notifying unit 8300 notifies a user of the message. The notifying unit 8300 may adopt, for example, a liquid crystal display notifying the message as text, picture, and the like, a speaker notifying the message as sound, a lamp notifying the message by flickering light, or the like. Also, the notifying unit 8300 may adopt a combination of two or more of the liquid crystal display, the speaker, the lamp, and the like.

Method of Determining Replacement Time of Developing Cartridge

Next, a method of determining a replacement time of the developing cartridge according to the eighth embodiment will be described.

When a large-capacity type developing cartridge 805B in which a predetermined amount of toner T remains is mounted in the laser printer 1, as shown in FIG. 24, waveforms of the output voltage value which is indicated as a dotted line in a region SB and is indicated as a solid line in other regions are obtained. In contrast, when a small-capacity type developing cartridge 805C in which a predetermined amount of toner T remains is mounted in the laser printer 1, as shown in FIG. 24, waveforms of the output voltage value which is indicated as a dotted line in respective regions are obtained.

Accordingly, in the large-capacity type developing cartridge, a time when the output voltage value exceeds the light reception reference value V1 occurs in the regions SB, while in the small-capacity type developing cartridge, the output voltage value never exceed the light reception reference value V1 in the region SB. That is, the light reception time (i.e. the time when the light output value exceeds the light reception reference value V1) is shortened when the small-capacity type developing cartridge 805C in which a predetermined amount of toner T remains is mounted in the laser printer 1 rather than when the large-capacity type developing cartridge 805B in which a predetermined amount of toner T remains is mounted in the laser printer 1.

Accordingly, the ratio of the light reception time to a predetermined time (e,g, 13/100) may exceed the determination threshold value (e.g. 12%) when a predetermined residual amount of toner T remains in the large-capacity type developing cartridge 805B, whereas the ratio of the light reception time to the predetermined time (e.g. 11/100) may not exceed the determination threshold value even though a predetermined residual amount of toner T remains in the small-capacity type developing cartridge 805C.

As a result, the determining unit 8110 determines that the replacement time has been reached when the predetermined amount of toner T remains in the large-capacity type developing cartridge 805B, whereas the determining unit 8110 determines that the replacement time has been reached when a specified amount of toner T, which is smaller than the predetermined amount of toner T, remains in the small-capacity type developing cartridge 805C. Accordingly, it is possible to use the small-capacity type developing cartridge 5B until the toner T remaining therein, which could not be efficiently used in the related art, reaches a proper deterioration state.

Also, in the eighth illustrative embodiment, the toner T in the small-capacity type developing cartridge can be efficiently used, and thus it is possible to increase the number of sheets that can be printed with respect to the small-capacity type developing cartridge. Also, it is possible to reduce the amount of toner T contained in the small-capacity type developing cartridge (i.e. the initial capacity of toner T) as the number of sheets that can be printed is kept, for example, 3,000.

Although the eighth illustrative embodiment has been described, the present invention is not limited to the eighth illustrative embodiment. The detailed configuration of the present invention may be properly modified without deviating from the scope of the present invention.

Figure 26A:
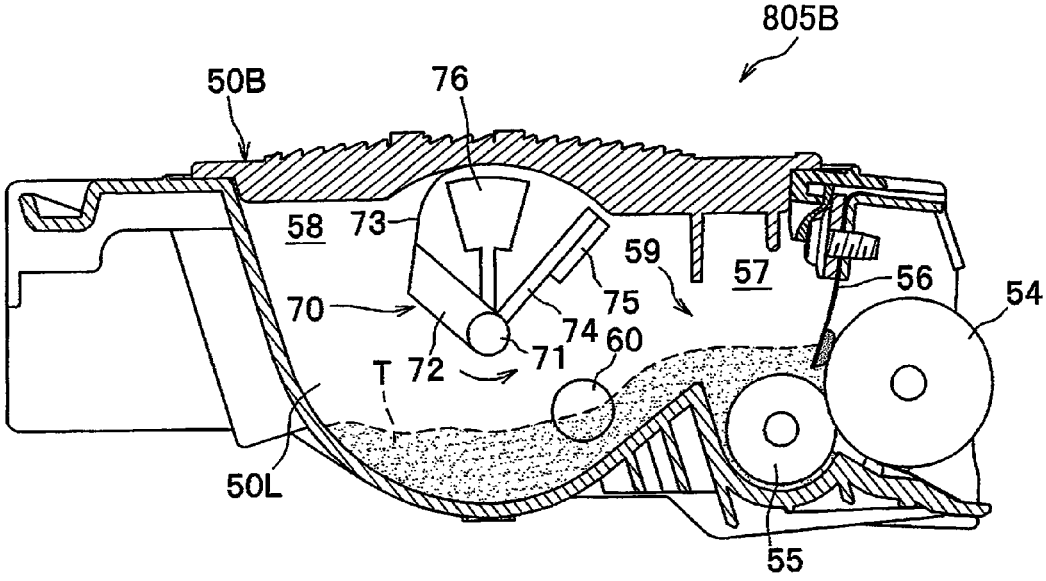
FIG. 26A is an enlarged cross-sectional view showing a state in which the position of a light shielding member is changed according to the type of a developing cartridge, e.g. in a small-capacity type developing cartridge.
Figure 26B:
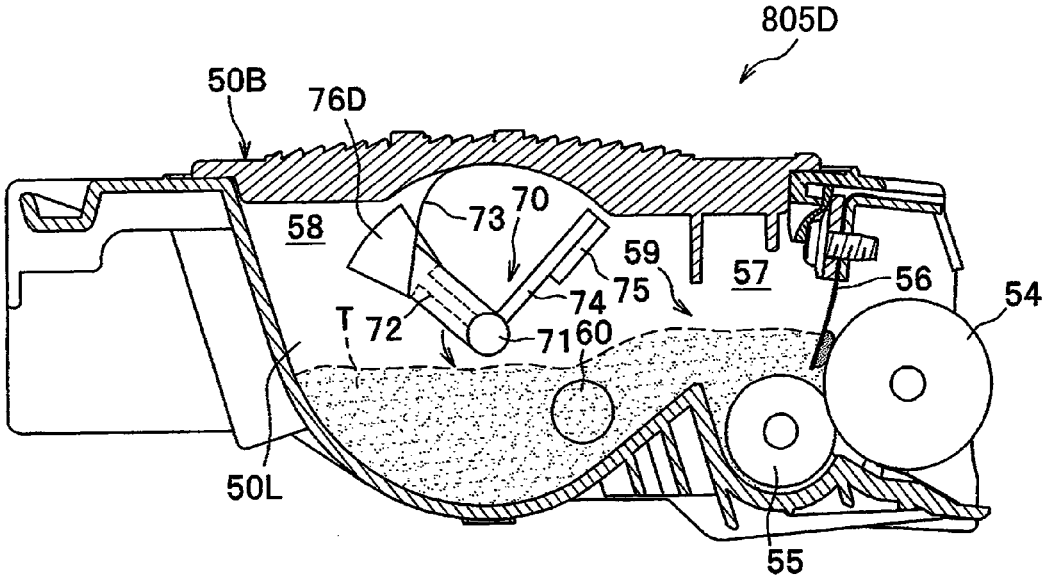
FIG. 26B is an enlarged cross-sectional view showing a state in which the position of a light shielding member is changed in a large-capacity type developing cartridge.

Although in the eighth illustrative embodiment, the length of the light shielding member is changed according to the type of the developing cartridge, the present invention is not limited thereto. As shown in FIGS. 26A and 26B, the position of the light shielding member 76 may be changed according to the type of the developing cartridge. Specifically, the position of the light shielding member 76 against the sheet member 73 in the small-capacity type developing cartridge as shown in FIG. 26A may be changed so that the light shielding member 76 is arranged in a position different from that of the light shielding member 76D in the rotating direction in the large-capacity type developing cartridge as shown in FIG. 26B to make the light shielding time longer than that of the light shielding member 76D in the large-capacity type developing cartridge. Here, as shown in FIGS. 26A and 26B, the large-capacity type developing cartridge in the above-described eighth illustrative embodiment is used as the small-capacity type developing cartridge, and the position of the light shielding member 76 in this developing cartridge 805B is changed to use this developing cartridge as a large-capacity type developing cartridge 805D.

In order to manufacture the two types of developing cartridges 805B and 805D, the light shielding member 76 in the small-capacity type developing cartridge is arranged in a different position in the rotating direction from the position of the light shielding member 76D in the large-capacity type developing cartridge with respect to the sheet member 73 so that the time when the light shielding member 76 in the small-capacity type developing cartridge blocks the light is lengthened in comparison to the light shielding member 76D in the large-capacity type developing cartridge. Also, as methods for arranging the light shielding members 76 and 76D in different positions, a method of fixing the light shielding member 76 or 76D to the rotating spindle 71 as measuring their angles with respect to the sheet attaching unit 72 with a measuring tool, a method of integrally forming the sheet attaching unit 72, the rotating spindle 71, the light shielding member 76 or 76D, and the wiper attaching unit 74 by frame molds corresponding to the two types of developing cartridges, and the like, may be used.

More specifically, in the small-capacity type developing cartridge 805B as shown in FIG. 26A, in the same manner as in the eighth illustrative embodiment, the light shielding member 76 is arranged between the sheet member 73 and the wiper 75. In contrast, in the large-capacity type developing cartridge 805D as shown in FIG. 26B, the light shielding member 76D is arranged in a position in which the light blocking function does not exhibits so much, e.g. in a position which, as seen from the side thereof, overlaps the toner T transported to the sheet member 73 (i.e. a position projecting from the sheet member 73 to the front of the rotating direction).

Figure 27:
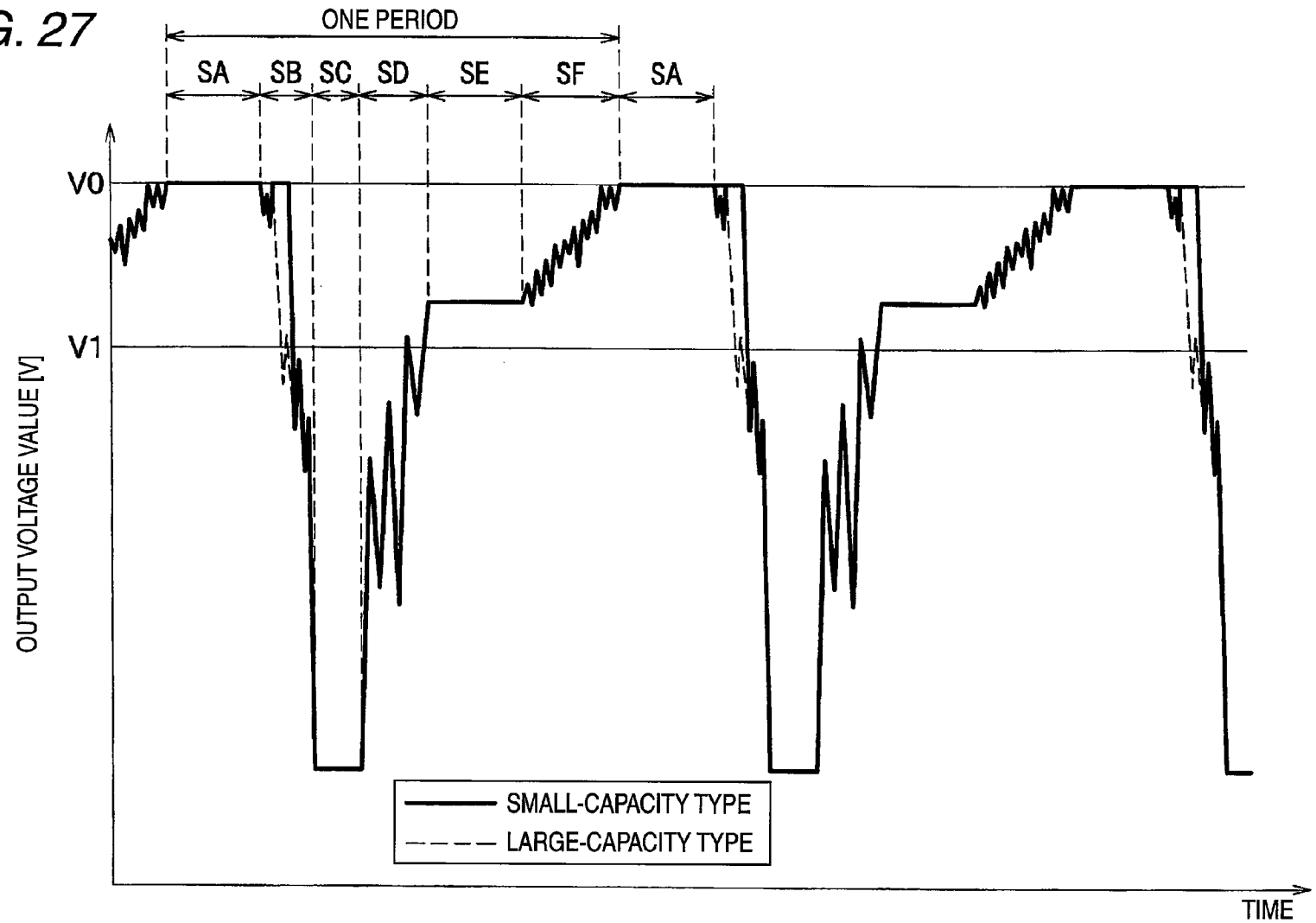
FIG. 27 is a time chart showing a light reception signal of a light receiving device in the cases illustrated in FIGS. 26A and 26B, respectively.

Accordingly, as shown in FIG. 27, in the small-capacity type developing cartridge, a waveform that is the same as that in the large-capacity type developing cartridge in the eighth illustrative embodiment, i.e. a waveform indicated by a solid line (i.e. a waveform in which the light is blocked for a predetermined time by the light shielding member 76 in the region SB) is obtained. In contrast, in the large-capacity type developing cartridge, the period in which the light is blocked by the light shielding member 76D overlaps the period (corresponding to the region SA) in which the light is blocked by the toner T transported to the sheet member 73, and thus in the region SB, unlike the small-capacity type developing cartridge, the output voltage value which is always smaller than V0 is obtained (corresponding to a zigzag waveform including the solid line and the dotted line).

Accordingly, in the large-capacity type developing cartridge, the light reception time becomes longer than that in the small-capacity type developing cartridge as large as an amount of time in which the waveform indicated by a dotted line in the region SB exceeds the light reception reference value V1. Thus, as in the illustrative embodiment as shown in FIGS. 26A and 26B, in the same manner as in the eighth illustrative embodiment, even a smaller residual amount of toner T than that in the large-capacity type developing cartridge can be used in the small-capacity type developing cartridge, and the small-capacity type developing cartridge may be replaced when the toner T contained therein reaches a proper deterioration state.

Figure 28A:
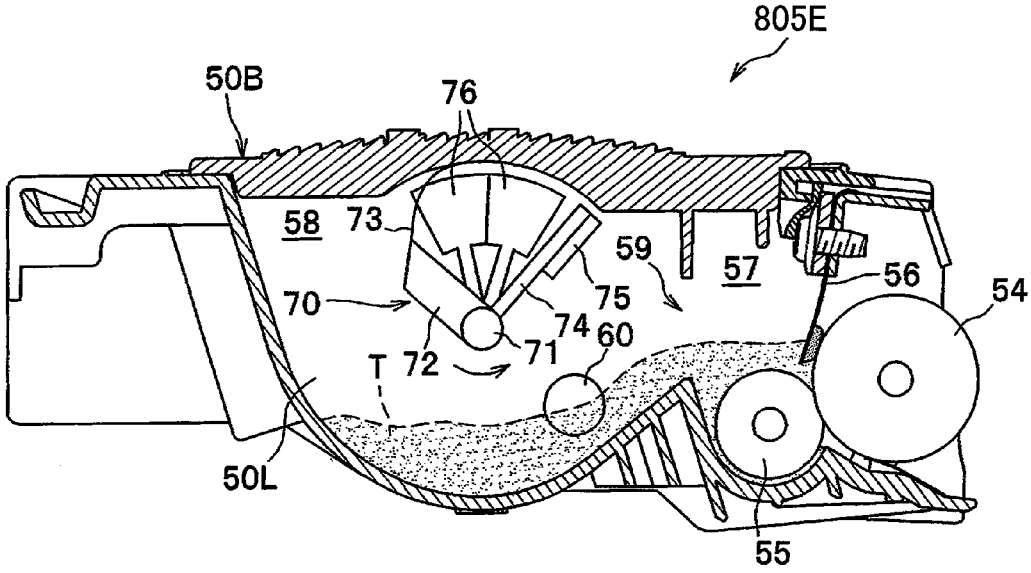
FIG. 28A is an enlarged cross-sectional view showing a state in which the number of light shielding members is changed according to the type of a developing cartridge, e.g, in a small-capacity type developing cartridge.
Figure 28B:
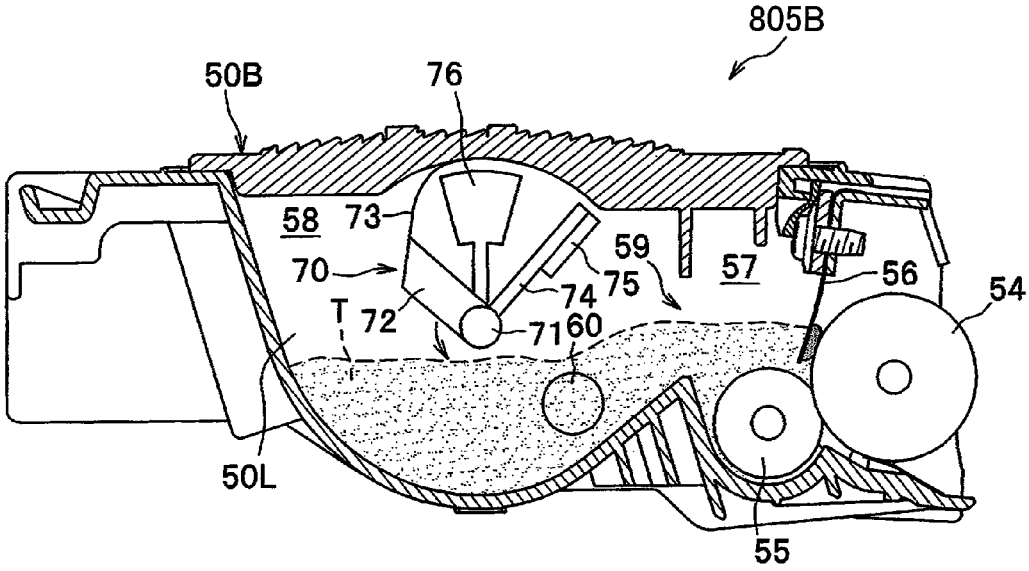
FIG. 28B is an enlarged cross-sectional view showing a state in which the number of light shielding members is changed in a large-capacity type developing cartridge.

Also, as shown in FIGS. 28A and 28B, the number of light shielding members 76 may be changed according to the type of the developing cartridge. Specifically, in the large-capacity type developing cartridge 805E as shown in FIG. 28B, in the same manner as in the eighth illustrative embodiment, only one light shielding member 76 may be provided, and in the small-capacity type developing cartridge 805E as shown in FIG. 28A, a plurality of light shielding members 76 (e.g. two light shielding members in FIG. 28A) may be provided to cross each other in the rotating direction so as to make the blocking time longer than that of the light shielding member 76 in the large-capacity type developing cartridge.

In order to manufacture the two types of developing cartridges 805B and 805E, the light shielding members 76, the number of which is larger than that in the large-capacity type developing cartridge are used in manufacturing the small-capacity type developing cartridge, As methods for changing the number of light shielding members 76, a method of properly selecting the number of light shielding members 76 to be used according to the type of the developing cartridge and fixing the light shielding members 76 to the rotating spindle 71, a method of forming an agitator 70 having a different number of light shielding members 76 by frame molds corresponding to the two types of developing cartridges, and the like, may be used.

Accordingly, by using a plurality of light shielding members 76 in the small-capacity type developing cartridge, the same effect as that in a case in which a light shielding member 76C is provided in the rotating direction as in the illustrative embodiment shown in FIG. 22B can be obtained. That is, as shown in FIG. 24, in the region SB, since the light is blocked by two light shielding members 76 in the small-capacity type developing cartridge (indicated by a solid line) for a longer time than that in the large-capacity type developing cartridge (indicated by a dotted line), the light reception time becomes shorter than that in the large-capacity type developing cartridge. Accordingly, as in the illustrative embodiment shown in FIG. 28, in the same manner as in the eighth illustrative embodiment, even a small residual amount of toner T in the small-capacity type developing cartridge can be used in comparison to the residual amount of toner T in the large-capacity type developing cartridge, and the small-capacity type developing cartridge may be replaced when the toner T contained therein reaches a proper deterioration state.

In the configuration as shown in FIGS. 28A and 28B, it is exemplified that the number of light shielding member 76 in the large-capacity type developing cartridge is set to one and the number of light shielding members 76 in the small-capacity type developing cartridge is set to two. However, the present invention is not limited thereto as long as the number of light shielding members in the small-capacity type developing cartridge being larger than that in the large-capacity type developing cartridge. For example, the number of light shielding members 76 in the large-capacity type developing cartridge may be set to zero, and the number of light shielding members 76 in the small-capacity type developing cartridge may be set to one.

Although in the illustrative embodiment as described above, a transparent light transmission window 60 is provided on a colored developing frame 50B as the light transmission part, the present invention is not limited thereto. A portion of the transparent developing frame that can transmit the light may be used as the light transmission part.

Although in the eighth illustrative embodiment, two types of developing cartridges that are mountable in the laser printer 1 are exemplified, the present invention is not limited thereto, and for example, three or more types of developing cartridges may be used.

<Ninth Illustrative Embodiment>

Next, a ninth illustrative embodiment of the present invention will be described in detail while referring to the accompanying drawings. In the following description, the same reference numerals are used for the same constituent elements as those of the above-described illustrative embodiment, and the detailed description thereof will be omitted.

In the ninth illustrative embodiment, the developing cartridge has a configuration different from that in the above-described illustrative embodiments.

Configuration of Developing Cartridge

In the ninth illustrative embodiment, a developing cartridge 905B mountable in the laser printer 1 is classified into two types which contain different initial capacities of toner. Specifically, for example, there are a large-capacity type developing cartridge for which the number of sheets that can be printed is set to 6,000 and a small-capacity type developing cartridge for which the number of sheets that can be printed is set to 3,000 and which contains an initial capacity of toner that is smaller than that of the large-capacity type developing cartridge.

Figure 29A:
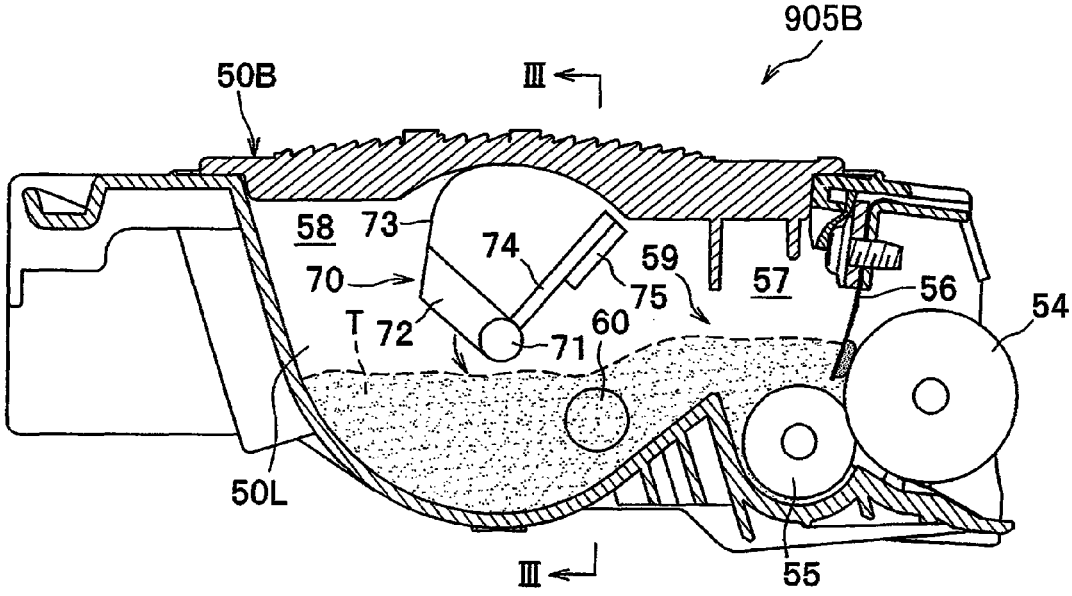
FIG. 29A is an enlarged cross-sectional view showing a large-capacity type developing cartridge.
Figure 29B:
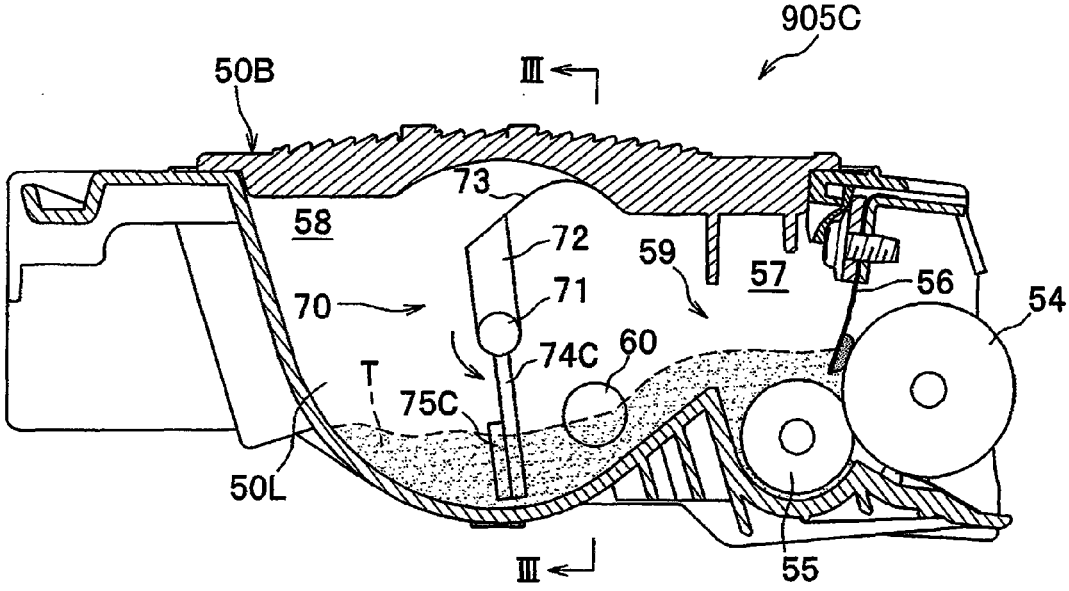
FIG. 29B is an enlarged cross-sectional view of a small-capacity type developing cartridge according to a ninth illustrative embodiment of the present invention.

Here, FIG. 29A shows a large-capacity developing cartridge 905B as an example of a second developing agent container, and FIG. 29B shows a small-capacity developing cartridge 905C as an example of a first developing agent container. In the ninth illustrative embodiment, an image forming system is configured by the two types of developing cartridges 905B and 905C and the laser printer 1 in which each of the two types of developing cartridges 905B and 905C is detachably mountable in a same position.

The respective types of developing cartridges 905B and 905C have different initial capacities of toner T contained in their toner containing chambers 58, but their basic configurations are substantially the same. However, in the ninth illustrative embodiment, a wiper 75 or 75C has different structure. Hereinafter, the structures of the respective developing cartridges 905B and 905C with common portions will be described in detail.

As illustrated in FIGS. 29A and 29B, the developing cartridge 905B or 905C is partitioned into a developing chamber 57 in which a supply roller 55, or the like, is arranged and a toner containing chamber 58 in which the toner T is accommodated by way of a developing frame 50B. The developing chamber 57 and the toner containing chamber 58 communicate with each other through a communicating part 59. This communicating part 59 is formed over the substantially entire width in an axis direction of a roller portion of the supply roller 55, and the toner T can communicate between the developing chamber 57 and the toner containing chamber 58 through the communicating part 59.

Figure 30:
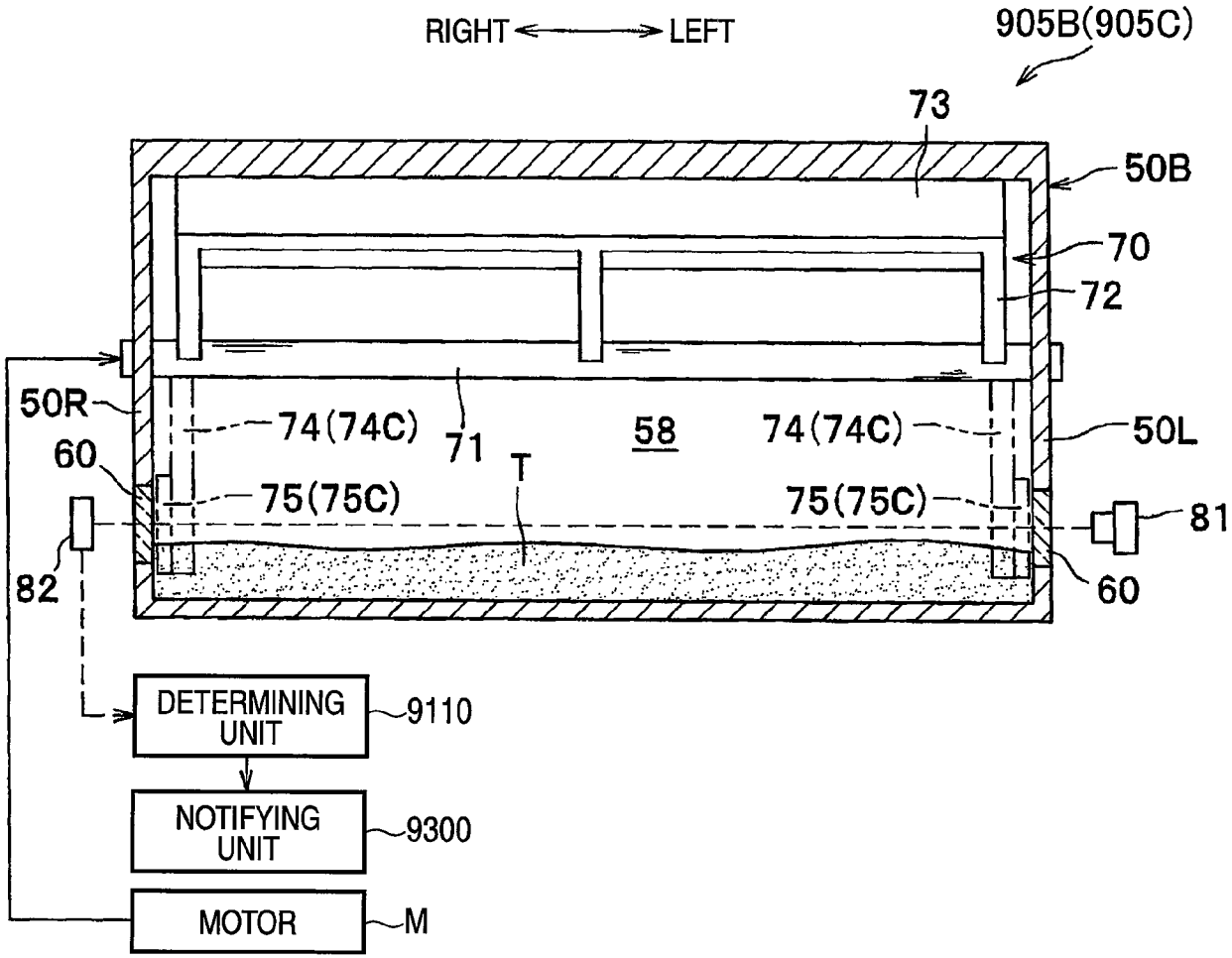
FIG. 30 is a cross-sectional view illustrating a schematic configuration of an image forming apparatus according to the ninth illustrative embodiment.

In the toner containing chamber 58, an agitator 70 that rotates to agitate the toner T is provided. Also, as illustrated in FIG. 30, on side walls 50L and 50R of the toner containing chamber 58 (i.e. developing frame 50B), which face each other, transparent light transmission windows 60 are oppositely provided in left and right directions as examples of a pair of light transmission parts.

As illustrated in FIGS. 29A and 29B, the agitator 70 is mainly provided with a rotating spindle 71, a sheet attaching unit 72, a sheet member 73 as an example of an agitating member, a wiper attaching unit 74 or 74C, and a wiper 75 or 75C as an example of a cleaning member.

The rotating spindle 71 is a shaft extending along the axis direction (i.e. left/right direction) of the developing roller 54 and the supply roller 55, and both ends of the rotating spindle 71 is rotatably supported on the side walls 50L and 50R (in FIG. 2, only one side is illustrated) of the developing frame 50B.

The sheet attaching unit 72 is formed to extend to the outside in a diameter direction from the rotating spindle 71, and its front end is fixed to the sheet member 73 by adhesion or the like.

The sheet member 73 is a flexible sheet type member which, by the rotation of the agitator 70, agitates the toner T as its front end slides across a bottom wall of the toner containing chamber 58, or the like, and transports the agitated toner T toward the developing chamber 57.

The wiper attaching unit 74 or 74C is provided in each place in the periphery of both ends in axis direction of the rotating spindle 71 (Refer to FIG. 30). The wiper attaching unit 74 in the large-capacity type developing cartridge as shown in FIG. 29A, at the rear of the rotating direction of the sheet attaching unit 72, as seen from its side, is formed in a position that is substantially perpendicular to the sheet attaching unit 72 so as to extend to the outside in the diameter direction from the rotating spindle 71. In contrast, the wiper attaching unit 74C in the small-capacity type developing cartridge as shown in FIG. 29B, at a position that is about 180° with respect to the sheet attaching unit 72, as seen from its side, is formed to extend to the outside in the diameter direction from the rotating spindle 71.

That is, the wiper attaching unit 74C or the wiper 75C in the small-capacity type developing cartridge is arranged on an upstream in the rotating direction, with respect to the sheet attaching unit 72 or the sheet member 73, in comparison to the position of the wiper attaching unit 74 or the wiper 75 in the large-capacity type developing cartridge.

In the wiper attaching unit 74 or 74C, the wiper 75 or 75C is fixed by adhesion to the outside surface in the axis direction of the rotating spindle 71.

The wiper 75 or 75C, as illustrated in FIG. 30, is a member that periodically wipes (or cleans) the toner T attached to the light transmission window 60 as it slides across the light transmission window 60, and is formed of a flexible material, such as urethane rubber, or the like. FIG. 30 shows a position in which the wiper 75 or 75C slides across the light transmission window 60.

In the case of manufacturing the small-capacity type developing cartridge in the process of manufacturing two types of developing cartridges 905B and 905C as described above, the wiper attaching unit 74C or the wiper 75C is arranged on the upstream in the rotating direction, with respect to the sheet attaching unit 72 or the sheet member 73, in comparison to the position of the wiper attaching unit 74 or the wiper 75 against the sheet attaching unit 72 or the sheet member 73 in the large-capacity type developing cartridge. Specifically, the method may be employed, which includes, while changing the position of the wiper attaching unit 74 or 74C with respect to the sheet attaching unit 72 according to the type of the developing cartridge, fixing the wiper attaching unit to the rotating spindle 71, or integrally forming the sheet attaching unit 72, the rotating spindle 71, and the wiper attaching unit 74 or 74C by frame molds corresponding to the two types of developing cartridges, and the like.

To the agitator 70 as configured above, a rotation driving force is given from the motor M provided inside the main body casing 2, rotates counterclockwise about the rotating spindle 71 in the toner containing chamber 58 to agitate and transport the toner T by way of the sheet member 73.

Configuration of Main Body Casing

As illustrated in FIG. 30, the laser printer 1 includes a light emitting device 81, a light receiving device 82, a determining unit 9110 configured to determine the replacement time of the developing cartridges 905B and 905C, and a notifying unit 9300 configured to notify a user of a message, in a main body casing 2.

The light emitting device 81 and the light receiving device 82 are oppositely arranged and interposed between a pair of light transmission windows of the developing cartridge 905B or 905C mounted in the main body casing 2. As the light emitting device 81 and the light receiving device 82, known light sensors may be adopted.

As illustrated as a dotted line FIG. 30, light emitted from the light emitting device 81 enters into the toner containing chamber 58 through one side light transmission window 60, and is received in the light receiving device 82 through the other side light transmission window 60. The light receiving device 82 is a device of which the output voltage value is changed depending upon the intensity of the received light, and outputs a light reception signal as shown in FIG. 31 to the determining unit 9110.

Here, the light reception signal will be described with reference to FIGS. 31, 32A to 32D and 33A to 33D. In the ninth illustrative embodiment, the light receiving device 82 is adopted such that when the intensity of the received light is minimum, the output voltage value becomes maximum, while when the intensity of the received light is maximum, the output voltage value becomes minimum. Accordingly, as shown in FIG. 30, as the output voltage value is larger, the intensity of the received light is lower, while as the output voltage value is smaller, the intensity of the received light is higher. In this case, V0 denotes the output voltage value when the light receiving device 82 receives no light (i.e. the output voltage value when the intensity of the received light is minimum). Also, the waveform, as shown in FIG. 30 represents the waveform when the residual amount of toner inside the development cartridge 905B or 905C is relatively decreased.

Figure 31:
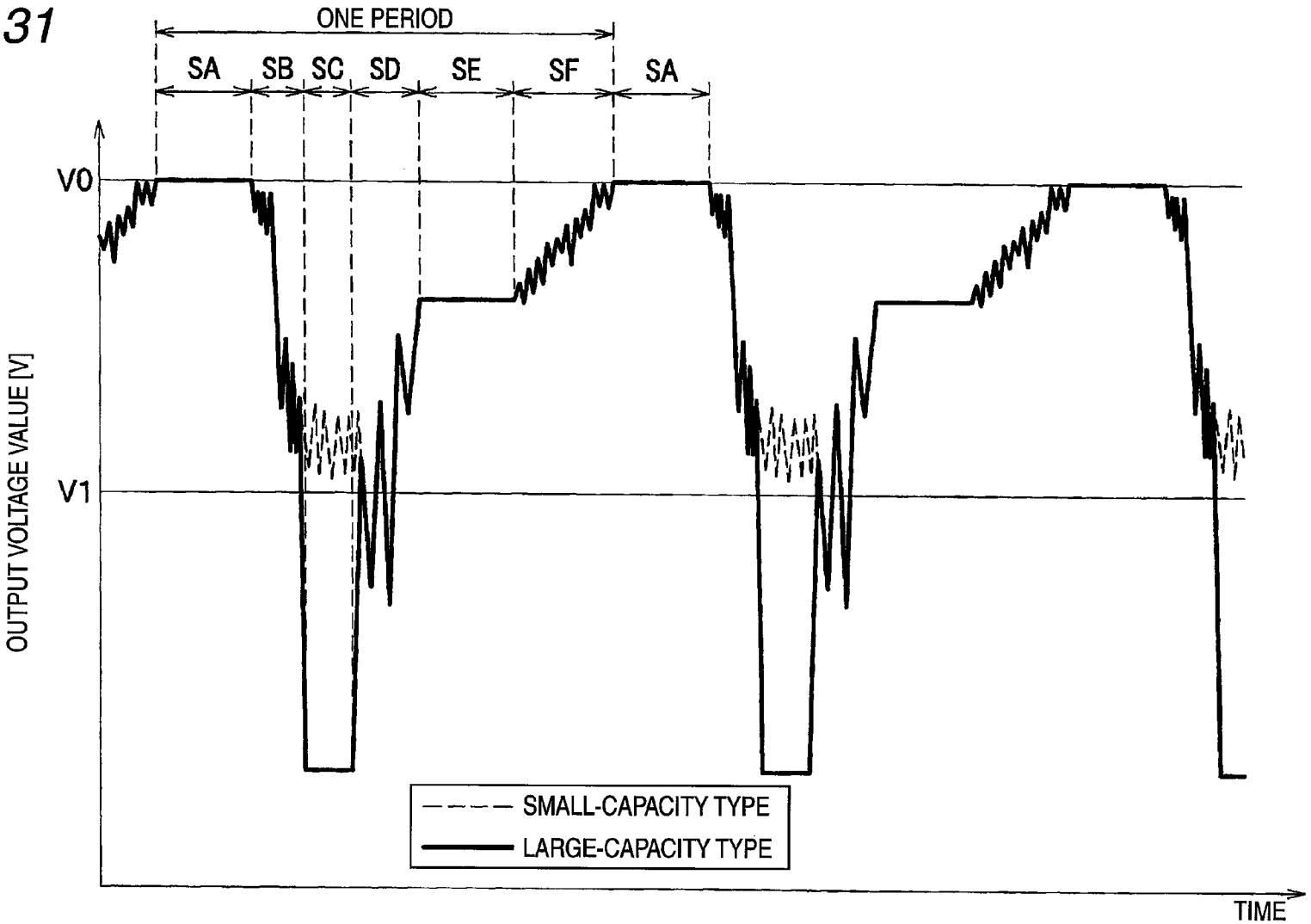
FIG. 31 is a time chart showing a light reception signal of a light receiving device according to the ninth illustrative embodiment.
Figure 32A:
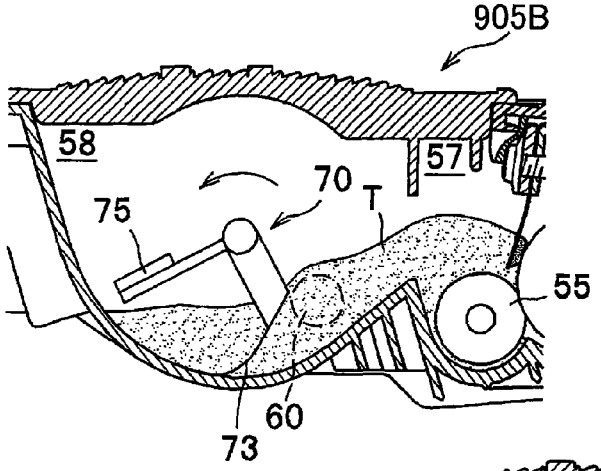
FIGS. 32A, 32B, 32C and 32D are cross-sectional views for explaining the operation of a large-capacity type agitator and movement of toner according to the ninth illustrative embodiment.

In the large-capacity type developing cartridge 905B, as shown in FIG. 32A, in a process in which the sheet member 73, by the rotation of the agitator 70, gathers and transports the toner T to the side of the developing chamber 57 as the sheet member 73 slides across the bottom surface of the toner containing chamber 58, if the gathered toner T completely covers the light transmission window 60, the light receiving device 82 is in a state in which the light receiving device 82 hardly receives the light, and thus the output voltage value becomes a maximum value V0 (corresponding to a region SA in FIG. 31).

Figure 32B:
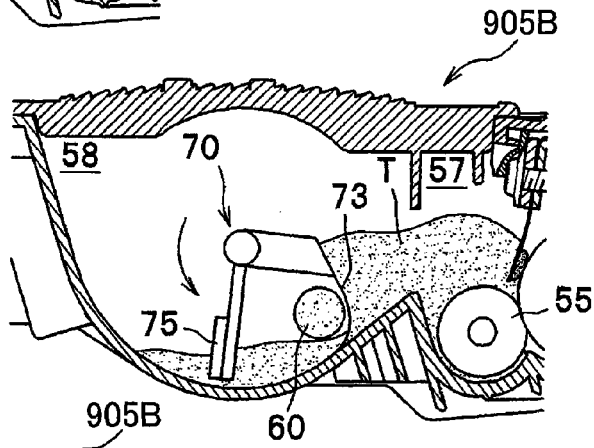

As shown in FIG. 32B, if the sheet member 73 passes between the pair of light transmission windows 60 by the rotation of the agitator 70, the amount of toner T between the pair of light transmission windows 60 is abruptly decreased due to the transport of the toner by the sheet member 73, and thus the intensity of the light that is received in the light receiving device 82 is heightened. Accordingly, the output voltage value is decreased (in region SB).

At the time point of the regions SB, the toner T is attached to the light transmission window 60. However, as illustrated in FIG. 32C, as the toner T attached to the light transmission window 60 is wiped by the wiper 75 as shown in FIG. 32C, the intensity of the light that is received in the light receiving device 82 becomes maximum, and thus the output voltage value becomes minimum (corresponding to a region SC).

Figure 32C:
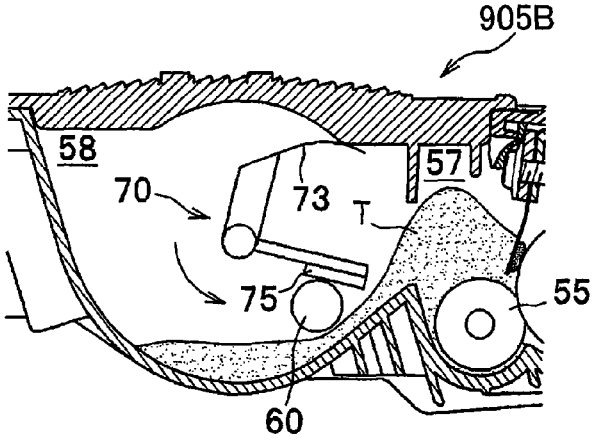
Figure 32D:
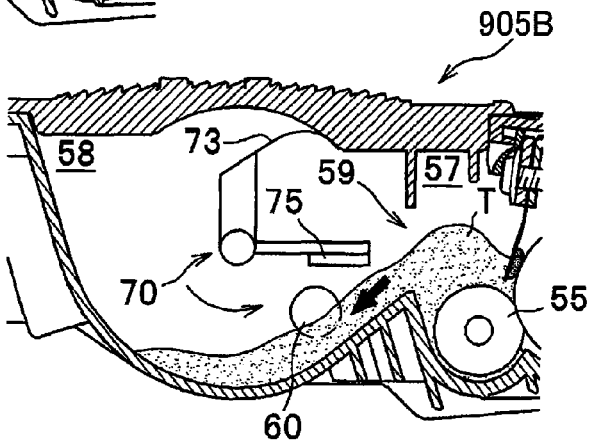

Although in the process as shown in FIGS. 32A to 32C, the toner T is accumulated in the developing chamber 57, a part of the toner T crumbles as shown in FIG. 32D, and thus the toner T flows into the toner containing chamber 58 through the communicating part 59. As the toner T having flowed into the toner containing chamber 58 covers at least a part of the light transmission window 60, the intensity of the light received in the light receiving device 82 is lowered to cause the output voltage value to become large (corresponding to a region SD).

Thereafter, as shown in FIG. 29A, while the sheet member 73 slides across an upper wall or a front wall of the toner containing chamber 58, the amount of movement of the toner T in the periphery of the light transmission window 60 becomes small, and thus the output voltage value is shifted to a substantially constant level (corresponding to a region SE). Also, as the sheet member 73 pushes into the toner T accumulated on the bottom wall of the toner containing chamber 58, gradually gathers and transports the toner T to the side of the developing chamber 57 as the sheet member 73 slides across the bottom wall of the toner containing chamber 58, the light transmission window 60 is gradually covered with the toner T, and thus the output voltage value becomes larger (corresponding to a region SF). Once the light transmission window 60 is completely covered, the output voltage value becomes maximum (corresponding to the region SA).

Figure 33A:
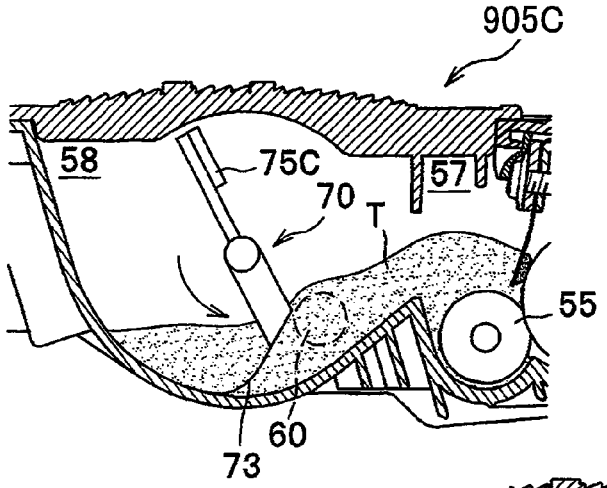
FIGS. 33A, 33B, 33C and 33D are cross-sectional views for explaining the operation of a small-capacity type agitator and movement of toner according to the ninth illustrative embodiment.
Figure 33B:
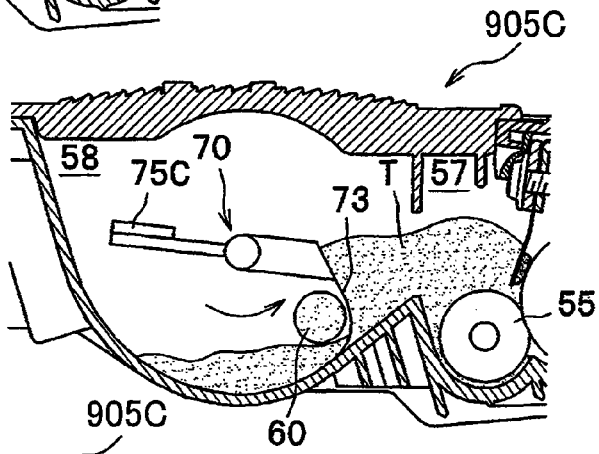
Figure 33C:
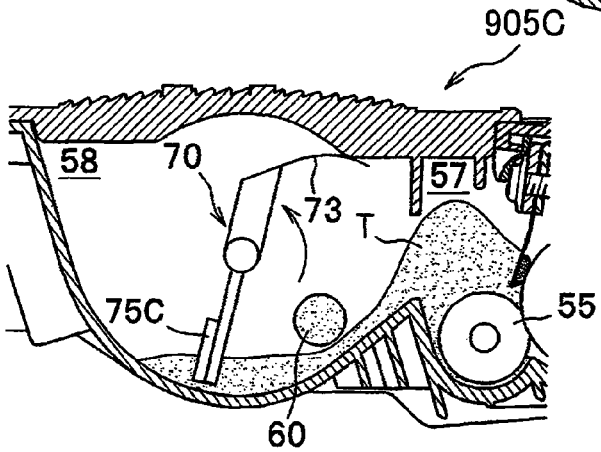
Figure 33D:
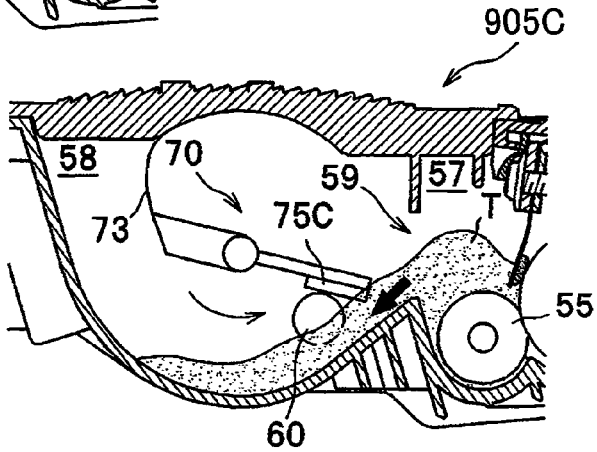

In contrast, in the small-capacity type developing cartridge 905C, as shown in FIGS. 33A and 33B, after the sheet member 73 passes through the light transmission window 60, the position of the wiper 75C with respect to the sheet member 73 is determined so that the wiper 75C is positioned on the upstream in the rotating direction in comparison to the position of the wiper in the large-capacity type developing cartridge, and thus, as shown in FIGS. 33C and 33D, the light transmission window 60 is late wiped by the wiper 75C in comparison to the wiping of the light transmission window in the large-capacity type developing cartridge. Accordingly, the waveform of the light reception signal in the small-capacity type developing cartridge differs from that in the large-capacity type developing cartridge in region SC as shown in FIG. 31.

Specifically, as shown in FIG. 32C, in the large-capacity type developing cartridge, the optical transmission window 60 is wiped by the wiper 75, and the output voltage value (indicated by a solid line) in the region SC becomes minimum. However, in the same temporal conditions, in the small-capacity type developing cartridge, the wiper 75C has not yet reached the light transmission window 60 as shown in FIG. 33C. Accordingly, the toner T is kept attached to the light transmission window 60, and thus in the small-capacity type developing cartridge, as indicated by a dotted lined in FIG. 31, the output voltage value in the region SC is kept higher than the minimum value.

Thereafter, as shown in FIG. 33D, even though the light transmission window 60 has been wiped by the wiper 75C, the light transmission window 60 is gradually choked up with the toner T that is returning from the developing chamber 57. Accordingly, as shown in FIG. 31, the output voltage value approaches the minimum value, but thereafter is gradually increased (corresponding to the region SD).

As shown in FIG. 30, the determining unit 9110 is provided with a CPU, a RAM, a ROM, an input/output circuit, and the like (not illustrated). The determining unit 9110 determines the replacement time of the developing cartridge 905B or 905C on the basis of a program or data stored in the ROM, outputs from the light receiving device 82, and the like.

The basic flow of the replacement time determination will be briefly described. As shown in FIG. 31, in a predetermined time including one or plural periods (e.g. one period is a time required for one rotation of the agitator 70), the determining unit 9110 calculates the time during which the output voltage value exceeds a preset light reception reference value V1 (i.e. in FIG. 31, the time during which the output voltage value is lower than the reference value V1). Here, the time during which the output voltage value exceeds the preset light reception reference value V1 means the time when the light with the intensity of equal to or larger than a predetermined value is received, and hereinafter, for convenience, it is called a "light reception time". Then, the determining unit 9110 calculates the ratio of the light reception time to the predetermined time. Then, the determining unit 9110 compares the calculated time ratio with a preset determination threshold value, and if the calculated ratio exceeds the determination threshold value, the determining unit 9110 determines that the replacement time of the developing cartridge 905B or 905C has been reached.

In this case, the method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time, and whether the output voltage value (i.e. respective sampling point) every predetermined time exceeds the light reception reference value may be determined. In this case, the ratio of sampling points that exceed the determination reference value to the entire sampling points may be calculated, and the replacement time may be determined depending upon whether the ratio exceeds the determination threshold value.

The notifying unit 9300 notifies a user who operates the laser printer 1 of a message. In the ninth illustrative embodiment of the present invention, when the determining unit 9110 determines that the replacement time of the developing cartridge 905B or 905C has been reached, the notifying unit 9300 notifies a user of the message to the corresponding effect. The notifying unit 9300 may adopt, for example, a liquid crystal display notifying the message as text, picture, and the like, a speaker notifying the message as sound, a lamp notifying the message by flickering light, or the like. Also, the notifying unit 9300 may adopt a combination of two or more of the liquid crystal display, the speaker, the lamp, and the like.

Method of Determining Replacement Time of Developing Cartridge

Next, a method of determining a replacement time of the developing cartridge according to the ninth illustrative embodiment will be described.

When a large-capacity type developing cartridge 905B in which a predetermined amount of toner T remains is mounted, as shown in FIG. 31, waveforms of the output voltage value which is indicated as a solid line in respective regions are obtained. In contrast, when a small-capacity type developing cartridge 905C in which a predetermined amount of toner T remains is mounted, as shown in FIG. 31, waveforms of the output voltage value which is indicated as a dotted line in the region SC are obtained.

Accordingly, in the large-capacity type developing cartridge, a time when the output voltage value exceeds the light reception reference value V1 occurs in the regions SC, while in the small-capacity type developing cartridge, the output voltage value does not exceed the light reception reference value V1 in the region SC. That is, the light reception time (i.e. the time when the light output value exceeds the light reception reference value V1) is shortened when the small-capacity type developing cartridge 905C in which a predetermined amount of toner T remains is mounted in the laser printer 1 rather than when the large-capacity type developing cartridge 905B in which the same predetermined amount of toner T remains is mounted in the laser printer 1.

Accordingly, the ratio of the light reception time to a predetermined time (e.g. 13/100) may exceed the determination threshold value (e.g. 12%) when a predetermined residual amount of toner T remains in the large-capacity type developing cartridge 905B, whereas the ratio of the light reception time to the predetermined time (e.g. 11/100) may not exceed the determination threshold value even though a predetermined residual amount of toner T remains in the small-capacity type developing cartridge 905C.

As a result, the determining unit 9110 determines that the replacement time has been reached when the predetermined amount of toner T remains in the large-capacity type developing cartridge 905B, whereas the determining unit 9110 determines that the replacement time has been reached when a specified amount of toner T, which is smaller than the predetermined amount of toner T, remains in the small-capacity type developing cartridge 905C. Accordingly, it is possible to use the small-capacity type developing cartridge 905C until the toner T remaining therein, which could not be efficiently used in the related art, reaches a proper deterioration state.

Also, in the ninth illustrative embodiment, the toner T in the small-capacity type developing cartridge can be efficiently used, and thus it is possible to increase the number of sheets that can be printed with respect to the small-capacity type developing cartridge. Also, it is possible to reduce the amount of toner T contained in the small-capacity type developing cartridge (i.e. the initial capacity of toner T) as the number of sheets that can be printed is kept, for example, 3,000.

Although the ninth illustrative embodiment has been described, the present invention is not limited to the ninth illustrative embodiment. The detailed configuration of the present invention may be properly modified without deviating from the scope of the present invention.

Although in the ninth illustrative embodiment, two types of developing cartridges that are mountable in the laser printer 1 are exemplified, the present invention is not limited thereto, and for example, three or more types of developing cartridges may be used.

Although in the ninth illustrative embodiment, a transparent light transmission window 60 is provided on a colored developing frame 50B as the light transmission part, the present invention is not limited thereto, and a portion of the transparent developing frame that can transmit the light may be used as the light transmission part.

<Tenth Illustrative Embodiment>

Next, a tenth illustrative embodiment of the present invention will be described in detail while referring to the accompanying drawings. In the following description, the same numerals are used for the same constituent elements as those of the above-described illustrative embodiment, and the detailed description thereof will be omitted.

In the tenth illustrative embodiment, the developing cartridge has a configuration different from that in the above-described illustrative embodiment.

Configuration of Developing Cartridge

In the tenth illustrative embodiment, a developing cartridge 1005B mountable in the laser printer 1 is classified into two types which contain different initial capacities of toner. Specifically, for example, there are a large-capacity type developing cartridge for which the number of sheets that can be printed is set to 6,000 and a small-capacity type developing cartridge for which the number of sheets that can be printed is set to 3,000 and which contains an initial capacity of toner that is smaller than that of the large-capacity type developing cartridge.

Figure 34A:
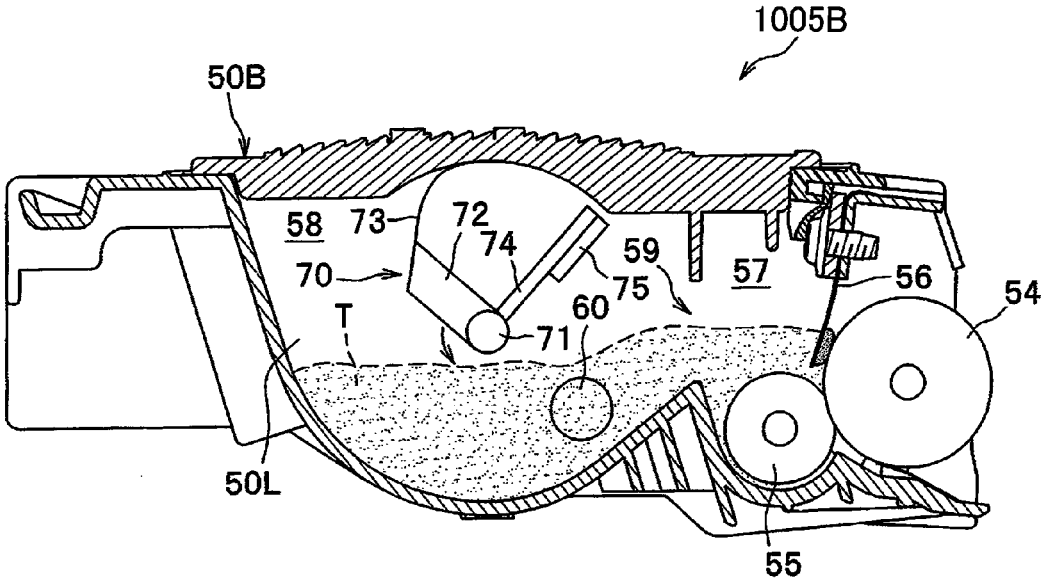
FIG. 34A is an enlarged cross-sectional view showing a large-capacity type developing cartridge.
Figure 34B:
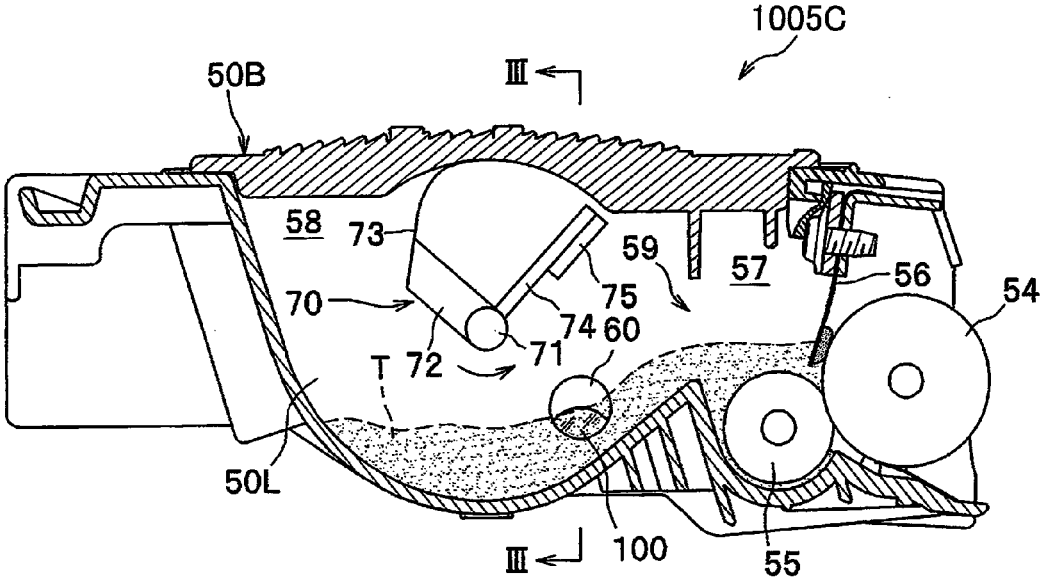
FIG. 34B is an enlarged cross-sectional view of a small-capacity type developing cartridge according to a tenth illustrative embodiment.

Here, FIG. 34A shows a large-capacity developing cartridge 1005B as an example of a second developing agent container, and FIG. 34B shows a small-capacity developing cartridge 1005C as an example of a first developing agent container. In this illustrative embodiment, an image forming system is configured by the two types of developing cartridges 1005B and 1005C and the laser printer 1 in which each of the two types of developing cartridges 1005B and 1005C is detachably mountable in a same position.

The respective types of developing cartridges 1005B and 10050 have different initial capacities of toner T contained in their toner containing chambers 58, but their basic configurations are substantially the same. However, in the tenth illustrative embodiment, a portion in the periphery of the light transmission window 60 that is an example of a light transmission part to be described later has a different structure. Hereinafter, the structures of the respective developing cartridges 1005B and 1005C with common portions will be described in detail.

Specifically, as illustrated in FIGS. 34A and 34B, the developing cartridge 1005B or 1005C is partitioned into a developing chamber 57 in which a supply roller 55, or the like, is arranged and a toner containing chamber 58 in which the toner T is accommodated by way of a developing frame 50B. The developing chamber 57 and the toner containing chamber 58 communicate with each other through a communicating part 59. This communicating part 59 is formed over the substantially entire width in an axis direction of a roller portion of the supply roller 55, and the toner T can come and go between the developing chamber 57 and the toner containing chamber 58 through the communicating part 59.

In the toner containing chamber 58, an agitator 70 that rotates to agitate the toner T is provided. Also, as illustrated in FIG. 35A, on side walls 50L and 50R, which face each other, of the toner containing chamber 58 (i.e. developing frame 50B), a pair of transparent light transmission windows 60 are oppositely provided in left and right directions.

Figure 35B:
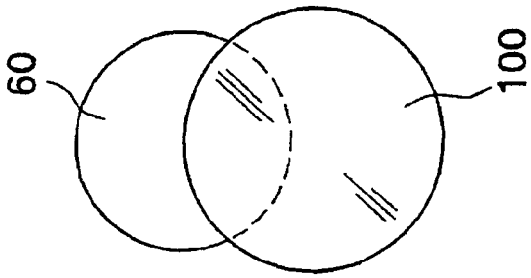
FIG. 35B is a side view illustrating a light shielding plate.
Figure 35A:
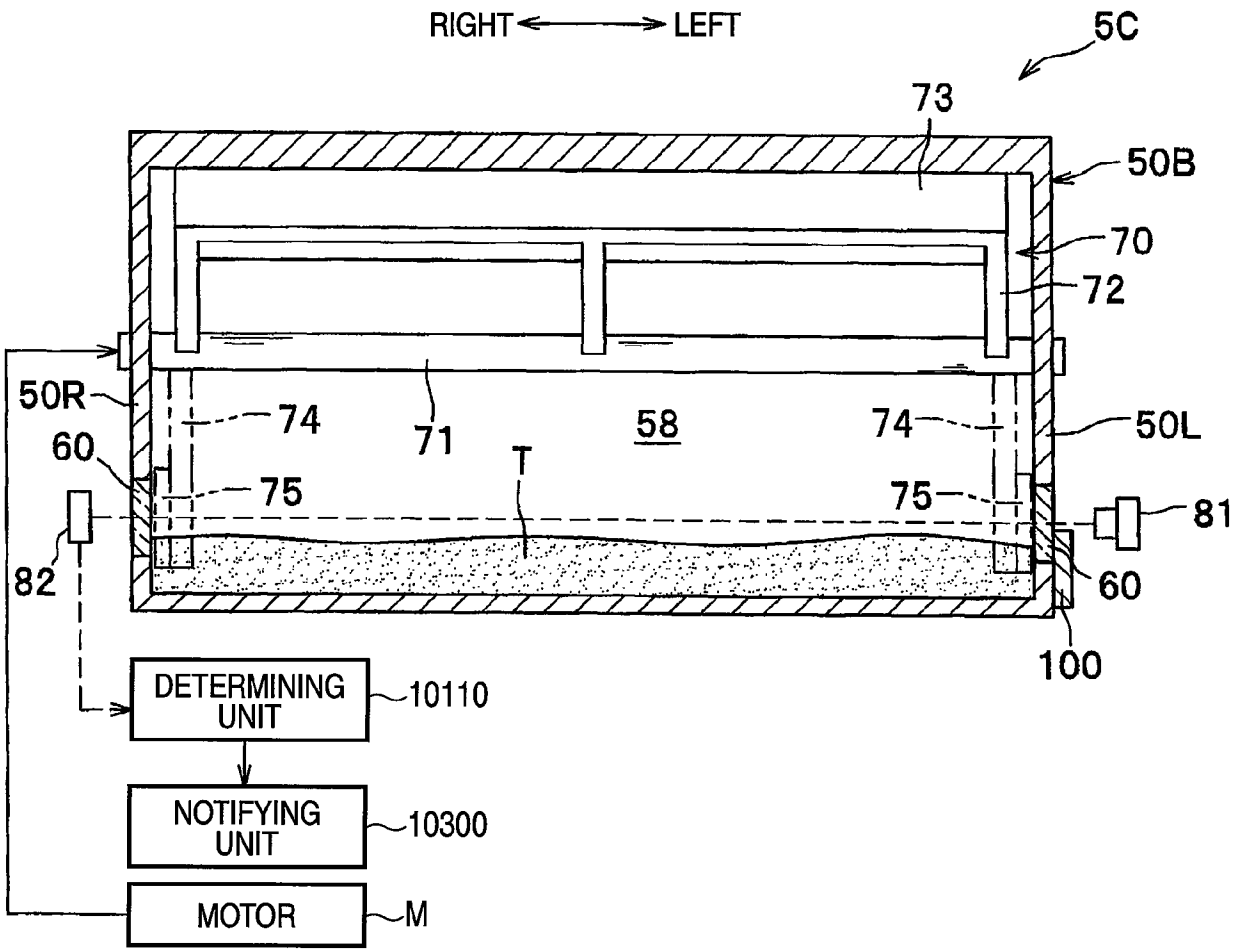
FIG. 35A is a cross-sectional view illustrating a schematic configuration of an image forming apparatus according to the tenth illustrative embodiment.

Also, on an outer surface of the light transmission window 60 of one side of the small-capacity type developing cartridge 1005C as shown in FIG. 35A, a light shielding plate 100 is provided as an example of a light shielding part which is not provided in the large-capacity type developing cartridge 1005B. This light shielding plate 100, as shown in FIG. 35B, is provided to overlap roughly a lower half portion (i.e. a part) of the light transmission window 60, as seen from a proceeding direction of the light that passes through the light transmission window 60. Accordingly, in the small-capacity type developing cartridge 1005C, a part of the light that passes through the light transmission window 60 is blocked by the light shielding plate 100, and thus the area of the light that is received in the light receiving device 82 to be described later becomes smaller than that when the large-capacity type developing cartridge is mounted.

For manufacturing the above-described two types of developing cartridges 1005B and 1005C, only in the case of manufacturing the small-capacity type developing cartridge, the light shielding plate 100 is attached to a side surface of the developing cartridge 1005C so that the light shielding plate 100 overlaps a part of the light transmission window 60.

As illustrated in FIGS. 34A and 34B, the agitator 70 is mainly provided with a rotating spindle 71, a sheet attaching unit 72, a sheet member 73, a wiper attaching unit 74, and a wiper 75 as an example of a cleaning member.

The rotating spindle 71 is a shaft extending along the axis direction (i.e. left/right direction) of the developing roller 54 and the supply roller 55, and both ends of the rotating spindle 71 is rotatably supported on the side walls 501, and 50R (in FIG. 2, only one side is illustrated) of the developing frame 50B.

The sheet attaching unit 72 is formed to extend to the outside in a diameter direction from the rotating spindle 71, and its front end is fixed to the sheet member 73 by adhesion or the like.

The sheet member 73 is a flexible sheet type member which, by the rotation of the agitator 70, agitates the toner T as its front end slides across a bottom wall of the toner containing chamber 58, or the like, and transports the agitated toner T toward the developing chamber 57.

The wiper attaching unit 74 is provided in each place in the periphery of both ends in axis direction of the rotating spindle 71 (Refer to FIG. 35A). The wiper attaching unit 74 is formed, as seen from the side thereof, in a position that is substantially perpendicular to the sheet attaching unit 72, in the rear of the rotating direction of the sheet attaching unit 72, so as to extend to the outside in the diameter direction from the rotating spindle 71. Also, in the wiper attaching unit 74, the wiper 75 is fixed by adhesion to the outside surface of the axis direction of the rotating spindle 71.

The wiper 75, as illustrated in FIG. 35A, is a member that wipes (or cleans) the toner T attached to the light transmission window 60 as it slides across the light transmission window 60, and is formed of a flexible material, such as urethane rubber, or the like, FIG. 35A shows a position in which the wiper 75 slides across the light transmission window 60.

To the agitator 70 as configured above, a rotation driving force is given from the motor M provided inside the main body casing 2, rotates counterclockwise about the rotating spindle 71 in the toner containing chamber 58, as shown in FIG. 2, to agitate and transport the toner T by way of the sheet member 73.

Configuration of Main Body Casing

As illustrated in FIG. 35A, the laser printer 1 includes a light emitting device 81, a light receiving device 82, a determining unit 10110 configured to determine the replacement time of the developing cartridges 1005B and 1005C, and a notifying unit 10300 configured to notify a user of a message, in a main body casing 2.

The light emitting device 81 and the light receiving device 82 are oppositely arranged and interposed between a pair of light transmission windows 60 of the developing cartridge 1005B or 1005C mounted in the main body casing 2. As the light emitting device 81 and the light receiving device 82, known light sensors may be adopted.

As illustrated as a dotted line FIG. 35A, light emitted from the light emitting device 81 enters into the toner containing chamber 58 through one side light transmission window 60, and is received in the light receiving device 82 through the other side light transmission window 60. The light receiving device 82 is a device of which the output voltage value is changed depending upon the intensity of the received light, and outputs a light reception signal as shown in FIG. 36 to the determining unit 10110.

Here, the light reception signal will be described with reference to FIGS. 36 and 37A to 37D. In the tenth illustrative embodiment, the light receiving device 82 is adopted such that when the intensity of the received light is minimum, the output voltage value becomes maximum, while when the intensity of the received light is maximum, the output voltage value becomes minimum. Accordingly, as shown in FIG. 36, as the output voltage value is larger, the intensity of the received light is lower, while as the output voltage value is smaller, the intensity of the received light is higher. In this case, V0 denotes the output voltage value when the light receiving device 82 receives no light (i.e. the output voltage value when the intensity of the received light is minimum). Also, the waveform as shown in FIG. 36 represents the waveform when the residual amount of toner in the development cartridge 1005B or 1005C is relatively decreased.

Figure 36:
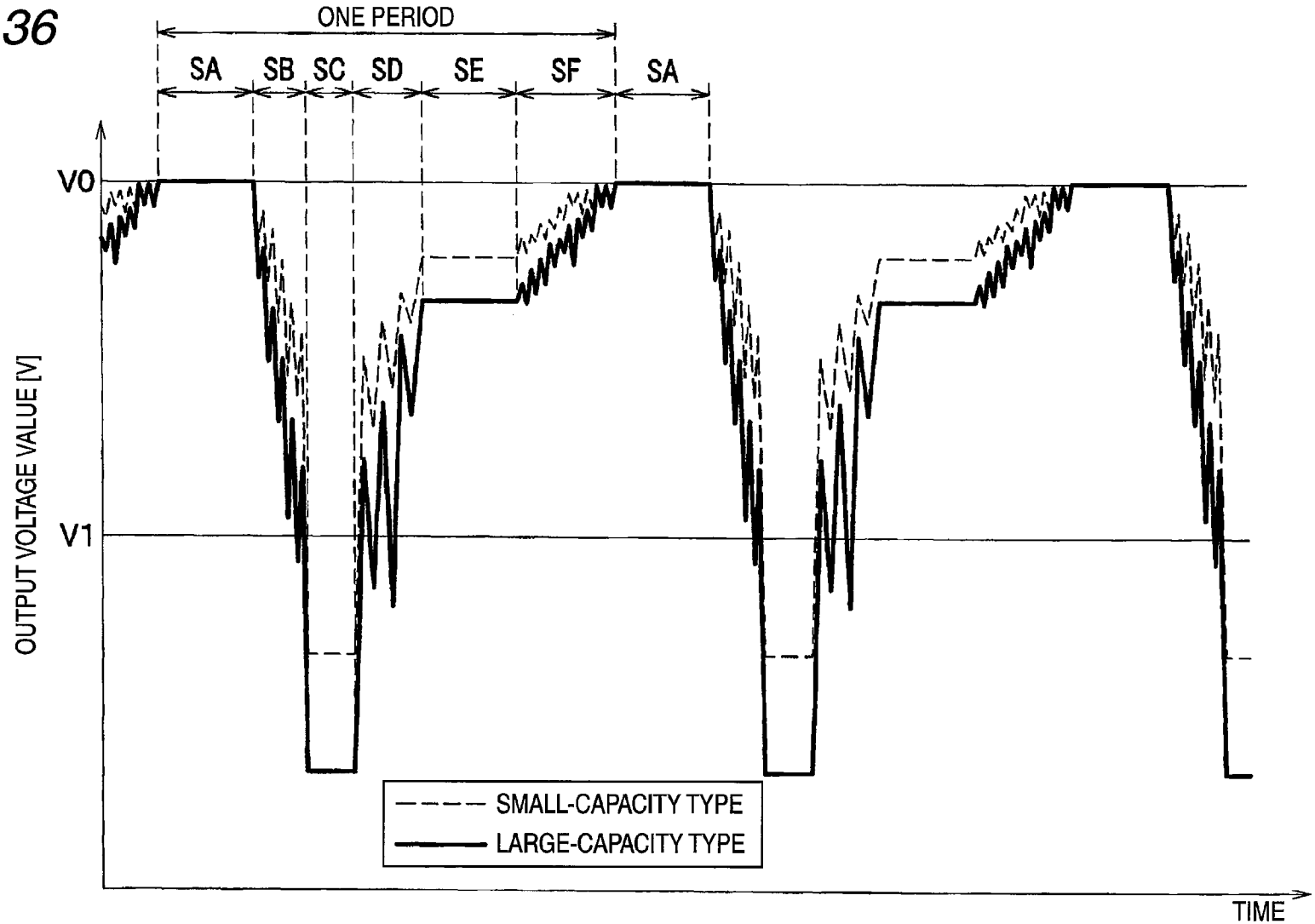
FIG. 36 is a time chart showing a light reception signal of a light receiving device according to the tenth illustrative embodiment.
Figure 37A:
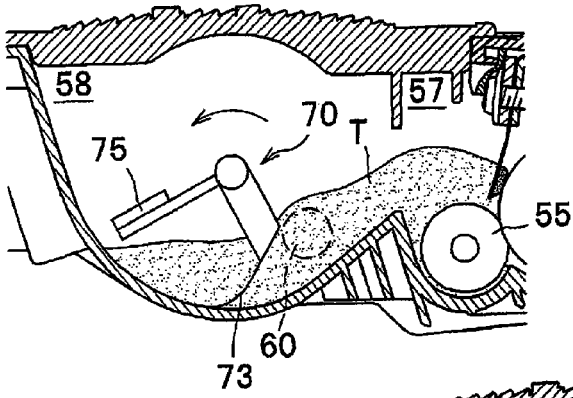
FIGS. 37A, 37B, 37C and 37D are cross-sectional views for explaining the operation of an agitator and movement of toner according to the tenth illustrative embodiment.

As shown in FIG. 37A, in a process in which the sheet member 73, by the rotation of the agitator 70, gathers and transports the toner T to the side of the developing chamber 57 as the sheet member 73 slides across the bottom surface of the toner containing chamber 58, if the gathered toner T completely covers the light transmission window 60, the light receiving device 82 is in a state in which the light receiving device 82 hardly receives the light, and thus the output voltage value becomes a maximum value V0 (corresponding to a region SA in FIG. 36).

Figure 37B:
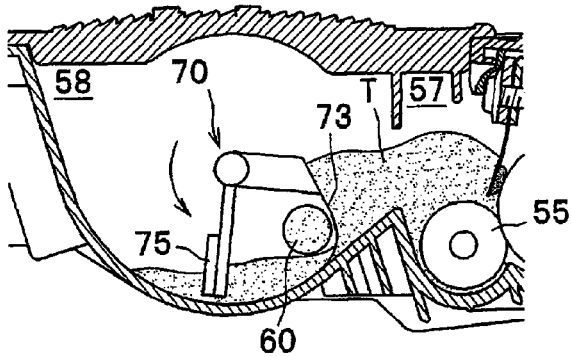

As shown in FIG. 37B, if the sheet member 73 passes between the pair of light transmission windows 60 by the rotation of the agitator 70, the amount of toner T between the pair of light transmission windows 60 is decreased due to the transport of the toner by the sheet member 73, and thus the intensity of the light that is received in the light receiving device 82 is heightened. Accordingly, the output voltage value is decreased (in a region SB). Here, in the region SB, the light transmission window 60 has not been wiped by the wiper 75 (i.e. the toner T is attached to the light transmission window 60), and thus the light has an intensity that is weaker than the maximum value.

Figure 37C:
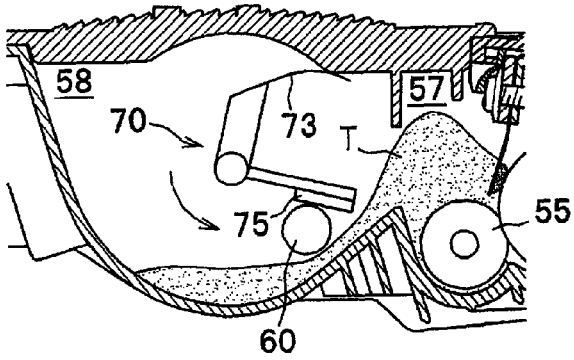

As shown in FIG. 37C, if the toner T attached to the light transmission window 60 is wiped by the wiper 75, as shown in FIG. 36, the intensity of the light that is received in the light receiving device 82 becomes maximum, and thus the output voltage value becomes minimum (corresponding to a region SC).

Figure 37D:
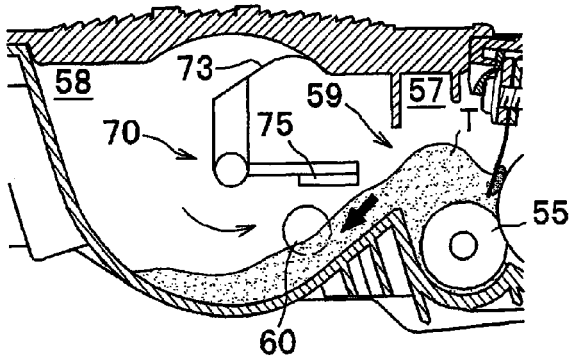

In the process as shown in FIGS. 37A to 37C, the toner T is accumulated in the developing chamber 57. However, as shown in FIG. 37D, since a part of the toner T crumbles, the toner T flows into the toner containing chamber 58 through the communicating part 59. As the toner T having flowed into the toner containing chamber 58 covers at least a part of the light transmission window 60, the intensity of the light received in the light receiving device 82 is lowered to cause the output voltage value to become large (corresponding to a region SD).

Thereafter, as shown in FIG. 34, while the sheet member 73 slides across an upper wall or a front wall of the toner containing chamber 58, the amount of movement of the toner T in the periphery of the light transmission window 60 becomes small, and thus the output voltage value is shifted to a substantially constant level (corresponding to a region SE). Also, as the sheet member 73 pushes into the toner T accumulated on the bottom wall of the toner containing chamber 58, gradually gathers and transports the toner T to the side of the developing chamber 57 as the sheet member 73 slides across the bottom wall of the toner containing chamber 58, the light transmission window 60 is gradually covered with the toner T, and thus the output voltage value becomes larger (corresponding to a region SF). Once the light transmission window 60 is completely covered, the output voltage value becomes maximum (corresponding to the region SA).

As shown in FIG. 35, the determining unit 10110 is provided with a CPU, a RAM, a ROM, an input/output circuit, and the like (not illustrated). The determining unit 10110 determines the replacement time of the developing cartridge 1005B or 1005C on the basis of a program or data stored in the ROM, outputs from the light receiving device 82, and the like.

The basic flow of the replacement time determination will be briefly described. As shown in FIG. 36, in a predetermined time including one or plural periods (e.g. one period is a time required for one rotation of the agitator 70), the determining unit 10110 calculates the time during which the output voltage value exceeds a preset light reception reference value V1 (i.e. in FIG. 36, the time during which the output voltage value is lower than the reference value V1). Here, the time during which the output voltage value exceeds the preset light reception reference value V1 means the time when the light with the intensity of equal to or larger than a predetermined value is received, and hereinafter, for convenience, it is called a "light reception time". Then, the determining unit 10110 calculates the ratio of the light reception time to the predetermined time. Then, the determining unit 9110 compares the calculated time ratio with a preset determination threshold value, and if the calculated ratio exceeds the determination threshold value, the determining unit 10110 determines that the replacement time of the developing cartridge 1005B or 1005C has been reached.

In this case, the method of determining whether the output voltage value exceeds the light reception reference value V1 is not specially restricted. For example, the light reception signal in the predetermined time may be divided into very short times, and whether the output voltage value exceeds the light reception reference value V1 may be determined every time unit. Also, whether the output voltage value exceeds the light reception reference value V1 may be determined by successively monitoring the light reception signal within the predetermined time. Also, the output voltage value may be acquired (i.e. sampled) every predetermined time, for example, as a point, from the light reception signal within the predetermined time, and whether the output voltage value (i.e. respective sampling point) every predetermined time exceeds the light reception reference value may be determined. In this case, the ratio of sampling points that exceed the determination reference value to the entire sampling points may be calculated, and the replacement time may be determined depending upon whether the ratio exceeds the determination threshold value.

The notifying unit 10300 notifies a user who operates the laser printer 1 of a message. In this illustrative embodiment of the present invention, when the determining unit 10110 determines that the replacement time of the developing cartridge 1005B or 1005C has been reached, the notifying unit 10300 notifies a user of the message to the corresponding effect. The notifying unit 10300 may adopt, for example, a liquid crystal display notifying the message as text, picture, and the like, a speaker notifying the message as sound, a lamp notifying the message by flickering light, or the like. Also, the notifying unit may adopt a combination of two or more of the liquid crystal display, the speaker, the lamp, and the like.

Method of Determining Replacement Time of Developing Cartridge

Next, a method of determining a replacement time of the developing cartridge will be described.

When a large-capacity type developing cartridge 1005B in which a predetermined amount of toner T remains is mounted in the laser printer 1, waveforms of the output voltage value which is indicated as a solid line in FIG. 36 are obtained. In contrast, when a small-capacity type developing cartridge 1005C in which a predetermined amount of toner T remains is mounted in the laser printer 1, a part of the light is blocked by the light shielding plate 100, and thus as shown in FIG. 36, waveforms of the output voltage value which is closer to V0 (i.e. waveforms indicating that the light intensity is low: a dotted line) are obtained in comparison to the waveforms of the output voltage value (indicated as a solid line) corresponding to the large-capacity type developing cartridge.

That is, the light intensity is lowered when the small-capacity type developing cartridge 1005C in which a predetermined amount of toner T remains is mounted in the laser printer 1, rather than when the large-capacity type developing cartridge 1005B in which the same predetermined amount of toner T remains is mounted in the laser printer 1.

Accordingly, in the large-capacity type developing cartridge, a time when the output voltage value exceeds the light reception reference value V1 occurs even in the regions SB and SD in addition to the region SC, while in the small-capacity type developing cartridge, the output voltage value exceeds the light reception reference value V1 only in the region SC, but does not exceed the light reception reference value V1 in the regions SB and SD. Accordingly, the light reception time (i.e. the time when the light output value exceeds the light reception reference value V1) is shortened when the small-capacity type developing cartridge 1005C is mounted, rather than when the large-capacity type developing cartridge 1005B is mounted.

Accordingly, the ratio of the light reception time to a predetermined time (e.g. 13/100) may exceed the determination threshold value (e.g. 12%) when a predetermined residual amount of toner T remains in the large-capacity type developing cartridge 1005B, whereas the ratio of the light reception time to the predetermined time (e.g. 11/100) may not exceed the determination threshold value even though a predetermined residual amount of toner T remains in the small-capacity type developing cartridge 1005C.

As a result, the determining unit 10110 determines that the replacement time has been reached when the predetermined amount of toner T remains in the large-capacity type developing cartridge 1005B, whereas the determining unit 10110 determines that the replacement time has been reached when a specified amount of toner T, which is smaller than the predetermined amount of toner T, remains in the small-capacity type developing cartridge 1005C. Accordingly, it is possible to use the toner T in the small-capacity type developing cartridge 1005C until the toner T remaining therein, which could not be efficiently used in the related art, reaches a proper deterioration state.

Also, in the tenth illustrative embodiment, the toner T in the small-capacity type developing cartridge can be efficiently used, and thus it is possible to increase the number of sheets that can be printed with respect to the small-capacity type developing cartridge. Also, it is possible to reduce the amount of toner T contained in the small-capacity type developing cartridge (i.e. the initial capacity of toner T) as the number of sheets that can be printed is kept, for example, 3,000.

Although the tenth illustrative embodiment has been described, the present invention is not limited to the tenth illustrative embodiment. The detailed configuration of the present invention may be properly modified without deviating from the scope of the present invention.

Figure 38A:
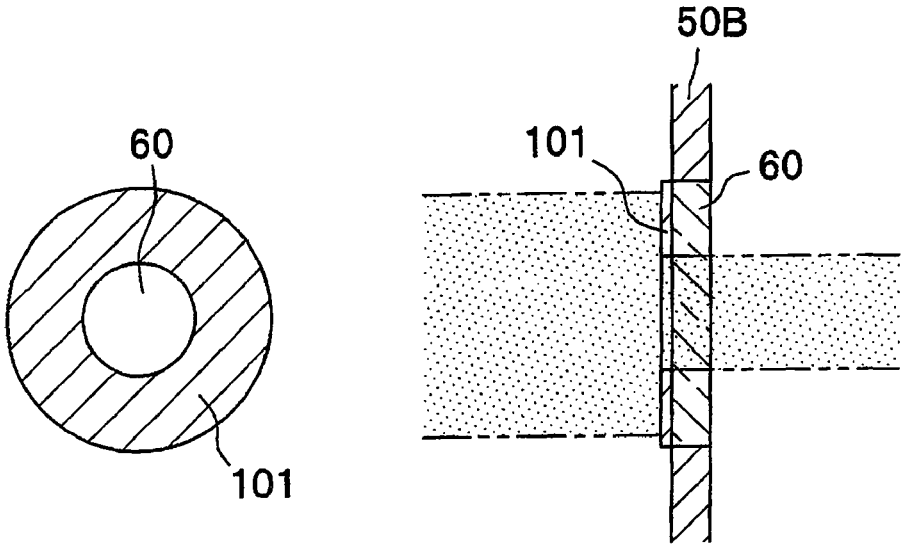
FIG. 38A is a view illustrating a configuration in which a seal is adopted as a light shielding portion.
Figure 38B:
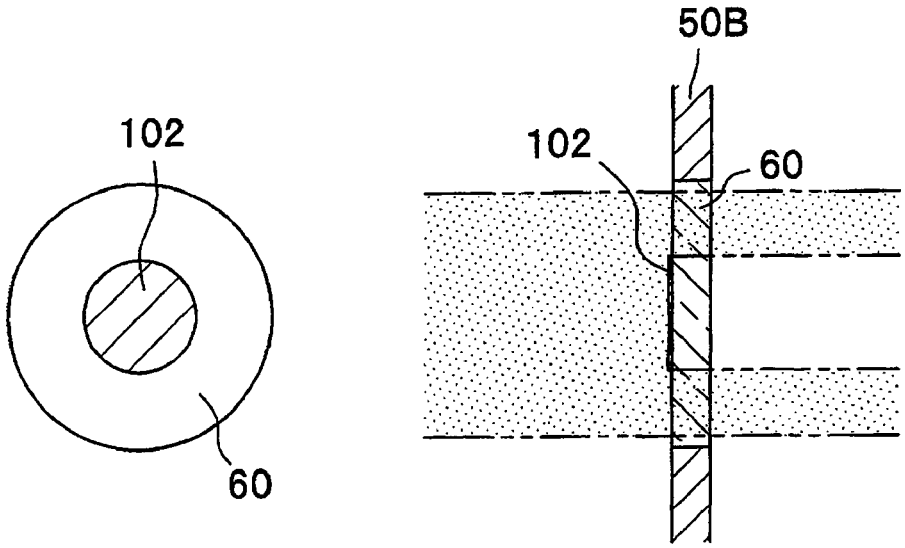
FIG. 38B is a view illustrating a configuration in which paint is adopted as a light shielding portion.

Although in this illustrative embodiment, the light shielding plate 100 is adopted as the light shielding part, the present invention is not limited thereto. For example, the light shielding part may be a colored seal 101 adhered to the light transmission window 60 as shown in FIG. 38A, or may be a colored paint 102 spread onto the light transmission window 60 as shown in FIG. 38B. Also, the light shielding part may be in the shape of a ring as shown in FIG. 38A, or may be in various shapes, such as in the shape of a circle, whose diameter is smaller than the diameter of the light transmission window 60 as shown in FIG. 38B. The transparent light transmission part may be formed with a diameter that is smaller than that in the above-described illustrative embodiments, and a part of a colored developing frame 50B that surrounds the light transmission part may be used as the light shielding part.

Although in the tenth illustrative embodiment, the light shielding plate 100 is provided to make the intensity of light that is received in the light receiving device 82 in the small-capacity type developing cartridge lower than the intensity of light that is received in the light receiving device 82 in the large-capacity type developing cartridge, the present invention is not limited thereto. For example, the light transmission part in the small-capacity type developing cartridge may be formed to have the light transmittance that is lower than the light transmittance of the light transmission part in the large-capacity type developing cartridge.

Figure 39A:
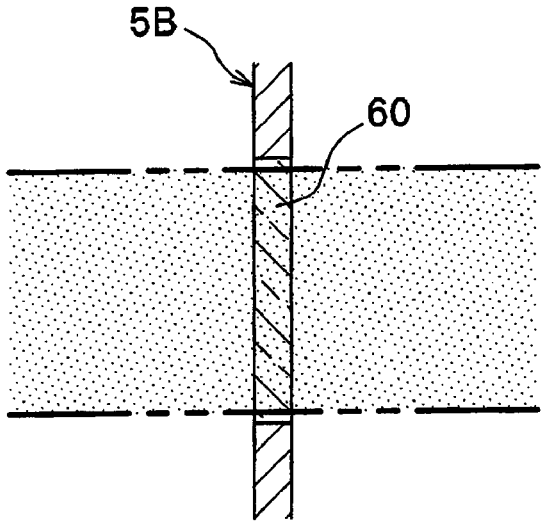
FIGS. 39A and 39B are cross-sectional views illustrating configurations in which a material of a light transmission portion is changed.
Figure 39B:
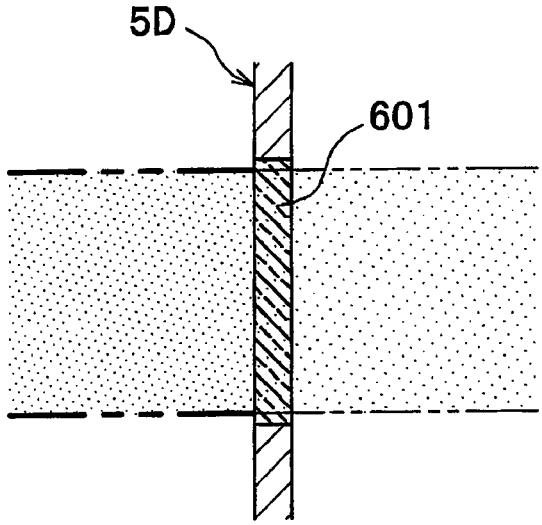

For example, the light transmission window 601 of the small-capacity type developing cartridge 1005D as shown in FIG. 39B may be formed of a material having the light transmittance that is lower than that of the light transmission window 60 of the large-capacity type developing cartridge 1005B as shown in FIG. 39A. That is, when the small-capacity type developing cartridge is manufactured, the light transmission window 601 formed of a material having the light transmittance that is lower than that of the light transmission window 60 used in the large capacity-type developing cartridge may be used. With this configuration, the intensity of light passed through the light transmission window 601 of the small-capacity type developing cartridge becomes lower than the intensity of light passed through the light transmission window 60 of the large-capacity type developing cartridge.

Figure 40A:
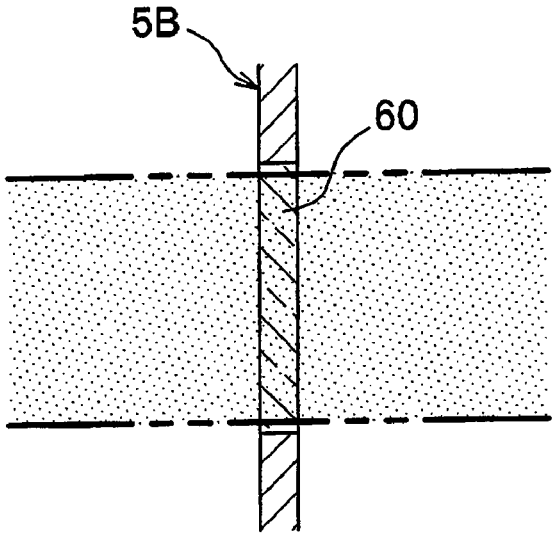
FIGS. 40A and 40B are cross-sectional views illustrating configurations in which the thickness of a light transmission portion is changed.
Figure 40B:
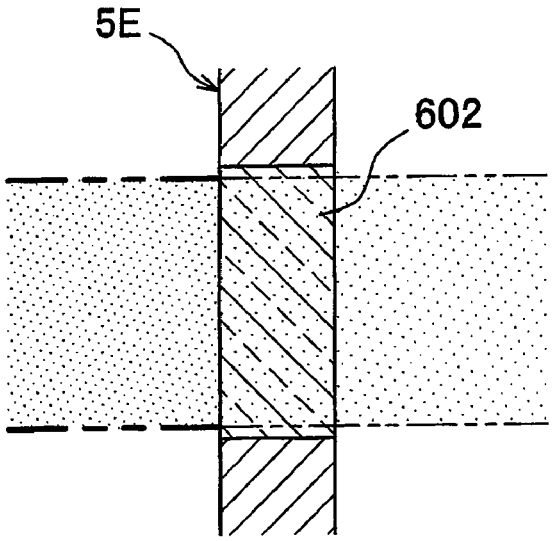

Also, as shown in FIGS. 40A and 40B, by changing the thickness of the light transmission windows 60 and 602, the light transmittance may be changed. Specifically, the light transmission window 602 of the small-capacity type developing cartridge 5E as shown in FIG. 40B may be formed with a thickness that is thicker than that of the light transmission window 60 of the large-capacity type developing cartridge 1005B as shown in FIG. 40A. That is, when the small-capacity type developing cartridge is manufactured, the light transmission window 602 may be used to have a thickness that is thicker than that of the light transmission window 60 used in the large capacity-type developing cartridge. In this case, the intensity of light passed through the light transmission window 602 of the small-capacity type developing cartridge becomes lower than the intensity of light having passed through the light transmission window 60 of the large-capacity type developing cartridge.

Figure 41A:
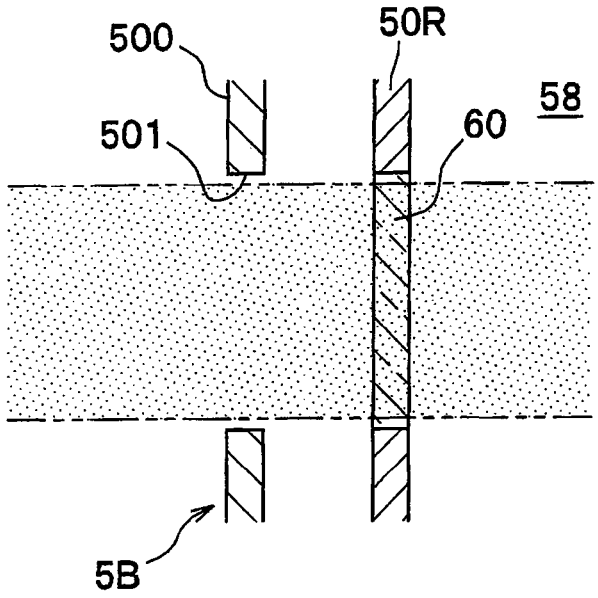
FIGS. 41A and 41B are cross-sectional views illustrating configurations in which the size of a hole on a cover is changed.
Figure 41B:
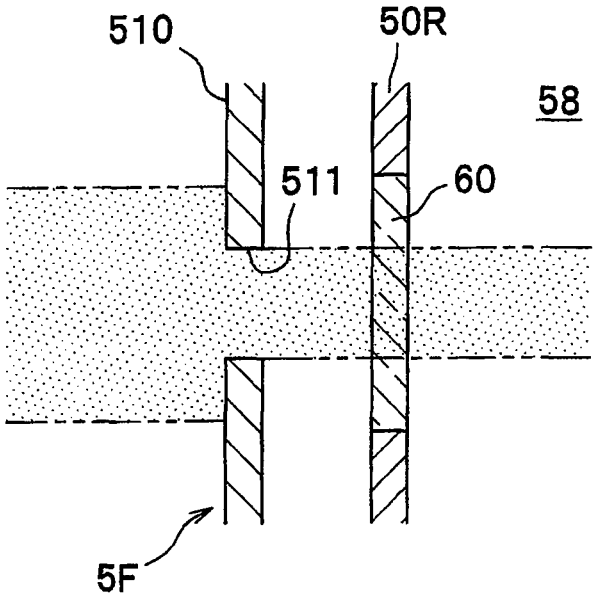

Also, as shown in FIGS. 41A and 41B, when a cover 500 or 510 (e.g. a gear cover) is provided adjacent to a side wall 50R or 50L that constitutes the toner containing chamber 58, the intensity of light may be caused to change according to the type of the developing cartridge by properly changing the size of a hole 501 or 511 formed in a position of the cover 500 or 510 that is opposite to the light transmission window 60. Specifically, by making the size of the hole 511 of the cover 510 of the small-capacity type developing cartridge 1005F as shown in FIG. 41B smaller than the size of the hole 501 of the cover 500 of the large-capacity type developing cartridge, a light shielding part may be formed around the hole 511 of the cover 510 of the small-capacity type developing cartridge as shown in FIG. 41A. Accordingly, in the same manner as in the above-describe illustrative embodiment, the light is shielded in the small-capacity type developing cartridge, and thus the intensity of light in the small-capacity type developing cartridge becomes lowered than that in the large-capacity type developing cartridge.

Figure 42A:
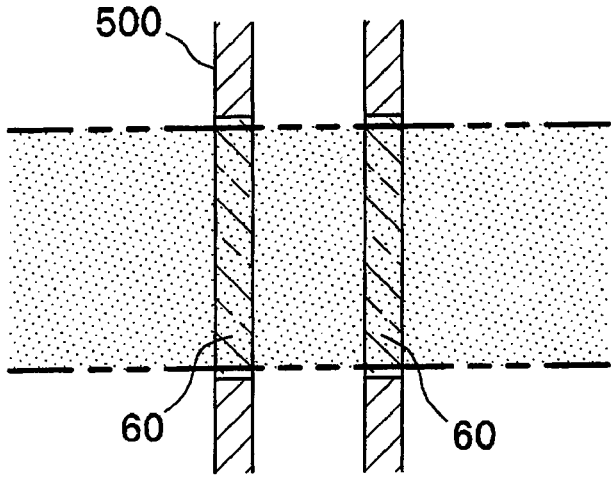
FIGS. 42A and 42B are cross-sectional views illustrating configurations in which a material of a light transmission portion of a cover is changed.
Figure 42B:
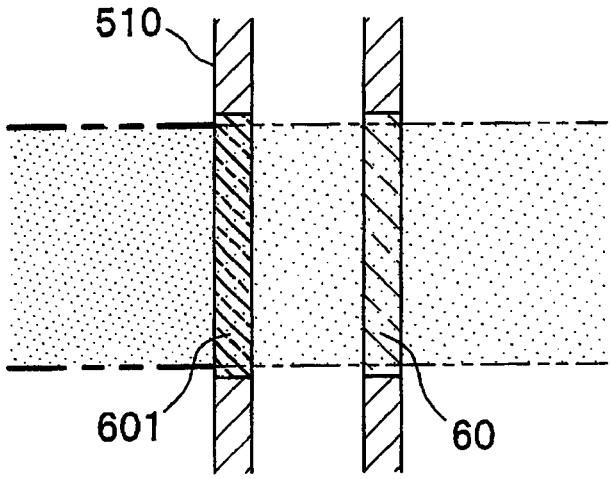

Also, as shown in FIGS. 42A and 42B, when a light transmission part (i.e. a second light transmission part) is provided in the cover 500 or 510, the light transmission window 601 of the cover 510 of the small-capacity type developing cartridge as shown in FIG. 42B may be formed of a material having the light transmittance that is lower than that of the light transmission window 60 of the cover 500 of the large capacity-type developing cartridge as shown in FIG. 42A. With this configuration, the intensity of light having passed through the light transmission window 601 of the small-capacity type developing cartridge becomes lower than the intensity of light having passed through the light transmission window 60 of the large-capacity type developing cartridge.

Figure 43A:
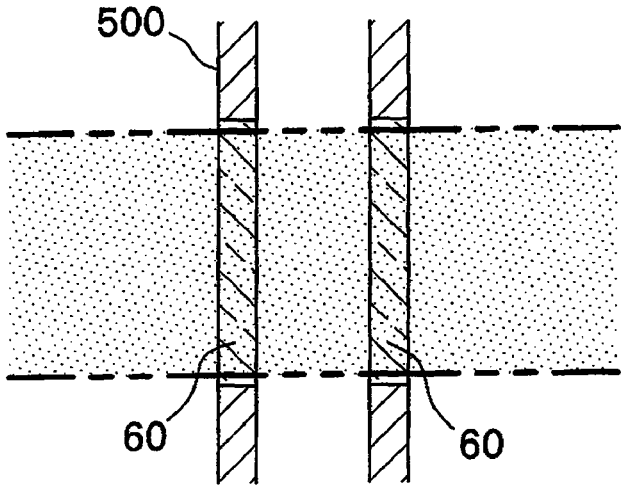
FIGS. 43A and 43B are cross-sectional views illustrating configurations in which the thickness of a light transmission portion of a cover is changed.
Figure 43B:
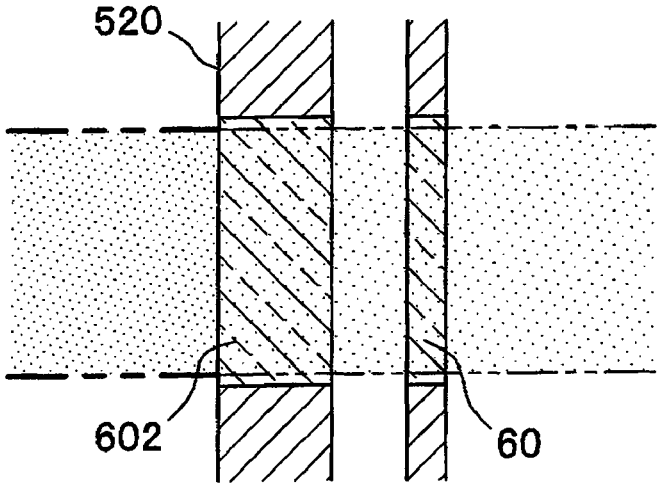

Also, as shown in FIGS. 43A and 43B, by changing the thickness of the light transmission windows 60 and 602 provided in the covers 500 and 520, respectively, in a state in which the light transmission windows 60 and 602 are made of the same material, the light transmittance may be changed. Specifically, the light transmission window 602 of the cover 520 the small-capacity type developing cartridge as shown in FIG. 43B may be formed with a thickness that is thicker than that of the light transmission window 60 of the cover 500 of the large-capacity type developing cartridge as shown in FIG. 43A. Even in this case, the intensity of light having passed through the light transmission window 602 of the small-capacity type developing cartridge becomes lower than the intensity of light having passed through the light transmission window 60 of the large-capacity type developing cartridge. In the illustrative embodiment of changing the thickness of the light transmission windows, the light transmission parts of the respective types may be formed of different materials, assuming that the light transmittance of the light transmission window of the small capacity-type developing cartridge is lowered.

Figure 44A:
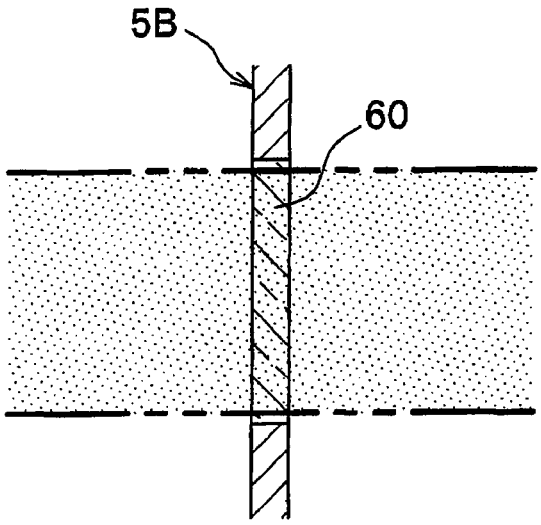
FIGS. 44A and 44B are cross-sectional views illustrating configurations in which members that extend light are adopted as light shielding portions.
Figure 44B:
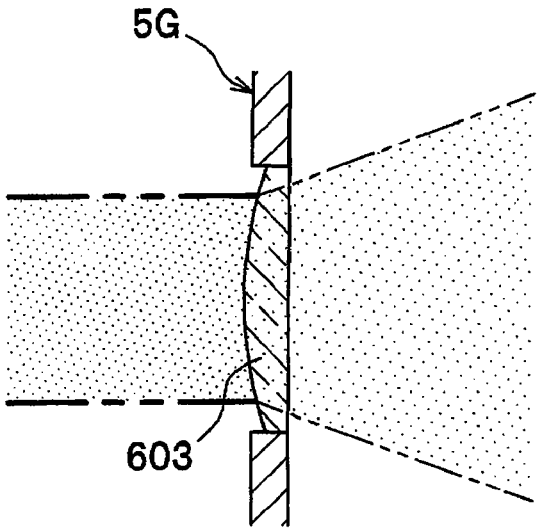

Also, as shown in FIG. 44A, the light transmission window 60 of the large-capacity type developing cartridge 1005B may be formed of a material that directly transmits the light input thereto with hardly refracting the light, and the light transmission window 603 of the small-capacity type developing cartridge 1005G may be formed of a member that expands light, such as a lens as shown in FIG. 44B, That is, when the small-capacity type developing cartridge is manufactured, the light transmission window 60, which is formed of a light expanding member rather than the material that forms the light transmission window 60 used in the large capacity-type developing cartridge, may be used.

Even in this case, the intensity of light having passed through the light transmission window 603 of the small-capacity type developing cartridge can be made to be lower than the intensity of light having passed through the light transmission window 60 of the large-capacity type developing cartridge. As "the light expanding member", a lens that expands the diameter of light as shown in the drawing, a lens that expands light after first condensing the light, a frosted glass having minute unevenness formed thereon, and the like, may be adopted.

Figure 45A:
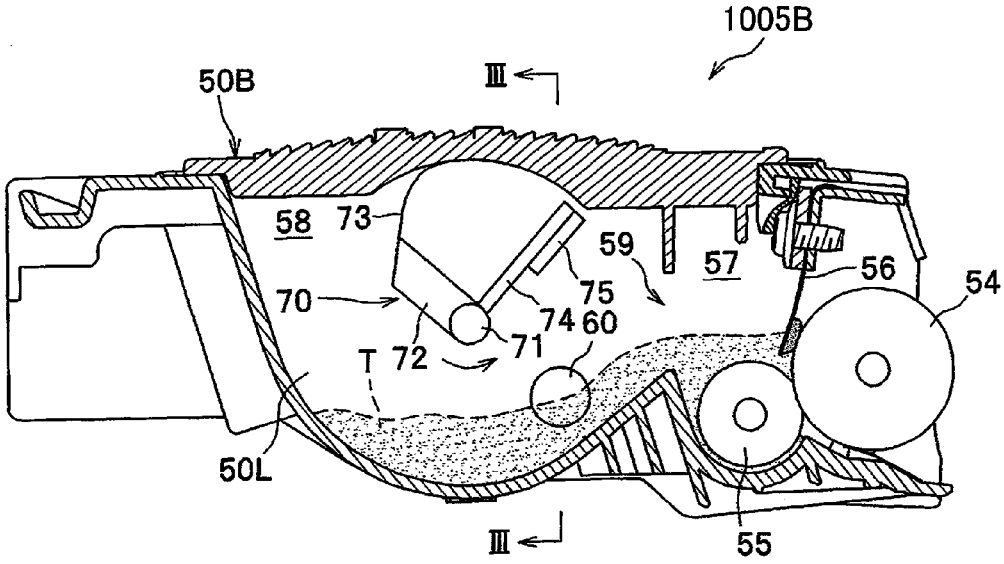
FIGS. 45A and 45B are cross-sectional views illustrating configurations in which the length of a wiper is changed.
Figure 45B:
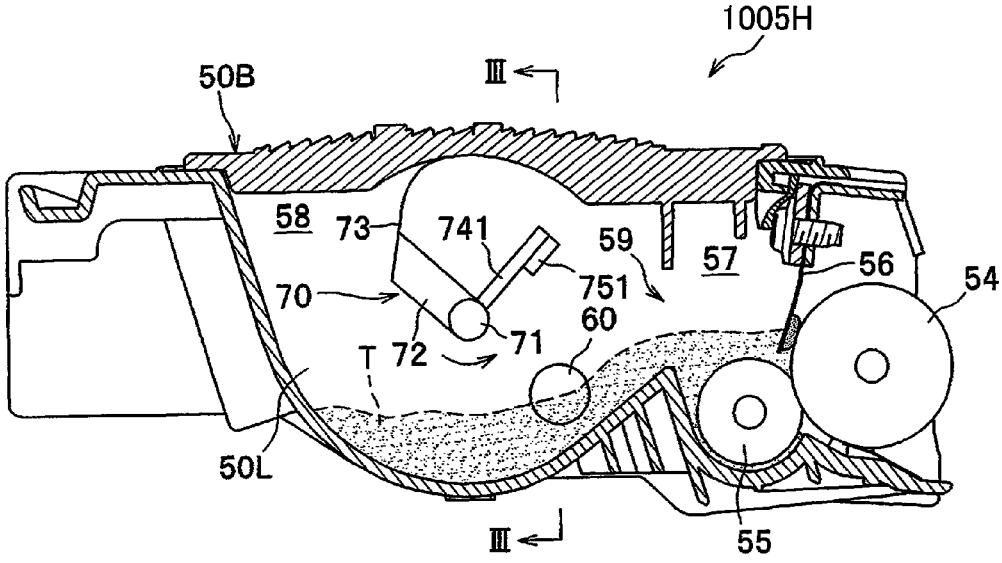

Also, as shown in FIGS. 45A and 45B, by changing the wiper 75 or 751, the intensity of light may be changed according to the type of the developing cartridge. Specifically, the wiper 751 and the wiper attaching unit 741 of the small-capacity type developing cartridge 1005H as shown in FIG. 45B may be formed to be shorter than those of the large-capacity type developing cartridge as shown in FIG. 45A. That is, when the small-capacity type developing cartridge is manufactured, the wiper 751 and the wiper attaching unit 741, which are formed to reduce the wiping area of the light transmission window 60 in comparison to the light transmission window of the large-capacity type developing cartridge, may be used.

Figure 46A:
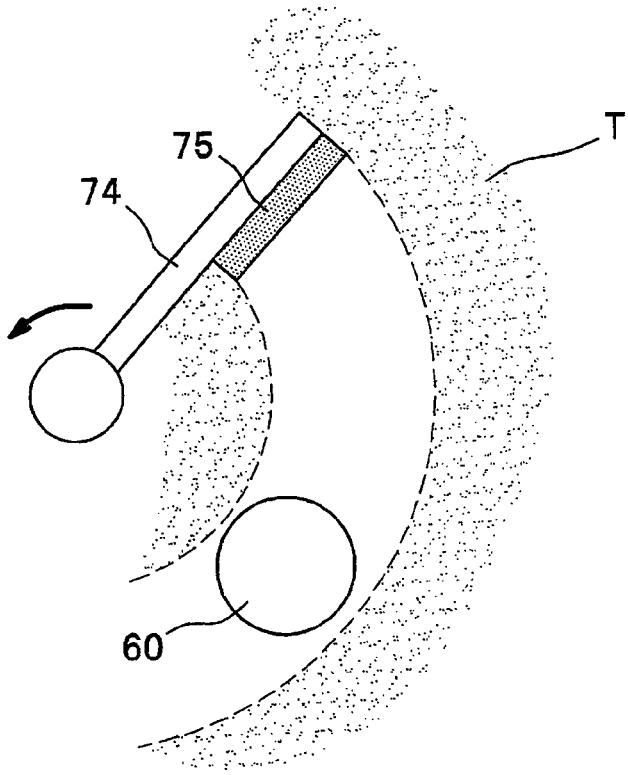
FIGS. 46A and 46B are views for explaining states in which a light transmission portion is wiped by wipers illustrated in FIGS. 45A and 45B.
Figure 46B:
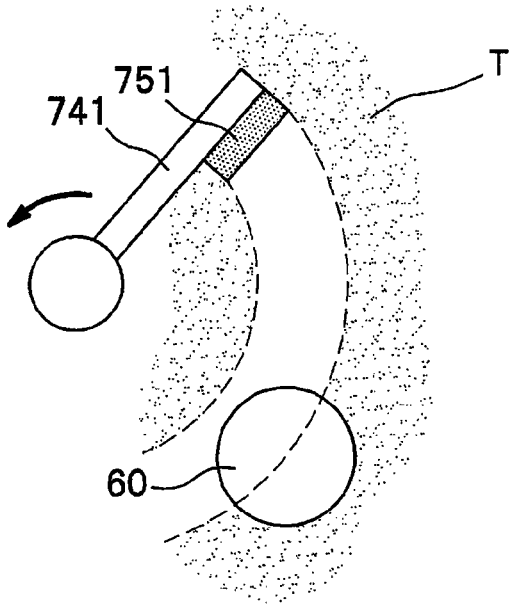

Accordingly, as shown in FIGS. 46A and 46B, the wiping area of the light transmission window 60 of the wiper 751 of the small-capacity type developing cartridge becomes smaller than that of the wiper 75 of the large-capacity type developing cartridge. Accordingly, in the small-capacity type developing cartridge, the non-wiped toner T serves as a light shielding part, and thus the same effect as in the above described illustrative embodiment can be obtained. In this case, in order to reduce the wiping area of the light transmission window 60, the wipe may be formed in diverse shapes, such as a wiper having a front end obliquely cut.

Although in the above-described tenth illustrative embodiment, the light shielding plate 100 is provided only in the small-capacity type developing cartridge, but is not provided in the large-capacity type developing cartridge, the present invention is not limited thereto, The light shielding plate which is movable by a shutter may be provided in both the small-capacity and large-capacity developing cartridges, and the position of the shutter may be changed according to the type of the developing cartridge.

Figure 47A:
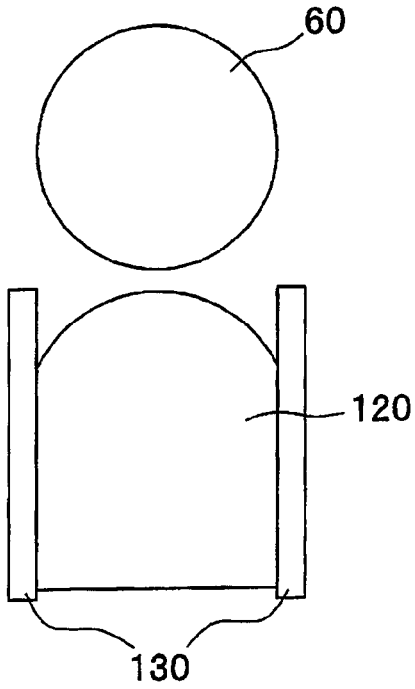
FIGS. 47A and 47B are side views illustrating configurations in which a shutter that moves in straight line is provided.
Figure 47B:
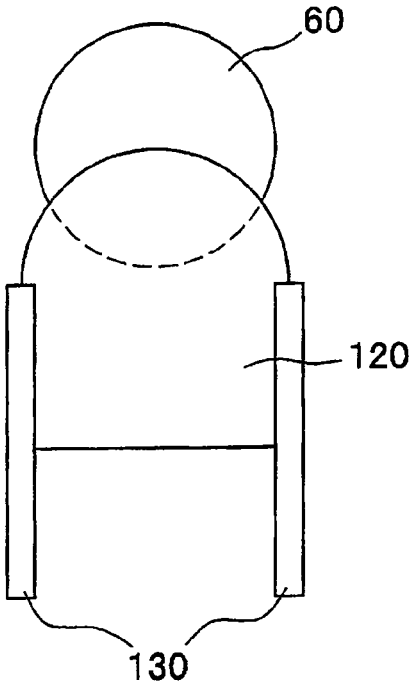

For example, as shown in FIGS. 47A and 47B, a plate type shutter 120 and a pair of rail units 150 for movably supporting the shutter 120 in a straight line are provided in both the small-capacity and large-capacity developing cartridges. Accordingly, the shutter 120 can be shifted between a light shielding position (i.e. a position as shown in FIG. 47B) in which the shutter 120 overlaps a part of the light transmission window 60 and an open position (i.e. a position as shown in FIG. 47A) in which the shutter 120 does not overlap the light transmission window 60.

Accordingly, when the small-capacity type developing cartridge is manufactured, the shutter 120 may be shifted to the light shield position. When the large-capacity type developing cartridge is manufactured, the shutter 120 may be shifted to the open position. Accordingly, the respective types of developing cartridges may be manufactured by common parts.

Figure 48A:
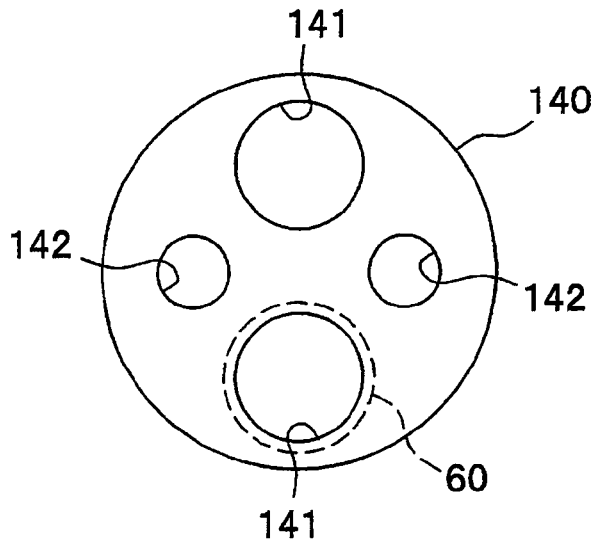
FIGS. 48A and 48B are side views illustrating configurations in which a rotating shutter is provided.
Figure 48B:
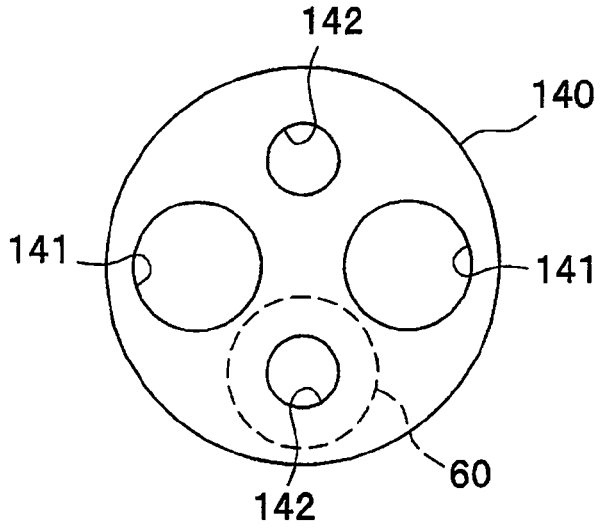

In this case, as the shutter, a rotatable shutter 140 that can be rotated between the light shielding position (i.e. the position as shown in FIG. 48B) and the open position (i.e. the position as shown in FIG. 48A) may be adopted as shown in FIGS. 48A and 48B. Specifically, the shutter 140 is in the shape of a circular plate which has a pair of large-diameter holes 141 symmetrically formed thereon about its center axis and a pair of small-diameter holes 142, which are smaller than the large-diameter holes 141, symmetrically formed thereon about its center axis.

In the open position as shown in FIG. 48A, the large-diameter hole 141 and the light transmission window 60 face each other, so that the cross section of the light passing through the light transmission window 60 becomes equal to the area of the large-diameter hole 141. In contrast, in the light shielding position as shown in FIG. 48B, the small-diameter hole 142 and the light transmission window 60 face each other, so that the cross section of the light passing through the light transmission window 60 becomes smaller than the area of the large-diameter hole 141. Accordingly, the intensity of light in the small-capacity type developing cartridge can be made to be lower than that in the large-capacity type developing cartridge.

Although in the tenth illustrative embodiment, a configuration in which a transparent light transmission window 60 is provided in a colored developing frame 50B as the light transmission part, the present invention is not limited thereto, and a portion that transmits light among the transparent developing frame may be used as the light transmission part.

Although in the tenth illustrative embodiment, two types of developing cartridges that are mountable in the laser printer 1 are used as an example, the present invention is not limited thereto. For example, three or more types of developing cartridges may be used.

While the present invention has been shown and described with reference to certain illustrative embodiments thereof, it will be understood by those skilled in the art that various changes in form and details may be made therein without departing from the spirit and scope of the invention as defined by the appended claims.

Although in the first to tenth illustrative embodiments, the light receiving device 82 has been adopted, of which the output voltage value becomes maximum when the intensity of the received light is minimum, and the output voltage value becomes minimum when the intensity of the received light is maximum, the present invention is not limited thereto. For example, a light receiving device, of which the output voltage value becomes minimum when the intensity of the received light is minimum, and the output voltage value becomes maximum when the intensity of the received light is maximum, may be adopted.

Therefore, a case in which the output value of the light receiving device exceeds the light reception reference value includes a case in which the output value is lower than the light reception reference value as the output value is changed from a value that is larger than the light reception reference value to a value that is smaller than the light reception reference value in addition to a case in which the output value is changed from the value that is smaller than the light reception reference value to the value that is larger than the light reception reference value. That is, to exceed the light reception reference value means to be over the light reception reference value. That is, to exceed the light reception reference value is to get over the light reception reference value.

Although in the first to tenth illustrative embodiments, the developing cartridge (or cartridge) is detachably mounted in the main body casing 2 in a state that the developing cartridge is mounted in the photosensitive unit 5A (i.e. in a state of a process unit 5), the present invention is not limited thereto. For example, the developing cartridge may be configured so that it can be directly attached to or detached from the main body casing 2 (specifically, it can be directly attached to or detached from the photosensitive unit 5A that has been fixed to the main body casing 2).

Although in the first to tenth illustrative embodiments, a developing cartridge having a developing roller 54, a supply roller 55, and a toner containing chamber 58 is adopted as an example of a cartridge, the present invention is not limited thereto. For example, a toner cartridge mainly having a toner containing chamber may be adopted, or a process unit (i.e. a process cartridge) in which the photosensitive unit SA and the developing cartridge SB according to the illustrative embodiments are integral may be adopted.

Although in the first to tenth illustrative embodiments, a laser printer 1 is adopted as an example of an image forming apparatus, the present invention is not limited thereto. For example, a copier or a multi-function apparatus may be adopted.

Although in the first to tenth illustrative embodiments, one developing cartridge is mounted in the laser printer 1, the present invention is not limited thereto. That is, a plurality of developing cartridges may be mounted at a plurality of positions in the laser printer 1, respectively. In this case, at each position, plural types of developing cartridges are detachably mountable.

What is claimed is:

1. An image forming apparatus comprising:

a mounting part configured to allow plural types of cartridges having different initial capacities of developing agent to be detachably mountable therein;

a light emitting device configured to emit light into a cartridge mounted in the mounting part;

a light receiving device configured to receive light emitted from the light emitting device and passed through an inside of the cartridge;

a determining unit configured to determine a replacement time of the cartridge based on a light reception signal of the light receiving device;

a detecting unit configured to detect an initial capacity of the cartridge mounted in the mounting part; and a light emission time changing unit configured to change a light emission time of the light emitting device in accordance with the initial capacity of the cartridge detected by the detecting unit such that the light emission time decreases as the initial capacity of the cartridge becomes smaller.

2. The image forming apparatus according to claim 1, wherein the plural types of cartridges include a first cartridge having a first initial capacity and a second cartridge having a second initial capacity smaller than the first initial capacity, and wherein the light emission time changing unit causes the light emitting device to continuously emit light when the first cartridge is mounted, and causes the light emitting device to emit pulsed light when the second cartridge is mounted.

3. The image forming apparatus according to claim 1, wherein the plural types of cartridges include a first cartridge having a first initial capacity and a second cartridge having a second initial capacity smaller than the first initial capacity, and wherein the light emission time changing unit causes the light emitting device to emit pulsed light at a first light emission interval when the first cartridge is mounted, and causes the light emitting device to emit pulsed light at a second light emission interval such that the light emission time at the second light emission interval is shorter than the light emission time at the first light emission interval when the second cartridge is mounted.

4. An image forming apparatus comprising:

a mounting part configured to allow plural types of cartridges having different initial capacities of developing agent to be detachably mountable therein;

a light emitting device configured to emit light into a cartridge mounted in the mounting part;

a light receiving device configured to receive light emitted from the light emitting device and passed through an inside of the cartridge;

a determining unit configured to determine a replacement time of the cartridge based on a light reception signal of the light receiving device; and a detecting unit configured to detect an initial capacity of the cartridge mounted in the mounting part, wherein the determining unit is configured to change a number of sampling points sampled from the light reception signal within a predetermined time period, in accordance with the initial capacity of the cartridge detected by the detecting unit, such that the number of sampling points decreases as the initial capacity of the cartridge becomes smaller.

5. The image forming apparatus according to claim 4, wherein the plural types of cartridges include a first cartridge having a first initial capacity and a second cartridge having a second initial capacity smaller than the first initial capacity, and wherein the determining unit uses all the sampling points which are sampled within the predetermined time period when the first cartridge is mounted, and uses a part of the sampling points extracted at a predetermined ratio from all the sampling points which are sampled within the predetermined time period when the second cartridge is mounted.

6. The image forming apparatus according to claim 4, wherein the plural types of cartridges include a first cartridge having a first initial capacity and a second cartridge having a second initial capacity smaller than the first initial capacity, and wherein the determining unit uses a part of the sample points extracted at a first ratio from all the sampling points which are sampled within the predetermined time period when the first cartridge is mounted, and uses a part of the sampling points extracted at a second ratio higher than the first ratio from all the sampling points which are sampled within the predetermined time period when the second cartridge is mounted.

7. An image forming apparatus comprising:

a mounting part configured to allow plural types of cartridges having different initial capacities of developing agent to be detachably mountable therein;

a light emitting device configured to emit light into a cartridge mounted in the mounting part;

a light receiving device configured to receive light emitted from the light emitting device and passed through an inside of the cartridge;

a detecting unit configured to detect an initial capacity of the cartridge mounted in the mounting part; and a control unit configured to:

determine a replacement time of the cartridge based on a light reception signal of the light receiving device; and change a light emission time of the light emitting device in accordance with the initial capacity of the cartridge detected by the detecting unit such that the light emission time decreases as the initial capacity of the cartridge becomes smaller.

8. The image forming apparatus according to claim 7, wherein the plural types of cartridges include a first cartridge having a first initial capacity and a second cartridge having a second initial capacity smaller than the first initial capacity, and wherein the control unit causes the light emitting device to continuously emit light when the first cartridge is mounted, and causes the light emitting device to emit pulsed light when the second cartridge is mounted.

9. The image forming apparatus according to claim 7, wherein the plural types of cartridges include a first cartridge having a first initial capacity and a second cartridge having a second initial capacity smaller than the first initial capacity, and wherein the control unit causes the light emitting device to emit pulsed light at a first light emission interval when the first cartridge is mounted, and causes the light emitting device to emit pulsed light at a second light emission interval such that the light emission time at the second light emission interval is shorter than the light emission time at the first light emission interval when the second cartridge is mounted.

* * * * *